US008490312B2

(12) United States Patent
Barrett et al.

(10) Patent No.: US 8,490,312 B2
(45) Date of Patent: Jul. 23, 2013

(54) QUICK COUPLING BARREL SYSTEM FOR FIREARM

(75) Inventors: Jonathan Barrett, Georges Mills, NH (US); Brian Vuksanovich, Poland, OH (US)

(73) Assignee: Sturm, Ruger & Company, Inc.

( * ) Notice: Subject to any disclaimer, the term of this patent is extended or adjusted under 35 U.S.C. 154(b) by 119 days.

(21) Appl. No.: 13/101,548

(22) Filed: May 5, 2011

(65) Prior Publication Data

US 2012/0131835 A1 May 31, 2012

Related U.S. Application Data

(63) Continuation-in-part of application No. 12/409,783, filed on Mar. 24, 2009, now Pat. No. 8,087,194.

(51) Int. Cl.
*F41A 21/00* (2006.01)

(52) U.S. Cl.
USPC ..... 42/75.02

(58) Field of Classification Search
USPC ..... 42/75.01, 75.02
See application file for complete search history.

(56) References Cited

U.S. PATENT DOCUMENTS

| | | | | |
|---|---|---|---|---|
| 255,523 | A * | 3/1882 | Lightburne, Jr. | 285/88 |
| 1,376,834 | A | 5/1921 | Sheppard | |
| 1,628,226 | A * | 5/1927 | Browning | 89/149 |
| 2,981,154 | A | 4/1961 | Sweeney | |
| 3,163,952 | A | 1/1965 | Into | |
| 3,538,810 | A * | 11/1970 | Maillard | 89/159 |
| 3,618,457 | A | 11/1971 | Miller | |
| 3,979,849 | A | 9/1976 | Haskins | |
| 4,087,930 | A | 5/1978 | Grehl | |
| 4,152,855 | A | 5/1979 | DuBiel et al. | |
| 4,220,214 | A | 9/1980 | Benoit | |
| 4,262,578 | A | 4/1981 | Bains | |
| 4,288,938 | A | 9/1981 | Kahn | |
| 4,357,137 | A * | 11/1982 | Brown | 464/75 |
| 4,475,438 | A | 10/1984 | Sullivan | |
| 4,555,860 | A * | 12/1985 | Zedrosser | 42/25 |

(Continued)

FOREIGN PATENT DOCUMENTS

| | | |
|---|---|---|
| AT | 417239 | 12/2008 |
| DE | 3342964 | 6/1985 |

(Continued)

OTHER PUBLICATIONS

Author Unknown, Modern Firearms—Steyr Stg. 77AUG assault rifle, http://world.guns.ru/assault/as20-e, Mar. 20, 2008, 8 pages.

(Continued)

*Primary Examiner* — Samir Abdosh
(74) *Attorney, Agent, or Firm* — The Belles Group, P.C.

(57) ABSTRACT

A spring-loaded quick coupling barrel retaining system for a firearm. The firearm includes a receiver, a barrel nut, and barrel assembly rotatably mounted thereto. In one embodiment, the barrel assembly may include barrel locking lugs which rotatably engage and interlock with corresponding locking elements disposed on the barrel nut such a splines. The barrel assembly further includes a spring member forming a flexible interface with the barrel nut. The spring member self-tensions and tightens the lockup between the barrel assembly and barrel nut to promote a tight fit. Some embodiments may include a lock nut and a setting tool for adjusting the spring force to promote consistently proper lockup from one replacement barrel assembly to the next.

25 Claims, 21 Drawing Sheets

U.S. PATENT DOCUMENTS

| | | | | |
|---|---|---|---|---|
| 4,563,937 | A | 1/1986 | White | |
| 4,651,455 | A | 3/1987 | Geiser, Jr. | |
| 4,655,118 | A | 4/1987 | Bruderer et al. | |
| 4,674,217 | A | 6/1987 | Matievich | |
| 4,733,489 | A | 3/1988 | Kurak | |
| 4,765,224 | A * | 8/1988 | Morris | 89/191.01 |
| 4,779,370 | A | 10/1988 | Cormack | |
| 4,893,426 | A | 1/1990 | Bixler | |
| 4,916,844 | A | 4/1990 | Zedrosser | |
| 4,920,677 | A | 5/1990 | Schuerman | |
| 4,920,679 | A | 5/1990 | Sarles et al. | |
| 4,930,238 | A | 6/1990 | Poff, Jr. | |
| 4,944,109 | A | 7/1990 | Zedrosser | |
| 5,020,260 | A | 6/1991 | Houghton | |
| 5,155,284 | A * | 10/1992 | Flashkes | 42/75.02 |
| 5,198,600 | A * | 3/1993 | E'Nama | 42/90 |
| 5,228,887 | A | 7/1993 | Mayer | |
| 5,247,758 | A | 9/1993 | Mason | |
| 5,375,358 | A | 12/1994 | Riness et al. | |
| 5,410,834 | A | 5/1995 | Benton et al. | |
| 5,433,133 | A | 7/1995 | LaFrance | |
| 5,520,019 | A | 5/1996 | Schuetz | |
| 5,559,302 | A | 9/1996 | Latka | |
| 5,826,361 | A | 10/1998 | Jamison | |
| 5,834,678 | A | 11/1998 | Kalb | |
| 5,907,919 | A | 6/1999 | Keeney | |
| 5,937,563 | A * | 8/1999 | Schuetz et al. | 42/106 |
| 5,987,797 | A | 11/1999 | Dustin | |
| 6,000,161 | A | 12/1999 | Aalto | |
| 6,044,748 | A | 4/2000 | Westrom | |
| 6,182,389 | B1 | 2/2001 | Lewis | |
| 6,205,696 | B1 | 3/2001 | Bilgeri | |
| 6,250,198 | B1 * | 6/2001 | Vendetti et al. | 89/44.02 |
| 6,279,258 | B1 | 8/2001 | Hashman | |
| 6,293,040 | B1 | 9/2001 | Luth | |
| 6,295,751 | B1 * | 10/2001 | Piwonski | 42/1.15 |
| 6,321,477 | B1 | 11/2001 | Watson Jr. | |
| 6,604,314 | B2 | 8/2003 | Fluhr | |
| 6,606,812 | B1 | 8/2003 | Gwinn, Jr. | |
| 6,609,319 | B1 * | 8/2003 | Olson | 42/16 |
| 6,609,323 | B1 | 8/2003 | Donnelly | |
| 6,655,372 | B1 | 12/2003 | Field et al. | |
| 6,671,990 | B1 * | 1/2004 | Booth | 42/75.01 |
| 6,681,677 | B2 | 1/2004 | Herring | |
| 6,694,660 | B1 | 2/2004 | Davies | |
| 6,752,061 | B2 * | 6/2004 | Knorich et al. | 89/14.05 |
| 6,959,509 | B2 * | 11/2005 | Vais | 42/75.02 |
| 6,971,202 | B2 * | 12/2005 | Bender | 42/16 |
| 7,076,904 | B1 * | 7/2006 | Rustick | 42/75.02 |
| 7,331,135 | B2 | 2/2008 | Shimi | |
| 7,347,023 | B2 | 3/2008 | Wossner et al. | |
| 7,640,689 | B2 | 1/2010 | Fluhr | |
| 7,716,865 | B2 | 5/2010 | Daniel et al. | |
| 7,721,639 | B2 | 5/2010 | Wossner | |
| 7,735,410 | B2 | 6/2010 | Clark | |
| 7,748,154 | B2 | 7/2010 | Moretti | |
| 8,046,949 | B1 | 11/2011 | Daniel | |
| 8,240,074 | B2 | 8/2012 | Vuksanovich | |
| 2001/0029687 | A1 | 10/2001 | Hashman | |
| 2002/0073591 | A1 | 6/2002 | Schweikart | |
| 2002/0139241 | A1 | 10/2002 | Butler | |
| 2002/0162266 | A1 | 11/2002 | Clay | |
| 2004/0049964 | A1 * | 3/2004 | Vais | 42/75.02 |
| 2004/0168362 | A1 | 9/2004 | Aalto et al. | |
| 2005/0081707 | A1 * | 4/2005 | Herring | 89/33.14 |
| 2005/0188591 | A1 | 9/2005 | Stone | |
| 2005/0229463 | A1 | 10/2005 | Tashjian | |
| 2005/0241211 | A1 | 11/2005 | Swan | |
| 2005/0262752 | A1 | 12/2005 | Robinson et al. | |
| 2006/0010748 | A1 * | 1/2006 | Stoner et al. | 42/71.01 |
| 2006/0236582 | A1 | 10/2006 | Lewis et al. | |
| 2007/0033851 | A1 * | 2/2007 | Hochstrate et al. | 42/75.01 |
| 2007/0186458 | A1 | 8/2007 | Wait | |
| 2007/0193102 | A1 * | 8/2007 | Briggs | 42/76.02 |
| 2007/0199435 | A1 * | 8/2007 | Hochstrate et al. | 89/191.02 |
| 2009/0013579 | A1 | 1/2009 | Fluhr | |
| 2009/0019754 | A1 | 1/2009 | Moretti | |
| 2009/0031607 | A1 | 2/2009 | Robinson et al. | |
| 2010/0005956 | A1 | 1/2010 | Wossner | |
| 2010/0122483 | A1 | 5/2010 | Clark | |
| 2010/0162605 | A1 | 7/2010 | Laney et al. | |
| 2010/0175290 | A1 | 7/2010 | Duplessis et al. | |
| 2010/0269682 | A1 | 10/2010 | Vuksanovich et al. | |
| 2010/0319231 | A1 * | 12/2010 | Stone et al. | 42/71.01 |
| 2011/0000119 | A1 * | 1/2011 | Desomma et al. | 42/75.02 |
| 2011/0016762 | A1 | 1/2011 | Davies | |
| 2012/0073177 | A1 | 3/2012 | Laney et al. | |
| 2012/0132068 | A1 | 5/2012 | Kucynko | |
| 2012/0137556 | A1 | 6/2012 | Laney et al. | |
| 2012/0311908 | A1 | 12/2012 | Kenney et al. | |

FOREIGN PATENT DOCUMENTS

| | | |
|---|---|---|
| EP | 0115034 | 8/1984 |
| EP | 0143454 | 6/1985 |
| ES | 2304040 | 9/2008 |
| GB | 506632 | 6/1939 |
| JP | 2000 213891 | 8/2000 |
| JP | 2004 020184 | 1/2004 |
| WO | WO86/07136 | 5/1985 |
| WO | WO98/27399 | 6/1998 |
| WO | 2008103193 | 8/2008 |
| WO | 2010111026 | 9/2010 |

OTHER PUBLICATIONS

Author Unknown, Steyr AUG, http://en.wikipedia.org/wiki/Steyr_AUG, Mar. 19, 2008, 6 pages.

Author Unknown, The Monolith: Quick-Change Barrel System for the M-16, http://www.military.com/soldiertech/0,14632,soldiertech_RailPlatform, Mar. 20, 2008, 8 pages.

Author Unknown, The HK416, http://www.hkpro.com/hk416, Nov. 28, 2007, 13 pages.

Author Unknown, Armalite AR-18: The Windowmaker, http://www.weaponryonline.com/Reviews-req-showcontent-id-15, Apr. 3, 2008, 4 pages.

Author Unknown, Armalite AR-18 assault rifle, http://world.guns.ru/assault/as36-e, Apr. 3, 2008, 6 pages.

Author Unknown, AR-10, http://en.wikipedia.org/wiki/AR-10, Mar. 19, 2008, 6 pages.

Author Unknown, Heckler & Koch HK416, http://en.wikipedia.org/wiki/Heckler_%26_Koch_HK416, Mar. 19, 2008, 4 pages.

Author Unknown, AR-15, http://en.wikipedia.org/wiki/AR-15, Mar. 19, 2008, 7 pages.

Author Unknown, M16 Rifle, http://en.wikipedia.org/wiki/M16_rifle, Mar. 19, 2008, 22 pages.

Author Unknown, Ultimax 100, http://en.wikipedia.org/wiki/Ultimax_100, Mar. 13, 2008, 4 pages.

Author Unknown, STK/CIS Ultimax 100 light machine gun (Singapore), http://world.guns.ru/machine/mg20-e, Mar. 13, 2008, 3 pages.

Author Unknown, M4 Carbine, http://en.wikipedia.org/wiki/M4_Carbine, Mar. 19, 2008, 8 pages.

Author Unknown, Steyr Stg. 77 AUG assault rifle (Austria), http://world.guns.ru/assault/as20-e, Mar. 20, 2008, 8 pages.

Author Unknown, STK/CIS Ultimax 100 Light Machine Gun (Singapore), http://modernfirearms.net/machine/mg20-e, Mar. 19, 2008, 4 pages.

Crane, David Ultimax 100 MK4: Best Choice for USMC Infantry Automatic Rifle, http://www.defensereview.com/modules.php?name=News&file=article&sid=853, Mar. 13, 2008, 4 pages.

Nicholls Firearms & Ammo, Heckler & Koch HK416 Enhanced Carbine, 1 page.

Singapore Technologies Kinetics, Ultimax 100—The Lightest 5.56 mm Calibre Machine Gun in the World, 2 pages.

International Search Report and Written Opinion in PCT/US2010/026603 dated May 11, 2010, 12 pgs.

Corresponding PCT/US2012/032092 Search Report & Written dated Jun. 28, 2012.

Corresponding PCT/US2012/032060 Search Report & Written Opinion dated Nov. 30, 2012.

Corresponding PCT/US2012/032132 Search Report & Written Opinion dated Jan. 18, 2013.

* cited by examiner

QUICK COUPLING BARREL SYSTEM FOR FIREARM

CROSS-REFERENCE TO RELATED APPLICATIONS

This application is a continuation-in-part of commonly owned U.S. patent application Ser. No. 12/409,783 filed Mar. 24, 2009, entitled "Firearm Barrel Retaining System," which is incorporated herein by reference in its entirety.

BACKGROUND OF THE INVENTION

The present invention generally relates to firearms, and more particularly to a spring-loaded quick coupling barrel retaining system suitable for without limitation semi-automatic and automatic rifles.

Various arrangements are known to secure the barrel of a firearm to the receiver or frame. One known basic barrel retaining system used is to form a simple threaded connection between the breech end of the barrel and the receiver or frame. Other arrangements have been employed, however, on semi-automatic/automatic auto-loading rifles like the military and law enforcement versions of the M4-type and M16-type carbines, and semi-automatic counterparts such as AR-15 type carbines. The extreme operating conditions of rapid-fire automatic weapons results in rapid wearing down of rifling in the bore of the barrel, thereby requiring periodic replacement of the barrel sometimes during the exigencies of combat. In addition, it is sometimes be desirable to swap out barrel configurations and/or lengths depending on changing field conditions or combat environments encountered in which the automatic carbines will be used. For example, shorter lighter barrels are often desirable for close-quarters engagement like building sweeps. Longer heavier barrels may be needed in other situations for improved accuracy when firing at greater distances. Accordingly, it is desirable that today's semi-automatic/automatic rifles have readily replaceable barrels and be quickly adaptable to the situation at hand.

A known barrel retaining system used in M16-type carbines provides a detachable barrel that may be separated from the upper receiver for replacement. One such arrangement is generally shown in U.S. Pat. No. 6,971,202. This arrangement utilizes a threaded nipple on the front of the receiver that receives a threaded cast aluminum or steel barrel nut having complementary mating internal threads. Except for the threading and sometimes castellated collar for gripping with a wrench, the barrel nut is a generally plain tubular structure and acts much as an ordinary nut. The breech end of the steel barrel has a short stub-like tubular extension that is equipped with an annular flange spaced inwards from the end of the extension. The barrel extension may be an integral part of the barrel or may be a separate tubular component that is threaded onto the breech end of the barrel. The barrel extension further contains internal bolt-locking lugs with angled feed ramps for loading cartridges into the chamber formed in the breech end of the barrel. The bolt-locking lugs in the barrel extension engage bolt lugs formed on the forward end of a rotatable and axially reciprocating steel bolt slidably mounted in the receiver to provide a steel-to-steel lockup for withstanding the forces of combustion when the rifle is fired. The barrel is attached to the receiver by inserting the barrel extension through the threaded nipple into the receiver until the barrel extension flange is abutted against the receiver. The barrel nut is then slipped partially over the stub portion of the barrel and flange, and threaded onto the receiver nipple thereby trapping the barrel flange between an annular shoulder formed in the barrel nut and the receiver to secure the barrel. In an alternative reverse arrangement of this type barrel retaining system, the barrel nut may be externally threaded and the receiver contains a bore having mating internal threads as shown in U.S. Patent Application Publication No. US2007/0033851. In either of the foregoing arrangements, the barrel is held to the receiver by trapping the barrel flange against the receiver with the barrel nut.

The foregoing combination barrel nut/barrel flange retaining system does not lend itself to rapid barrel swapping and makes it cumbersome to exchange barrels under field conditions. The barrels of the foregoing rifles also become extremely hot during rapid fire automatic mode or semi-automatic mode and are difficult to handle directly with unprotected hands. The handguard, which typically surrounds such barrels typically must be at least partially disassembled in some designs often requiring additional tools to gain access to the barrel nut. Specialized tools such as barrel nut wrenches may also be required to unthread and subsequently reinstall the barrel nut with an appropriate torque preload. In summary, the barrel exchange process with the conventional barrel nut arrangement is cumbersome and time consuming, and not well suited for rapid barrel swapping particularly under combat conditions.

An improved barrel retaining system having quick-change characteristics is desirable.

SUMMARY OF THE INVENTION

The present invention provides a firearm with a quick-change barrel retaining system suitable for use in rifles and other firearms. In a preferred embodiment, the barrel is secured to the rifle by a locking member such as a barrel nut which preferably is attached to receiver. Although in one embodiment the barrel nut may be similarly threaded onto the receiver assembly like a conventional barrel nut in the usual manner, the barrel nut according to the present invention is configured and adapted to accomplish the barrel locking function in a different manner. Unlike known barrel nuts described heretofore that secure the barrel to the receiver by trapping an annular barrel flange between the barrel nut and receiver, the present barrel nut in a preferred embodiment is specially configured to directly engage the rifle barrel such that a locking relationship is formed between the barrel nut and barrel independently of the receiver. Advantageously, unlike known prior barrel nuts, the present barrel nut does not require removal or other manual manipulation by a user in order to remove the barrel from the rifle, but rather acts as a replaceable extension of the receiver. The present barrel nut may remain attached to the receiver assembly and stationary in position when a barrel is removed or installed, as will be further described herein. Advantageously, this allows the barrel to be quickly changed without tools while retaining the originally set point of aim for the new barrel because the barrel nut remains fixed to the firearm. Therefore, each new barrel need not be re-sighted after installation which is particularly important during field combat conditions. Also advantageously, the handguard and components supported by or mounted to the handguard also do not require partial disassembly or removal in order to replace the barrel. Preferably, the barrel retaining system does not require the use of any separate tools to remove the barrel from the firearm.

In some preferred embodiments, a barrel retaining system according to principles of the present invention provides a releasable dual locking mechanism intended to improve the tightness and reliability of the coupling between the barrel and rifle. The barrel retaining system reduces or eliminates possible vibration/rattling when the rifle is discharged. In some embodiments, an additional third locking mechanism may be provided to further enhance a secure locking relationship between the barrel and rifle. In one embodiment, the three locking mechanisms detachably lock the barrel to the rifle at three different axial locking locations for improved tightness. In one embodiment, one locking mechanism may be provided by barrel locking lugs formed on a barrel assembly that mate with corresponding locking elements such as splines formed on a barrel nut. A second locking mechanism may be provided by engagement between a flange on the barrel assembly with the barrel nut splines. A third locking mechanism may be provided by frictional engagement between a tapered contact surface on the barrel assembly with the barrel nut splines. The foregoing locking mechanisms and associated structures are further described herein.

According to one embodiment, a barrel retaining system for a firearm includes: a receiver defining a cavity that receives a reciprocating bolt; a barrel having a bore defining a longitudinal axis and an axial path for a bullet; a barrel extension coupled to the barrel, the barrel extension including a plurality of barrel locking lugs extending radially outwards from the barrel extension, the barrel extension being rotatable between unlocked and locked positions; and a barrel nut attached to the receiver and being configured to receive the barrel extension at least partially therein, the barrel nut including a plurality of internal splines configured to engage the barrel locking lugs, wherein when the barrel extension is inserted into the barrel nut and rotated into the locked position, the barrel locking lugs engage the splines to secure the barrel to the firearm.

According to another embodiment, a barrel retaining system for a firearm includes: a receiver having a front and defining a cavity configured to receive a reciprocating bolt; a barrel having a bore defining a longitudinal axis and an axial path for a bullet; a barrel extension removably attached to the barrel, the barrel extension including a plurality of barrel locking lugs extending radially outwards from the barrel extension and an annular flange disposed forward of the locking lugs, the barrel extension being rotatable between unlocked and locked positions; a barrel nut extending in a forward axial direction from the front of the receiver, the barrel nut being configured and adapted to receive the barrel extension; a plurality of longitudinally-extending splines formed on the barrel nut that protrude radially inwards therefrom, the splines being configured and adapted for engaging the barrel locking lugs and flange, the splines defining a plurality of channels therebetween configured and adapted for slidably receiving the barrel locking lugs to enable the barrel extension to be inserted into the barrel nut; an annular locking groove formed in the barrel nut that communicates with the channels, the locking groove being configured and adapted to receive the barrel locking lugs and allow the lugs to be rotated when positioned in the groove. In one embodiment, inserting the barrel extension into the barrel nut by sliding the barrel locking lugs of the barrel extension along the channels of the barrel nut into the locking groove, and rotating the barrel extension into the locked position engages each spline with one of the barrel locking lugs and a forward portion of the barrel extension to secure the barrel to the firearm. In one embodiment, the forward portion of the barrel extension defines an annular frustoconical portion forming a tapered contact surface that is frictionally engaged by at least some of the splines when the barrel extension is inserted into the barrel nut and rotated. In some embodiments, at least some of the barrel locking lug include a means for axially displacing the barrel extension with respect to the barrel nut when the barrel extension is inserted into the barrel nut and rotated with respect to the barrel nut. In one embodiment, the means for axially displacing the barrel extension is formed by an angled camming notch that slidably engages a rear end of each spline and axially displaces the barrel extension rearward with respect to the barrel nut upon rotation of barrel extension.

In another embodiment, a firearm with a detachable barrel includes: a receiver having a front and defining a cavity that receives a reciprocating and rotatable bolt having bolt lugs; a barrel assembly having a breech end, a muzzle end, and a bore defining an axial path for a bullet, the barrel assembly including bolt locking lugs for releasably engaging the bolt lugs for forming a locked breech and a plurality of barrel locking lugs extending radially outwards from barrel assembly; and a barrel nut attached to the receiver and receiving a portion of the barrel assembly therein, the barrel nut including a plurality of locking elements being configured and adapted to engage the barrel locking lugs. In one embodiment, the barrel assembly is rotatable in a first direction to engage the barrel locking lugs with the locking elements to lock the barrel assembly to the firearm, and the barrel assembly is rotatable in a second opposite direction to disengage the barrel locking lugs from the locking elements to unlock the barrel assembly from the firearm.

In another embodiment, a firearm with a detachable barrel includes: a receiver having a front and defining a cavity that receives a reciprocating bolt having bolt lugs; a barrel nut attached to the front of the receiver, the barrel nut including a plurality of longitudinally-extending splines extending radially inwards from an interior surface of the barrel nut, the splines each including a front end and an opposite rear end defining a length therebetween; and a barrel extension at least partially insertable into the barrel nut and rotatable therein for coupling a barrel to the barrel nut, the barrel extension being configured and arranged to engage both the front and rear ends of the splines upon rotation of the barrel extension when positioned in the barrel nut for locking the barrel extension to the barrel nut.

A method for attaching a barrel to a firearm is also provided. In one embodiment, the method includes: axially inserting at least a portion of a barrel assembly into a barrel nut attached to a receiver or frame of the firearm; rotating the barrel assembly in a first direction; and engaging a plurality of barrel locking lugs on the barrel assembly with the barrel nut such that the barrel assembly cannot be axially removed from the barrel nut.

Spring-Loaded Quick Coupling Barrel Retaining System

According to another aspect of the present invention, a spring-loaded quick coupling barrel retaining system is provided having characteristics of being self-tensioning and self-adjusting to establish a tight and secure lock up between the user-removable barrel assembly and rifle. In one possible preferred embodiment, the spring-loaded barrel system incorporates a biasing or spring member that may be mounted on the barrel assembly to provide an axially flexible interface between the barrel nut mounted to the receiver and a mating part of the barrel assembly. In one embodiment, the mating part may be provided on an axially positionable lock nut threadably coupled to the barrel. The spring member preferably acts between a pair of radially extending spring seating surfaces that face in opposing axial directions. One radial spring seating surface each may be disposed on the stationary receiver such as on barrel nut mounted thereon and on the barrel assembly such as on the lock nut: the barrel assembly being movable independently of the receiver.

The spring member advantageously at least partially alleviates some of the stringent manufacturing tolerances that may be otherwise necessary and reduces the tolerance stack between the barrel nut and barrel assembly, as further described herein. This translates into simpler and less costly fabrication of components used in the barrel system by reducing and/or eliminating machining operations. In addition, reduction in the tolerance stack promotes more reliable meshing of inter-fitting parts by eliminating some of the potential dimensional variations possible due to manufacturing tolerance or service factors such as heat and pressure.

In one possible embodiment, a firearm with spring-loaded quick coupling barrel retaining system includes: a receiver; a barrel nut coupled to the receiver and defining a first radial spring seating surface; a barrel assembly rotatably coupled to the barrel nut and defining a longitudinal axis, a forward muzzle end, and an opposite rearward breech end, the barrel assembly defining a second radial spring seating surface; and a spring member operably engaged between the first and second radial spring seating surfaces and urging the surfaces apart in opposing axial directions. The spring member biases barrel assembly in a distal direction away from the barrel nut such as a forward direction. In one embodiment, the spring member may be a coned (e.g. cone shaped) disc spring. The barrel assembly may be collected defined by a barrel and barrel extension removably mounted to the barrel. The second radial spring seating surface may be disposed on a rotatable lock nut threadably engaged with the barrel assembly and axially movable thereon to adjust the spring force produced by the spring member when engaged with the barrel nut and barrel assembly.

In another embodiment, a firearm with spring-loaded quick coupling barrel retaining system includes: a receiver having an axially movable bolt; a barrel nut coupled to the receiver and defining a first radial spring seating surface; a barrel assembly defining a longitudinal axis and having a forward muzzle end and a rearward breech end a portion of which is received through the barrel nut, the barrel assembly being rotatably engageable with the barrel nut and further defining a second radial spring seating surface; and a spring member mounted on the barrel assembly and operably engaging the first and second radial spring seating surfaces, the spring member biasing the barrel assembly in a forward direction toward the muzzle end. The barrel nut may further include a plurality of longitudinally-extending splines arranged and configured to rotatably engage a plurality of corresponding barrel locking lugs disposed on the barrel assembly. When the barrel assembly is inserted into the barrel nut and rotated into a locked position, the barrel locking lugs engage the splines to prevent axial withdrawal of the barrel assembly from the barrel nut.

According to yet another embodiment, a firearm with spring-loaded quick coupling barrel retaining system includes: a receiver; a barrel nut coupled to the receiver and having a front end; a barrel assembly rotatably coupled to the barrel nut and aligned concentrically with the barrel nut, the barrel assembly defining a longitudinal axis, a forward muzzle end, and an opposite rearward breech end, the barrel assembly being rotatable between a locked rotational position in which the barrel assembly is axially removable from the barrel nut and an unlocked rotational position in which the barrel assembly is not axially removable from the barrel nut; and a spring member mounted on the barrel assembly and aligned concentrically with the barrel nut and barrel assembly, the spring operably engaging the barrel nut so as to bias the barrel assembly in a forward direction away from the barrel nut.

A method for mounting a spring-loaded quick coupling barrel assembly to a firearm is also provided. In one embodiment, a method for removably mounting a spring-loaded quick coupling barrel assembly to a firearm includes: providing a receiver with an axially movable bolt and a barrel nut coupled to the receiver inserting a rearward portion of a barrel assembly axially into the barrel nut, the rearward portion of the barrel assembly defining a chamber at a rearward breech end for holding a cartridge and an opposing forward muzzle end; compressing a spring member against the barrel nut with the barrel assembly; rotating the barrel assembly in a first rotational direction; and lockingly engaging the barrel assembly with the barrel nut in a locked position, wherein the barrel assembly cannot be axially removed from the barrel nut. In one embodiment, the compressing step may include compressing the spring member against a lock nut rotatably disposed on the barrel assembly. In one embodiment, the method includes axially biasing the barrel assembly forward away from to barrel nut with the spring member. In one embodiment, the lockingly engaging step includes positioning barrel locking lugs disposed on the barrel assembly behind splines disposed on the barrel nut, the splines preventing axial removal of the barrel assembly from the barrel nut when the barrel assembly is in the locked position. The spring member operates to maintain tight engagement between the barrel locking lugs and splines.

Spring-Loaded Quick Coupling Barrel Assembly

A spring-loaded quick-coupling barrel assembly for the foregoing firearm with spring-loaded barrel retaining system is provided.

According to one embodiment, a quick coupling barrel assembly for removable mounting to a receiver of a rifle includes: a barrel having a bore defining a longitudinal axis and an axial path for a bullet; a barrel extension having a front end coupled to the barrel and a rear end for coupling to the receiver of the rifle, the barrel and barrel extension collectively defining a barrel assembly; an annular shaped spring member coaxially mounted on the barrel assembly; and a radial spring seating surface disposed on the barrel assembly and facing in an axial direction. The spring member is positioned for compression against the radial spring seating surface when the barrel assembly is mounted to the receiver of the rifle. In one embodiment, the spring member is a coned disc (Belleville) spring. The radial spring surface may be a continuous or interrupted annular surface defined on a lock nut that is threadably engaged with the barrel assembly. The lock nut is movable forward and rearward on the barrel assembly via rotating the lock nut, wherein the radial spring surface is therefore axially adjustable in position for varying a compressive force exerted by lock nut against one end of the spring member with the other end of the spring member being configured for bracing against a surface disposed on the rifle receiver or a barrel nut mounted to the receiver.

According to another embodiment, a quick coupling barrel assembly for removable mounting to a receiver of a rifle includes: a barrel having a bore defining a longitudinal axis and an axial path for a bullet; a barrel extension having a front end coupled to the barrel and a rear end for coupling to the receiver of the rifle, the barrel and barrel extension collectively defining a barrel assembly; a first radial spring seating surface disposed on the barrel assembly and facing in an axial direction, the first seating surface being axially adjustable in position by a user; and a coned disc spring coaxially mounted about the barrel assembly. The spring is positioned for compression against the first radial spring seating surface when the barrel assembly is mounted to the receiver of the rifle. In one embodiment, the barrel assembly further includes a lock nut threadably mounted on the barrel assembly and axially movable forward and rearward; the lock nut defining the first radial spring seating surface thereon.

In one embodiment, the barrel assembly may further include a setting tool removably mounted on the barrel assembly; the setting tool defining a second radial spring seating surface. The spring is engageable between the first and second radial seating surfaces. In some embodiments the setting tool may include a plurality of splines engageable with a plurality of corresponding barrel locking lugs disposed on the barrel assembly, wherein the setting tool is rotatable in a first rotational direction to lock the setting tool on the barrel assembly and further rotatable in a second rotational direction to unlock the setting tool from the barrel assembly. In other embodiments, the barrel assembly may further include a barrel nut removably mounted to the barrel assembly and having a threaded end configured for mounting to the receiver of the rifle. The barrel nut defines a second radial spring seating surface with the spring being engageable between the first and second radial seating surfaces. In some embodiments, the barrel nut may include a plurality of splines engageable with a plurality of corresponding barrel locking lugs disposed on the barrel assembly, wherein the barrel assembly is rotatable in a first rotational direction to lock the barrel assembly to the barrel nut and further rotatable in a second rotational direction to unlock the barrel assembly from the barrel nut.

A method for assembling a spring-loaded barrel assembly for a firearm is also provided. According to one embodiment, the method generally includes the steps of: threadably engaging a lock nut with a firearm barrel, the barrel having a bore defining a longitudinal axis and an axial pathway for a bullet; installing an annular shaped coned disc spring coaxially over the barrel; and removably mounting a barrel extension to the barrel thereby defining a barrel assembly, the barrel extension being configured for mounting to a receiver of a firearm. The spring may be trapped on the barrel by the barrel extension so that the spring cannot be removed without dismounting the barrel extension.

In further embodiments, the method for assembling a spring-loaded barrel assembly for a firearm may further include a step of installing an annular shaped setting tool coaxially onto the barrel extension. The method may further include a step of locking the setting tool to the barrel extension by rotating the setting tool in a first rotational direction to a locked position in which the setting tool cannot be axially withdrawn from the barrel extension, wherein in one embodiment the locking step includes positioning splines on the setting tool in front of barrel locking lugs disposed on the barrel extension. The method may further include a step of unlocking the setting tool from the barrel extension by rotating the setting tool in a second rotational direction to an unlocked position in which the setting tool can be axially withdrawn from the barrel extension, the second rotational direction being opposite the first rotational direction. In one embodiment, the unlocking step includes positioning the splines on the setting tool between the barrel locking lugs on the barrel extension.

In a further embodiment, the method for assembling a spring-loaded barrel assembly for a firearm may further include a step of mounting a barrel nut on the barrel extension and compressing the spring between the barrel nut and a surface on the barrel assembly.

BRIEF DESCRIPTION OF THE DRAWINGS

The features of the preferred embodiments will be described with reference to the following drawings where like elements are labeled similarly, and in which.

Figure 1:
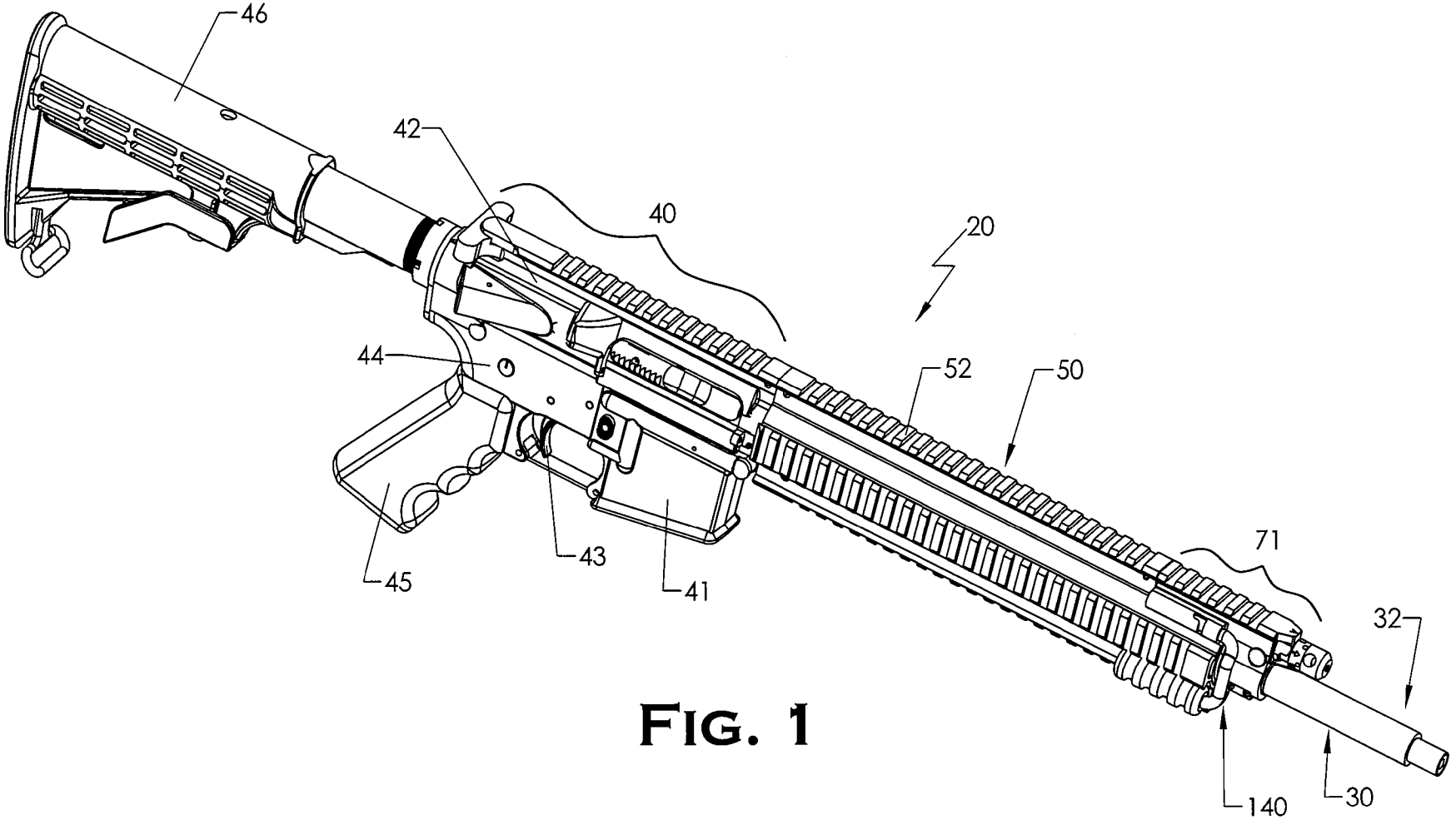
FIG. 1 is a perspective view of one embodiment of a rifle according to principles of the present invention.

All drawings are schematic and not to scale.

DESCRIPTION OF PREFERRED EMBODIMENTS

The features and benefits of the invention are illustrated and described herein by reference to preferred embodiments. Accordingly, the invention expressly should not be limited to such preferred embodiments illustrating some possible non-limiting combination of features that may exist alone or in other combinations of features; the scope of the invention being defined by the claims appended hereto. This description of preferred embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "coupled," "connected" and "interconnected," refer to a relationship wherein structures are secured or attached to one another either directly or indirectly through intervening structures, as well as both movable or rigid attachments or relationships, unless expressly described otherwise. The term "action" is used herein with respect to rifles in its conventional sense being the combination of the receiver, bolt, and other components associated with performing the functions of loading and unloading cartridges and locking and unlocking the breech. Directions or orientations such as front or forward and rear or rearward are referenced with respect to the rifle with the muzzle end being considered at the front and the stock being at the rear. Similar direction or orientation descriptions used in describing individual components refer to their positions when assembled in the rifle.

A preferred embodiment of a barrel retaining system with quick-change capabilities will now be described for convenience with reference and without limitation to a rifle capable of semi-automatic or automatic firing. However, it will be appreciated that alternate embodiments formed according to principles of the present invention may be used with equal advantage for other types of firearms and the invention not limited in applicability to rifles alone as described herein.

Figure 2:
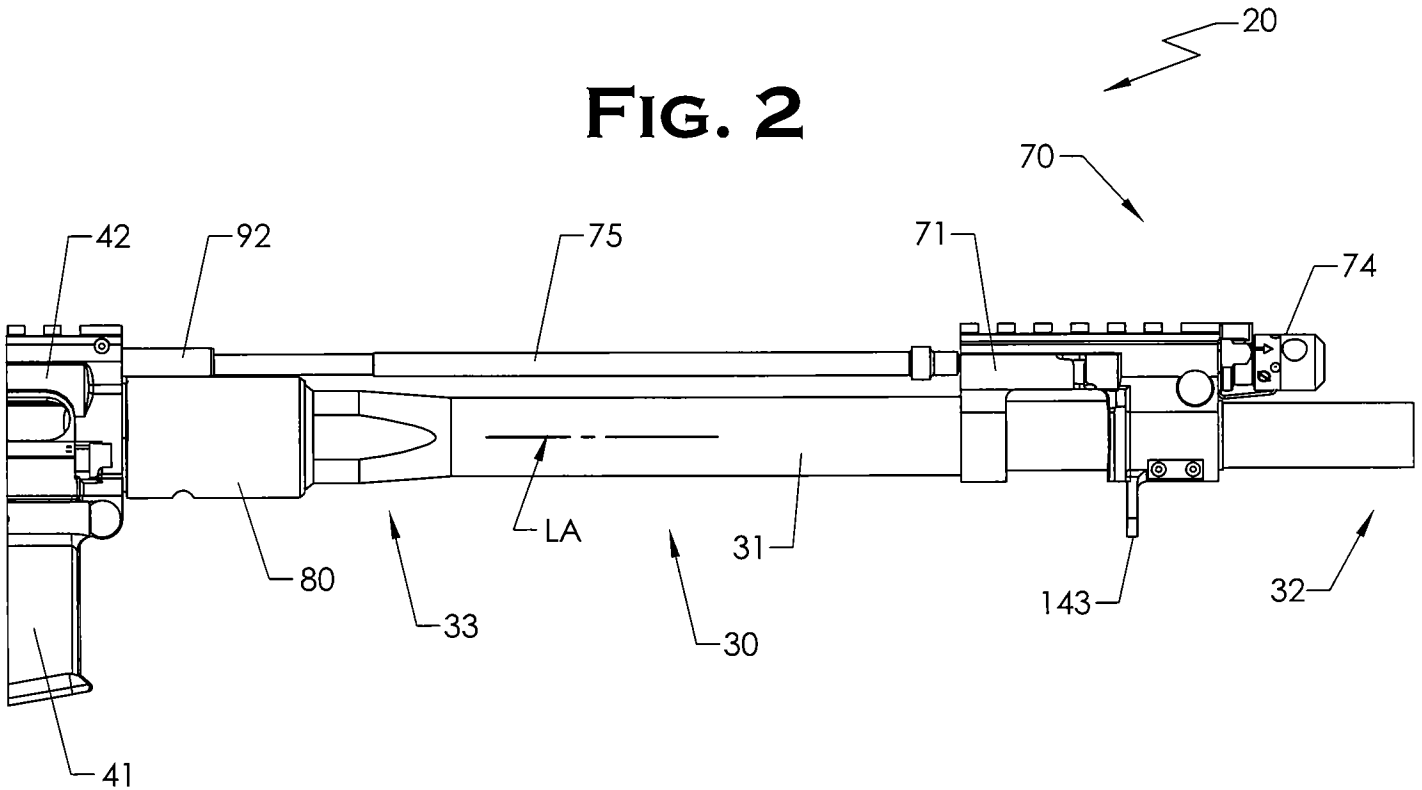
FIG. 2 is a partial side view of the rifle with handguard removed.

FIGS. 1 and 2 show a preferred embodiment of a rifle 20 according to principles of the present invention. In one embodiment, rifle 20 may preferably be a gas-operated auto-loading rifle with a rotating bolt-type action and magazine feed. FIG. 2 depicts the barrel portion of rifle 20 with the handguards removed to better show the arrangement of components hidden from view when the handguard is in place. As further described herein, rifle 20 includes a quick-change barrel retaining system intended to facilitate convenient and quick swapping of barrels in situations that include the combat arena.

Referring now to FIGS. 1 and 2, rifle 20 generally includes a receiver assembly 40 and a barrel assembly 30 mounted thereto via a locking member such as barrel nut 80. Receiver assembly 40 may house a conventional firing mechanism and related components such as those used in M-4 and M-16/AR-15 type rifles and their variants. Such firing mechanisms are generally described in U.S. Pat. Nos. 5,726,377 and 4,433,610, both of which are incorporated herein by reference in their entireties. As will be known to those skilled in the art, these firing mechanisms generally include a spring-biased hammer that is cocked and then released by a sear upon actuating the trigger mechanism. The hammer strikes a firing pin carried by the bolt, which in turn is thrust forward to contact and discharge a chambered cartridge. A portion of the expanding combustion gases traveling down the barrel is bled off and used to drive the bolt rearward against a forward biasing force of a recoil spring for automatically ejecting the spent cartridge casing and automatically loading a new cartridge into the chamber from the magazine upon the bolts forward return. Such recoil spring systems are generally described U.S. Pat. No. 2,951,424, which is incorporated herein by reference in its entirety. In a gas direct type system such as employed on M4 and M16-type rifles, the gas is directed rearwards through a tube to the breech area of the receiver and into a gas chamber associated with a reciprocating bolt carrier that holds the bolt. The gas acts directly on the bolt carrier. In a gas piston type system, such as used in AR-18 and AK-47 type rifles, the combustion gases are ported into a gas cylinder mounted on the barrel which contains a reciprocating piston. An operating or transfer rod mechanically links the piston to the bolt carrier in lieu of gas tube to drive the bolt carrier rearward after firing the rifle. The gas thus acts on the piston, which is remote from the breech area of the receiver and only mechanically linked to the bolt carrier. This latter type system generally keeps the breech area of the receiver cleaner than gas direct systems by reducing fouling and carbon accumulation on components from the combustion gases. Gas direct systems require more frequent cleaning and are generally more prone to malfunctions and misfires resulting from fouling. In addition, the piston system runs cooler than gas direct preventing components from getting hot and expanding (particularly during automatic firing mode) which can also result in malfunctions. In a preferred embodiment, the barrel retaining system according to principles of the present invention is preferably used in conjunction with a rifle employing a gas piston type system, which will be further described herein in pertinent part.

Referring now to FIGS. 1 and 2, receiver assembly 40 includes upper receiver 42 and lower receiver 44 which may be removably coupled together by conventional means. In some embodiments, upper receiver 42 may generally be a conventional M4 or M-16/AR-15 type upper receiver with modifications as described herein. Lower receiver 44 includes a buttstock 46, handgrip 45, trigger mechanism 43, and open magazine well 41 that removably receives a self-feeding magazine (not shown) for holding a plurality of cartridges. In some embodiments, the cartridges used may be 5.56 mm NATO rounds or other cartridge types suitable for use in semi-automatic and automatic rifles.

Bolt and Carrier: In one embodiment, a conventional rotating bolt is provided as commonly used in M4-type and M16/AR-15-type rifles. Referring to FIGS. 3, 4, and 8A-B, upper receiver 42 defines an internal longitudinally-extending cavity 47 configured to receive bolt assembly 60. Bolt assembly 60 is slidably disposed in cavity 47 for axial reciprocating recoil movement rearward and forward therein. Bolt assembly 60 includes a bolt carrier 61 and a rotatable bolt 62 such as generally described in U.S. Pat. Nos. 5,726,377, 4,3433,610, and 2,951,424, which are all incorporated herein by reference in their entireties. Bolt 62 is disposed in bolt carrier 61 in a manner that provides rotational and axial sliding movement of the bolt with respect to bolt carrier 61 in a conventional manner. When bolt assembly 60 is mounted in upper receiver 42, forward breech face 63 of bolt 62 protrudes outwards from inside bolt carrier 61 towards the front of rifle 20 for abutting a chambered cartridge C (shown in FIG. 23) when loaded in chamber 111 (see FIG. 13). A firing pin 200 (shown in FIGS. 3 and 4) is disposed in firing pin cavity 63 (see FIG. 4) for sliding axial movement therein to strike the chambered cartridge when struck on its rear by the hammer (not shown). Bolt 62 preferably includes a conventional transverse-mounted cam pin 67 that travels in a curved cam slot 68 defined by bolt carrier 61 to impart rotational movement to the bolt and limit its degree of rotation. Preferably, bolt 62 is made of steel. Bolt carrier 61 further includes a key 65 attached to or integral with the carrier. Key 65 includes a forward-facing thrusting surface 66 for engaging the transfer rod of the gas piston operating system described herein for cycling the action.

With continuing reference to FIGS. 3, 4, and 8A-B, bolt 62 further includes conventional laterally-protruding bolt lugs 64 located proximate to bolt breech face 63. Bolt lugs 64 extend outwards in a radial direction from bolt 62 and engage corresponding bolt locking lugs 105 associated with barrel assembly 30 to lock the breech prior to firing the rifle 20. In one preferred embodiment, bolt locking lugs 105 are formed in a preferably steel barrel extension 100 that is affixed to or integral with barrel 31. This provides a steel-to-steel locked breech when a chambered cartridge is detonated by the firing pin 200 after actuating the rifle's trigger mechanism. This steel-to-steel breech lockup withstands combustion forces and allows receiver assembly 40 to made of a lighter material, such as aluminum or aluminum alloy for weight reduction.

Barrel Assembly: Barrel assembly 30 will now be further described with initial reference to FIGS. 1-3, 5-7, and 13. Barrel assembly 30 includes a barrel 31 having a forward muzzle end 32 and rearward breech end 33. Barrel 31 defines a longitudinal axis LA for rifle 20 and an inner barrel bore 34 that forms an axial path for a bullet. A portion of barrel bore 34 is enlarged near the breech end 33 to define a chamber 111 that holds a cartridge. Preferably, inner barrel bore 34 includes conventional rifling (not shown) in some embodiments for imparting spin to the bullet when rifle 20 is fired. A gas block 71 forming part of a gas piston operating system 70 is shown mounted towards the muzzle end 32 of barrel assembly 30. The gas piston operating system 70 is further described elsewhere herein.

Figure 3:
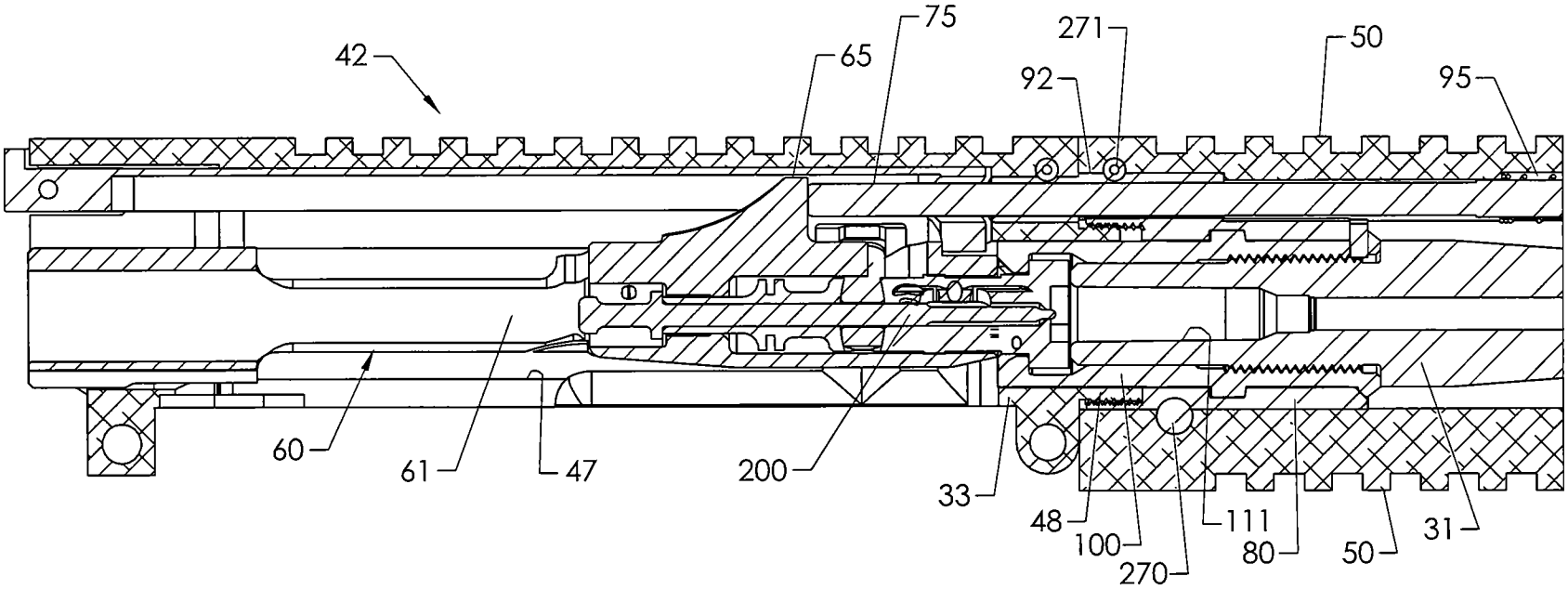
FIG. 3 is a partial cross sectional view of the upper receiver and breech end of the barrel of the rifle.
Figure 4:
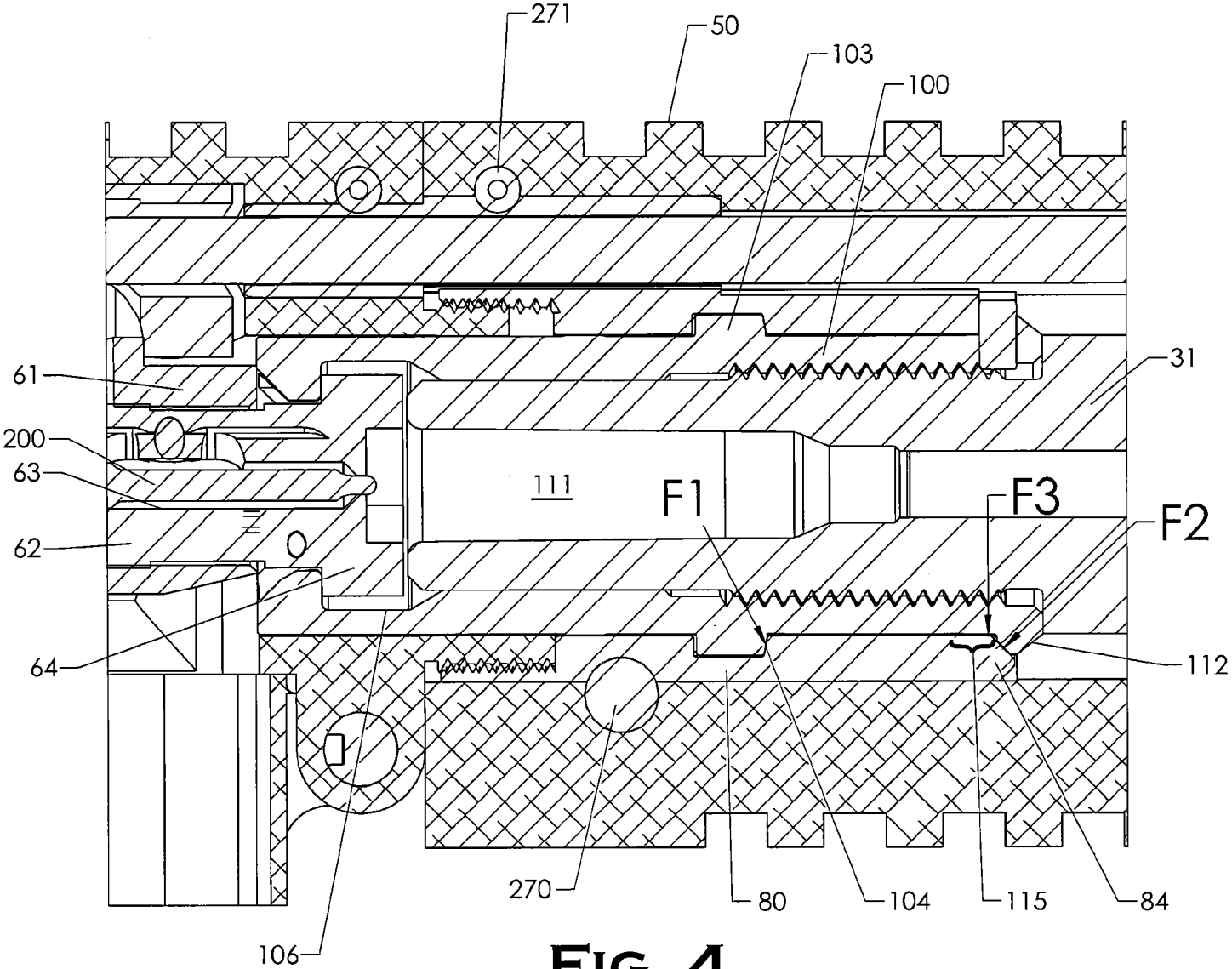
FIG. 4 is a detailed partial cross sectional view of the breech end of the barrel including the bolt, barrel extension, and barrel nut.

With additional reference now to FIGS. 14-20, barrel assembly 30 further includes a barrel extension 100 at breech end 33 of barrel 31. Barrel extension 100 defines an exterior surface 101 and an interior surface 102. A portion of exterior surface 101 defines an annular surface 114 for locating and receiving splines 81 of barrel nut 80. In one embodiment, annular surface 114 preferably extends axially in a longitudinal direction and may be formed between an annular flange 112 and barrel locking lugs 103 further described herein. Annular surface 114 preferably has an axial length sized to receive splines 81 as best shown in FIGS. 3 and 4.

In a preferred embodiment, barrel extension 100 may be a separate component removably attached to barrel 31 via a threaded connection. Accordingly, in one possible embodiment, barrel extension 100 may have internal threads 107 formed on interior surface 102 proximate to front end 108 which mate with complementary shaped external threads 35 formed proximate to or spaced inwards from breech end 33 of barrel 31 as shown. Other suitable conventional means of affixing barrel extension 100 to barrel 31 such as pins, screws, clamps, etc., or combinations of threading and such other means, may be used.

With continuing reference to FIGS. 14-21, opposite rear end 109 of barrel extension 100 includes conventional circumferentially-spaced bolt locking lugs 105 that project radially inwards from interior surface 102 to engage bolt lugs 64 of rotating bolt 62 (see FIGS. 4 and 8A-B) for closing and locking the breech in preparation for firing rifle 20 in a conventional manner. Rear end 109 of barrel extension 100 includes conventional angled feed ramps 110 to facilitate feeding cartridges into chamber 111 of barrel 31. A diametrically enlarged annular space 106 is provided in interior surface 102 of barrel extension 100 to receive bolt lugs 64 and allow bolt 62 to rotate in a usual conventional manner after bolt lugs 64 are inserted forward through bolt locking lugs 105.

Figure 13:
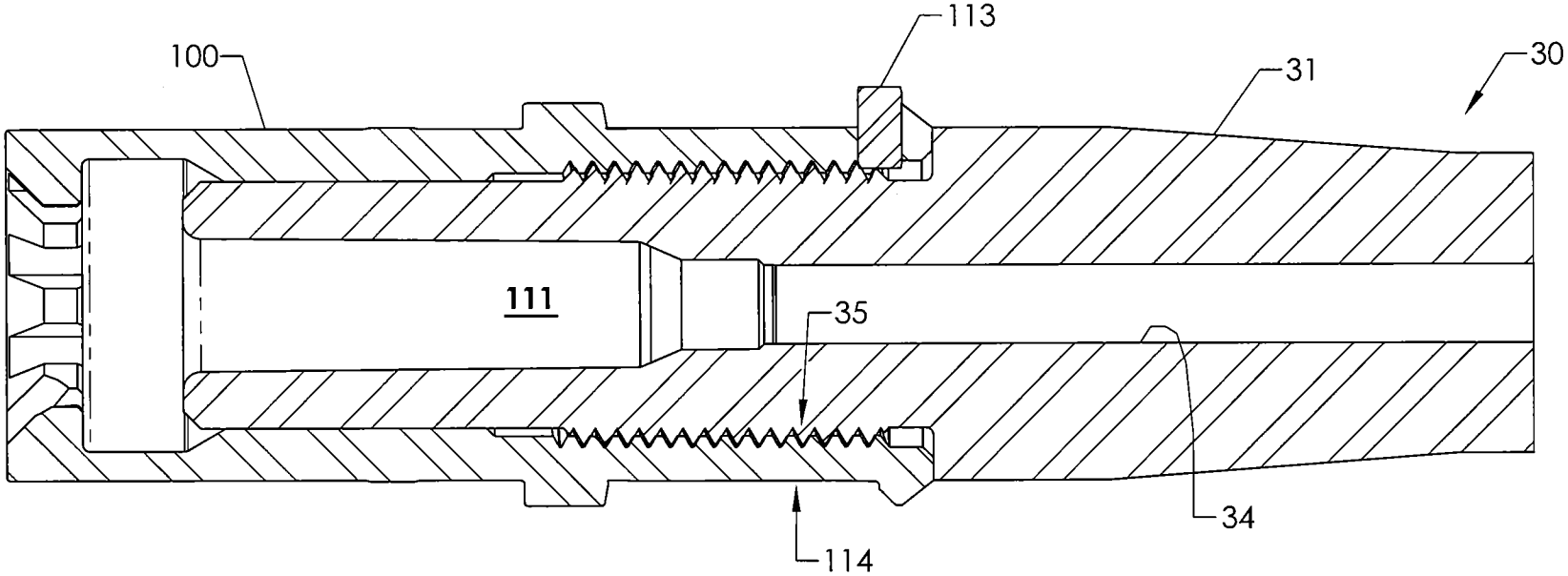
FIG. 13 is a cross-sectional side view of the breech end of the barrel with barrel extension attached thereto.
Figure 14:
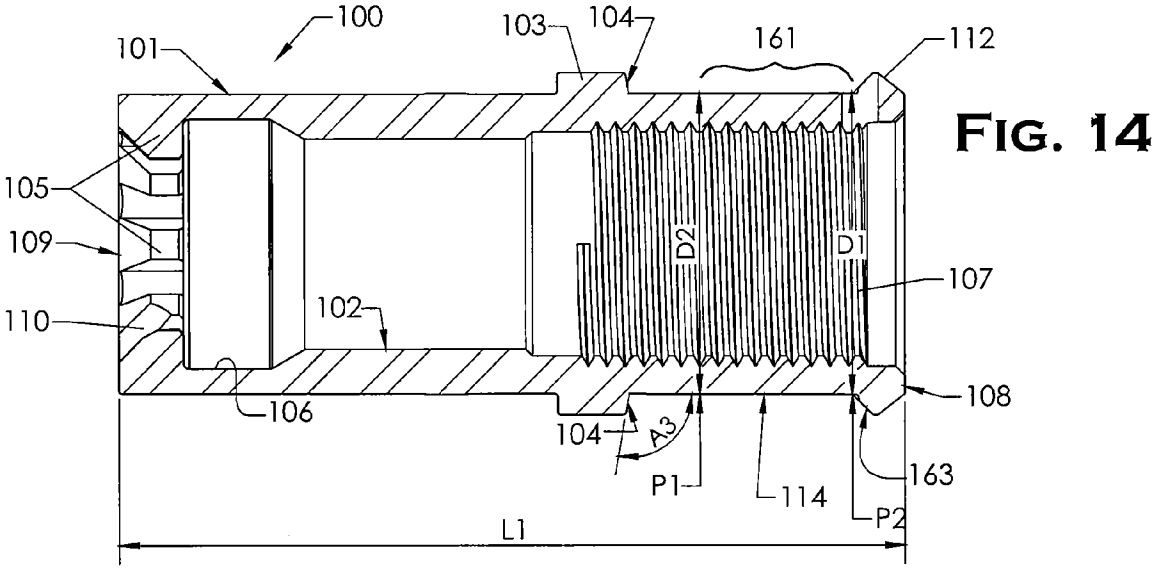
FIG. 14 is a cross-sectional top view of the barrel extension.
Figure 15:
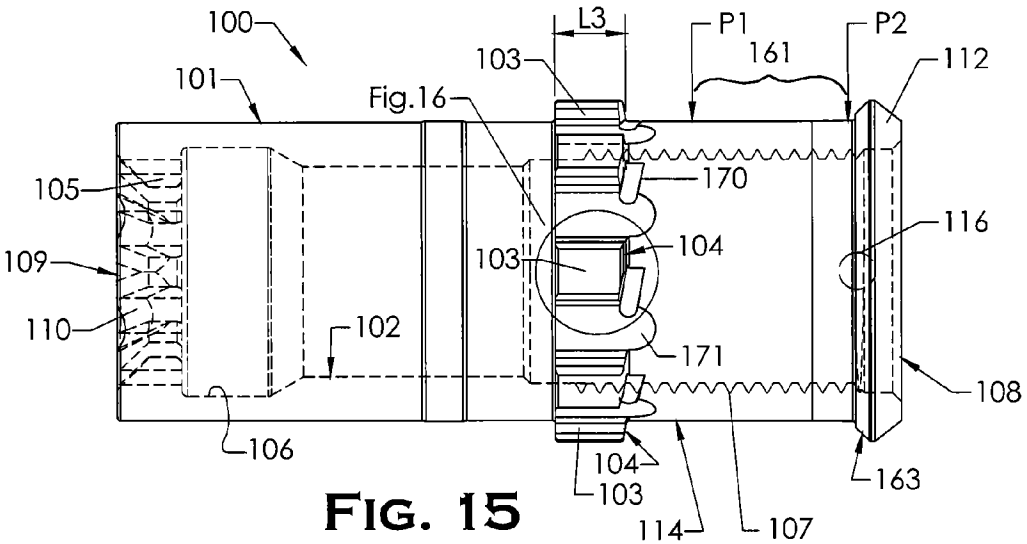
FIG. 15 is top view.

Unlike known barrel extensions, barrel extension 100 preferably includes barrel locking lugs 103 as shown in FIGS. 13-15 for detachably locking barrel assembly 30 to barrel nut 80 via corresponding splines 81 in the barrel nut. The barrel locking lugs 103 define a first locking mechanism for securing barrel assembly 30 to rifle 20. Barrel extension 100 is rotatable between a locked position in which the barrel locking lugs 103 are engaged with splines 81 to lock barrel assembly 30 to rifle 20, and an unlocked position in which barrel locking lugs 103 are not engaged with splines 81 to unlock the barrel assembly 30 from rifle 20. In a preferred embodiment, a plurality of opposing external barrel locking lugs 103 are provided and disposed on barrel extension 100. In other embodiments contemplated, barrel locking lugs may be disposed on barrel 31 (not shown) in alternative designs where no barrel extension is used. However, barrel extensions are favored in a preferred embodiment because the extensions may be detached from the used barrel and re-used on a new barrel. Because bolt locking lugs 105 and barrel locking lugs 103 are machined on barrel extension 100 that may be reused, fabrication of barrel 31 is less expensive. Each barrel assembly can be gauged individually for proper headspace before being installed into the rifle, and when a quick-change barrel system is used according to the present invention, each barrel will maintain headspacing regardless of the rifle it is installed in.

Figure 18:
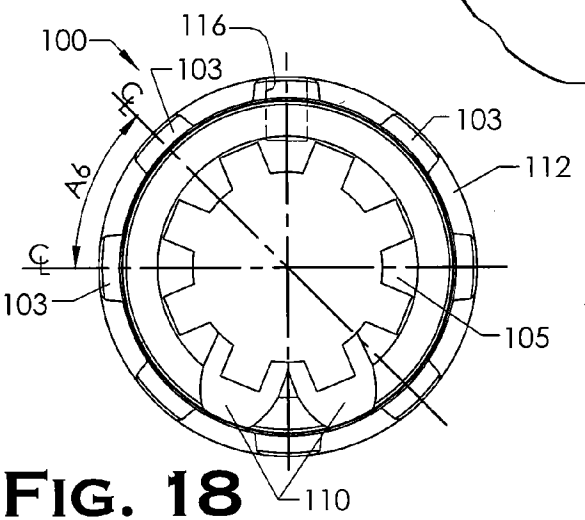
FIG. 18 is an end view of the barrel extension looking towards the breech end of the barrel extension.

As shown in FIGS. 14-21, barrel locking lugs 103 extend radially outwards from exterior surface 101 of barrel extension 100 in a circumferentially spaced apart and opposing relationship. Machined depressions 171 may be formed between the barrel locking lugs 103. As best shown in FIG. 18, by way of example without limitation, eight barrel locking lugs 103 may be provided that correspondingly engage eight splines 81 formed on barrel nut 80. Other suitable numbers of splines 81 and barrel locking lugs 103 may be used. Preferably, the barrel locking lugs 103 have a uniform circumferential spacing such that the lugs are equally spaced around the circumference of barrel extension 100. In one exemplary embodiment, the radial centerline of each barrel locking lugs 103 is angularly arranged at an angle A6 of about +/−45 degrees from each other (see FIG. 18) wherein eight lugs are provided.

In a preferred embodiment, each barrel locking lug 103 includes a front radial locking surface 104 for engaging and interlocking with a corresponding complementary rear radial locking surface 88 on spline 81 of barrel nut 80. Accordingly, barrel locking lugs 103 provide a first locking mechanism for securing barrel extension 100 to barrel nut 80 with an associated compressive locking force F1 (see FIG. 4). Front radial locking surface 104 is oriented generally transverse to longitudinal axis LA when barrel extension 100 is assembled to barrel 31. Preferably, front radial locking surface 104 is disposed at angle A3 with respect to contact surface 115 of barrel extension 100 a shown in FIG. 14. In one exemplary embodiment, angle A3 may be at least about 90 degrees, and about +/−100 degrees in one exemplary preferred embodiment (allowing for fabrication/machining tolerances). Other suitable angles may be used.

Figure 16:
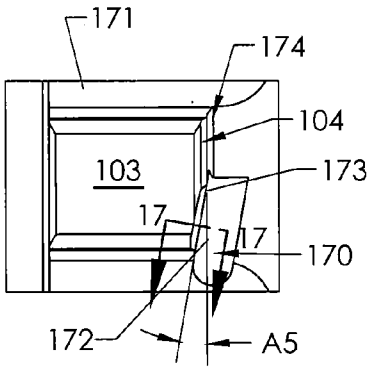
FIG. 16 is a view of detail 16 in FIG. 15 showing a barrel locking lug of the barrel extension.
Figure 17:
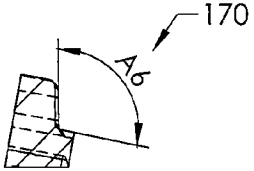
FIG. 17 is a cross-section of the barrel locking lug of FIG. 16 taken along line 17-17.

With reference to FIGS. 15-17 and 19, camming notches 170 may be provided in some embodiments. Camming notches 170 may have a rounded entry portion in some embodiments as shown for receiving radial locking surface 88 on spline 81 of barrel nut 80. Preferably, camming notches 170 are cut at least partially into front radial locking surface 104 of each barrel locking lugs 103 in a preferred embodiment (best shown in FIGS. 16-17). Each camming notch 170 extends partially across front radial locking surface 104 as best shown in FIG. 16. Each camming notch 170 preferably is cut at an angle A5 to the base 174 of locking surface 104 (see FIG. 16) which extends in a transverse direction perpendicular or 90 degrees to longitudinal axis LA of rifle 20 in a preferred embodiment. In some exemplary embodiments, without limitation, angle A5 maybe be at least 5 degrees, and more preferably at least about 10 degrees. Camming notch 170 may be formed with an entrance portion 172 and an opposite exit portion 173, which may the same or narrow in width than the entrance portion.

Camming notches 170 impart an axial relative motion to barrel extension 100 in relation to barrel nut 80 due to the angled orientation of at least a part of the notches with respect to the longitudinal axis LA of barrel assembly 30. The camming notches 170 function to translate rotational motion of barrel extension 100 into axial motion. The camming notches 170 advantageously tightens and enhances the locking relationship between the barrel locking lugs 103 and the tapered contact surface 161 of barrel extension 100 (see FIG. 15) and barrel nut 80 as further described below. This produces a zero-clearance fit both axially and radially between the barrel nut 80 and the barrel extension 100. By the contact between barrel extension radial locking surface 104 and barrel nut groove surface 88 (FIG. 11), the barrel extension 100 (and thereby the entire barrel assembly) is pulled rearward, engaging the barrel extension tapered contact surface 161 (see FIG. 15) with the front edge 265 of the barrel nut (shown in FIGS. 10 and 12). It should be noted that camming notch 170 best shown in FIGS. 15 and 16 is a lead-in so that precise alignment of front radial locking surface 104 (extension lug front face) with rear radial locking surface 88 (also the front surface of barrel nut locking groove 87) is not necessary—notch 170 aligns them when torque is applied by turning the barrel assembly into the barrel nut. Radially-extending annular flange 112 on barrel extension 100 in front of the tapered contact surface 161 serves to prevent over insertion of the barrel extension into the barrel nut 80. In addition, camming notch 170 progressively increases the frictional and compressive engagement between front radial locking surface 104 of barrel locking lugs 103 and rear radial locking surface 88 of splines 88 as the barrel extension 100 is rotated into engagement with barrel nut 80 in relation to the first locking mechanism described above.

Figure 10:
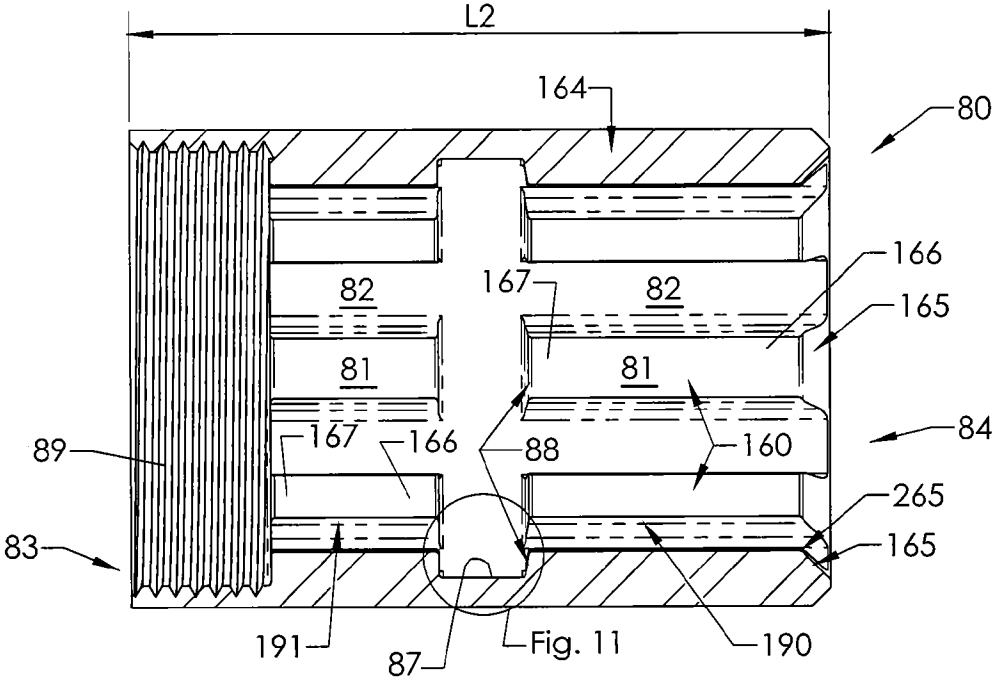
FIG. 10 is a cross-sectional view of the barrel nut.
Figure 11:
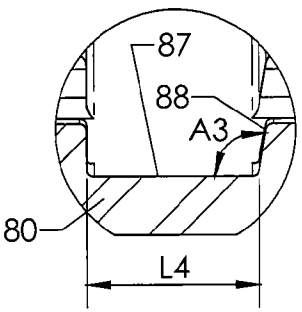
FIG. 11 is a view of detail 11 in FIG. 10.

With continuing reference to FIGS. 15-17 and 19, camming notch 170 is sized and configured to engage rear radial locking surface 88 of splines 81 (see FIGS. 10-11). After fully inserting barrel extension 100 into barrel nut 80 and locating barrel locking lugs 103 in locking groove 87 of the barrel nut, rotating the barrel extension towards a locking position will initially engage a leading edge of rear radial locking surface 88 of spline 81 (at rear end 167) with the entrance portion 172 of notch 170. The rear end 167 of spline 81 travels in notch 170 and slides across front radial locking surface 104 of the barrel locking lugs 103 towards the narrow exit portion 173 of the notch. Continuing to rotate barrel extension 100 causes the leading edge of spline 81 to leave notch 170 until rear radial locking surface 88 of spline 81 fully engages front locking surface 104 of barrel locking lugs 103. The notch 170 imparts axial motion to barrel extension 100 in relation to barrel nut 80 in a manner that displaces the barrel extension slightly rearward due to the angled A5 orientation of notch 170. This both tightens the locking engagement between the barrel locking lugs 103 and splines 81 (see FIG. 4, compressive locking force F1), and also compresses rear angled locking surface 163 of flange 112 against front angled locking surface 165 of each spline as the barrel extension is drawn rearward in relation to barrel nut 80 (see FIG. 4, compressive locking force F2). Accordingly, each end 166, 167 of splines 81 become wedged between the barrel extension flange 112 and barrel locking lugs 103 to form a secure locking relationship between the barrel extension 100 and barrel nut 80. Referring to FIG. 4, compressive locking forces F1, F2 act in opposite and converging directions on either end of splines 81 to produce the wedging effect on the splines.

With continuing reference to FIGS. 14-21, front end 108 of barrel extension 100 includes radially-extending annular flange 112 which in some embodiment provides additional locking engagement between the barrel extension and barrel nut 80. Accordingly, flange 112 provides a second locking mechanism for securing barrel extension 100 to barrel nut 80, which preferably is spaced axially apart from a first locking mechanism provided by barrel locking lugs 103. Flange 112 preferably is located and dimensioned to also properly position barrel locking lugs 103 in locking groove 87 of barrel nut 80 when barrel extension 100 is seated therein and prevent over insertion of the barrel extension into the barrel nut. Preferably, flange 112 is located proximate to front end 108 of barrel extension 100. In other embodiments contemplated, flange 112 may be spaced inwards from front end 108. A rear facing portion of flange 112 defines a rear angled locking surface 163 for cooperatively engaging a complementary front angled locking surface 165 defined on a front end 166 of each spline 81 (as best shown in FIG. 10) to lock barrel extension 100 to barrel nut 80. This creates a compressive locking force F2 between flange 112 and splines 81, as shown in FIG. 4. Preferably, rear angled locking surface 163 and front angled locking surface 165 are both angled as shown in FIG. 4 to provide both an axial and radial interlock that reduces rattling and vibration between barrel extension 100 and barrel nut 80 when rifle 20 is discharged. Rear angled locking surface 163 preferably is circumferentially continuous around barrel extension 100 thereby forming a part of a cone in configuration. Although a continuous flange 112 is preferred for ease of manufacturing, in other embodiments (not shown), flange 112 may be circumferentially discontinuous to define a plurality of separate annular segmented rear angled locking surfaces 163 for engaging front angled locking surfaces 165 of splines 81. Front angled locking surface 165 of barrel nut 80 is preferably disposed on front end 166 of each spline 81 opposite from rear end 167 of the spline having rear radial locking surface 88. Accordingly, each spline defines two opposite facing locking surfaces 88, 165 for engaging barrel extension 100 by wedging each spline between barrel extension flange 112 and barrel locking lugs 103 by compressive locking forces F1, F2 (see FIG. 4) as further described herein. When barrel extension 100 is full inserted into barrel nut 80 and rotated therein, rear and front angled surfaces 163 and 165 respectively become compressed together and frictionally engaged due to the rearward axial displacement of barrel extension 100 by barrel extension camming notches 170 described elsewhere herein. In one exemplary embodiment, angled locking surfaces 163, 165 may each be angled at about +/−45 degrees to longitudinal axis LA. Other suitable angles larger or smaller than 45 degrees may be used however. Preferably, angled locking surfaces 163 and 165 have approximately the same angles, but with opposite front/rear orientations.

It will be appreciated that in some embodiments, the foregoing second locking mechanism formed between rear angled locking surface 163 on flange 112 of barrel extension 100 and complementary front angled locking surface 165 defined on a front end 166 of each spline 81 in barrel nut 80 (as best shown in FIG. 10) may not be required. In some embodiments, the locking mechanisms provided by (1) barrel locking lug front radial locking surface 104 and corresponding complementary rear radial locking surface 88 on spline 81 of barrel nut 80, and (2) the tapered contact surface 161 of barrel extension 100 and barrel nut 80 described elsewhere herein may be sufficient to secure the barrel extension (and barrel assembly) to the barrel nut and upper receiver 42. Accordingly, flange 112 on barrel extension 100 may be sized and configured such that rear angled locking surface 163 on flange 112 may not engage front angled locking surface 165 of barrel nut 80.

A locator pin 113 may be fitted through hole 116 in the top center of barrel extension 100 (see e.g. FIGS. 13 and 18) to prevent the barrel extension from over-rotating during assembly/disassembly for smooth removal, and for proper orientation during the installation of the barrel extension (and thereby the barrel assembly) into the barrel nut 80.

In a preferred embodiment, referring to FIGS. 14-15 and 19-20, a portion of annular surface 114 of barrel extension 100 defines a tapered contact surface 161 as already noted herein to form a third locking mechanism between the barrel extension and barrel nut 80 to now be further described. Tapered contact surface 161 forms a frustoconical portion that extends circumferentially in an annular band or ring around exterior surface 101 of barrel extension 100. Tapered contact surface 161 engages at least a portion of the axial contact surface 160 (see FIG. 9) of each barrel nut spline 81 to form a frictional lock between the barrel extension and barrel nut when these two components are locked together. This creates a compressive locking force F3 between tapered contact surface 161 and splines 81, as shown in FIG. 4. In one embodiment, tapered contact surface 161 may be disposed adjacent to flange 112 of barrel extension 100. This creates a frictional lock proximate to the front of barrel nut and forward of barrel locking lugs 103 (see FIG. 4) at an axial locking location different than and spaced part from the axial locking location formed by barrel locking lugs 103 and the barrel nut. Engagement between tapered contact surface 161 of barrel extension 100 and axial contact surface 160 of splines 81 form an intermittent pattern of contact extending circumferentially around barrel extension 100. Tapered contact surface 161 in a preferred embodiment has an increasing slope in the axial direction from the rear point P1 of surface 161 to the front point P2 of surface 161 behind flange 112 such that an outer diameter D1 measured at P2 is larger than outer diameter D2 measured at P1 (see e.g. FIG. 14). When barrel extension 100 is fully inserted and seated in barrel nut 80, an axial contact pressure zone 115 is formed between a forward portion of each spline 81 near front end 166 along axial contact surface 160 and tapered contact surface 161 as shown in FIG. 4. In one exemplary embodiment, without limitation, tapered contact surface may have a representative axial length of at least about 0.125 inches measured between points P1 and P2.

Figure 19:
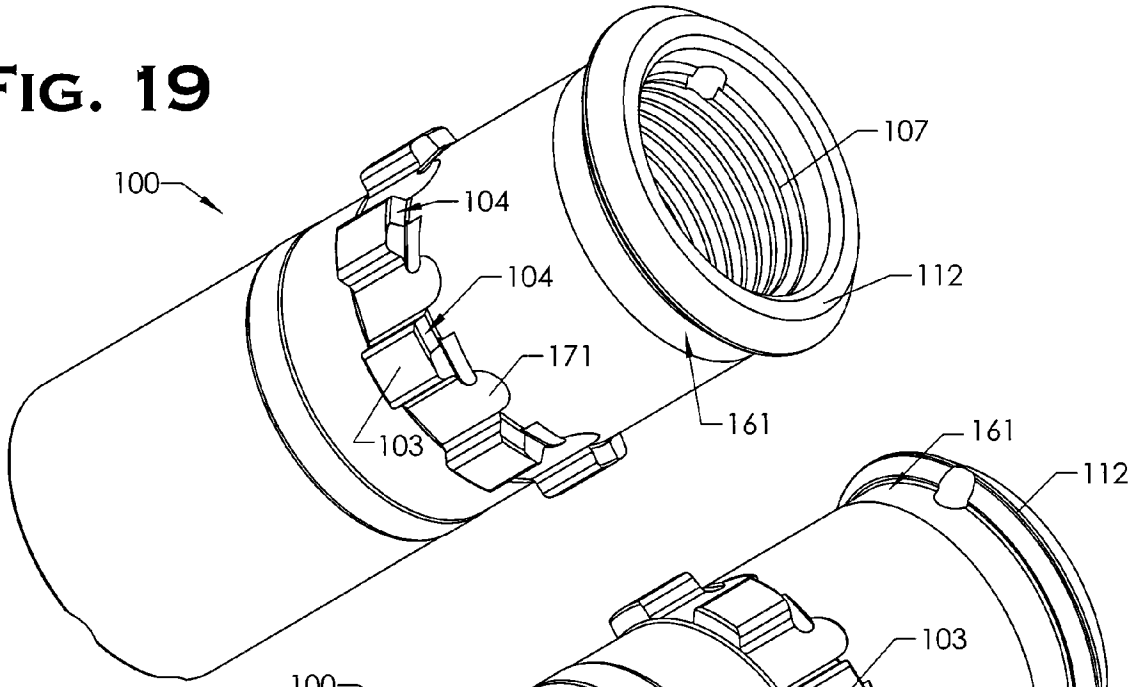
FIGS. 19 and 20 are perspective views looking towards the muzzle end and breech end of the barrel extension, respectively.
Figure 20:
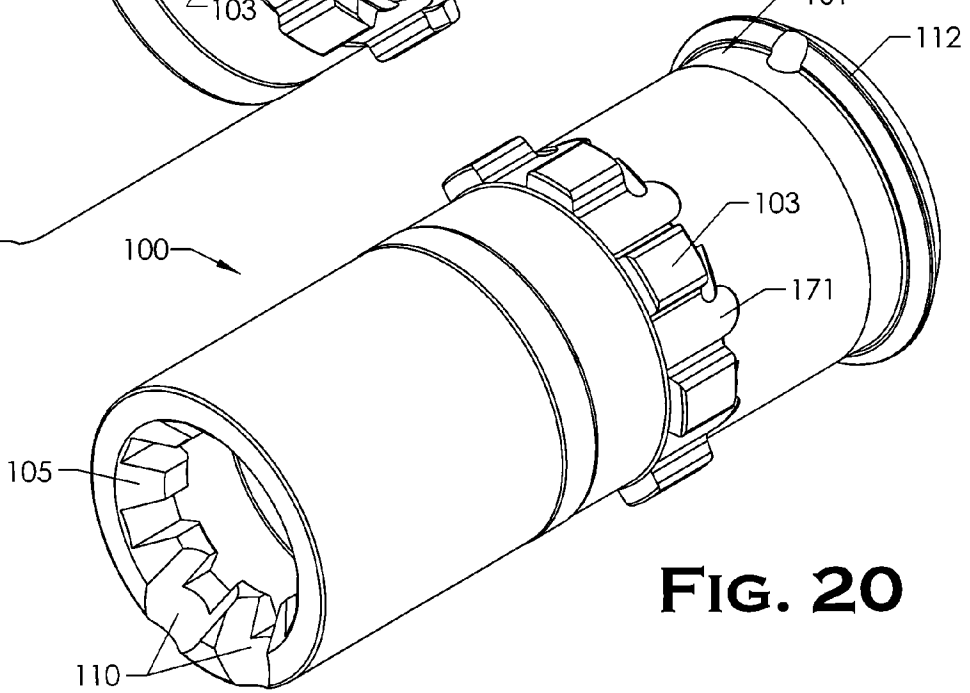

FIGS. 4 and 13 shows barrel extension 100 installed onto barrel 31. FIG. 18 shows an end view of barrel extension 100 with the foregoing features identified. FIGS. 19 and 20 show different perspective views of the barrel extension 100 with the foregoing features identified.

Figure 9:
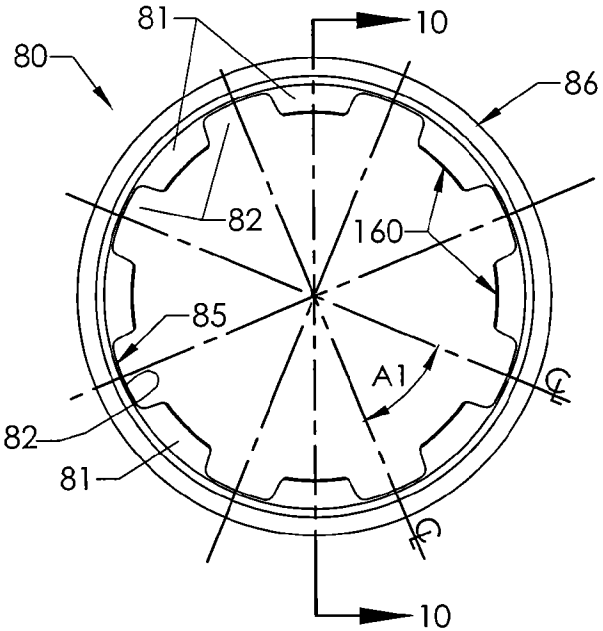
FIG. 9 is an end view of the barrel nut of the rifle looking towards the breech end of the barrel nut.
Figure 12:
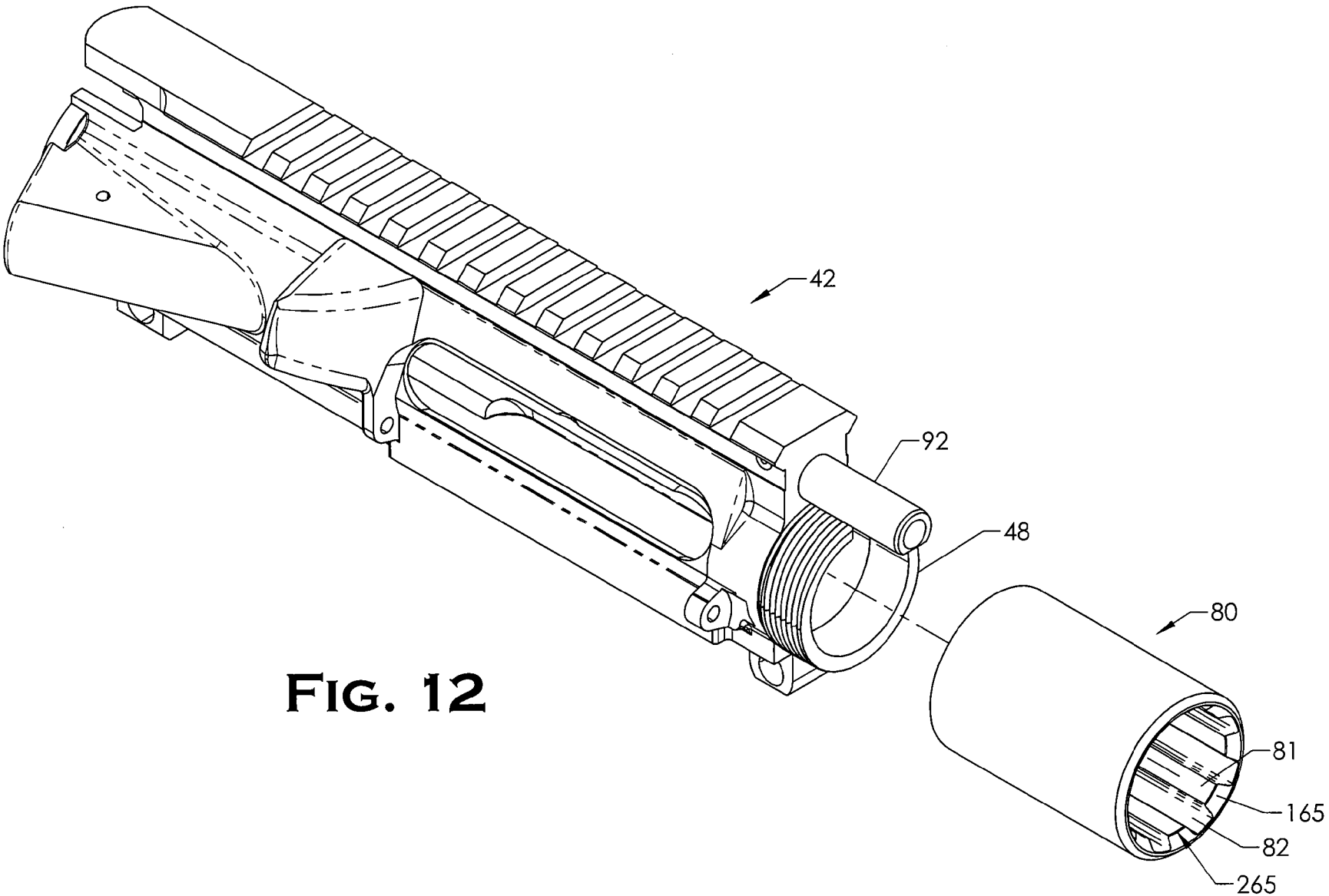
FIG. 12 is a perspective view of the upper receiver and barrel nut.

Barrel Nut: Barrel nut 80 will now be described in further detail. FIGS. 9-11 depict a preferred embodiment of barrel nut 80. FIG. 9 is an end view of barrel nut 80. FIG. 10 is a longitudinal cross-sectional view of barrel nut 80. FIG. 11 shows a detail of barrel nut 80 taken from FIG. 10. FIG. 12 shows barrel nut 80 positioned for attachment to upper receiver 42.

Referring now to FIGS. 9-12, barrel nut 80 according to principles of the present invention is a generally tubular element and includes an axial length L2, a receiver end 83, a barrel end 84, an exterior surface 86, and an interior surface 85. Barrel nut 80 is cooperatively sized and configured with barrel extension 100 to removably receive at least a portion of barrel extension 100 therein.

Barrel nut 80 may be removably or permanently coupled to upper receiver 42. In one possible embodiment, shown in FIG. 12, barrel nut 80 may be removably attached to upper receiver 42 via a threaded connection. Referring to FIG. 10, a portion of interior surface 85 adjacent receiver end 83 of barrel nut 80 may have internal threads 89 configured to removably engage a complementary externally-threaded mounting nipple 48 disposed on the front of upper receiver 42 (see FIGS. 3 and 12). Barrel nut 80 extends in an forward axial direction from the front of upper receiver 42 when mounted thereto. In other possible embodiments contemplated, a portion of exterior surface 86 of barrel nut 80 may alternatively be threaded while the mounting nipple 48 on upper receiver 42 may have complementary internal threads. In some embodiments, barrel nut 80 may also be pinned to upper receiver 42 in addition to threading for a more permanent type installation.

Although threaded attachment of barrel nut 80 to upper receiver 42 is preferred, in other possible embodiments barrel nut 80 may be attached to upper receiver 42 by other commonly known means for assembling firearm components such as set screws, pinning, clamping, etc. Preferably, barrel nut 80 is attached externally to upper receiver 42 to allow the barrel nut to sized larger than if mounted inside the receiver. In some conventional designs having an internal locking sleeve, the barrel locking function and headspacing is done by a trunnion. This means that headspacing will vary from firearm to firearm. When wear pushes the trunnion out of headspacing, the entire firearm such as a rifle must be replaced. In embodiments according to the present invention, since the headspacing is done by the assembly of the barrel extension to the barrel instead, only the quick change barrel would need to be replaced.

In a preferred embodiment, with reference to FIGS. 9-12, barrel nut 80 includes a plurality of locking elements such as splines 81 for engaging and interlocking with barrel locking lugs 103 of barrel extension 100. Splines 81 are preferably arranged in diametrically opposing relationship and circumferentially spaced apart from each other along the interior surface 85 of the barrel nut. Splines 81 extend radially inwards from interior surface 85 of barrel nut 80. In a preferred embodiment, splines 81 are sized and configured to engage both barrel locking lugs 103 and flange 112 of barrel extension 100. Splines 81 may be elongated and extend in a longitudinal direction in barrel nut 80. Each spline includes a front end 166 and a rear end 167 (with the orientation being defined when barrel nut 80 is attached to upper receiver 42 of rifle 20, as shown in FIGS. 4 and 12). In one embodiment shown in FIG. 10, splines 81 preferably extend at least proximate to barrel end 84 of barrel nut 80 to assist with guiding barrel extension 100 into the barrel nut. Accordingly, front end 166 of spline 81 may terminate at barrel end 84 of barrel nut 80. In other embodiments, splines 81 may be spaced inwards from one or both ends 83, 84 of barrel nut 80. Splines 81 may have any suitable axial length. Preferably, splines 81 do not extend into the threads 89 of barrel nut 80.

In the preferred embodiment, the barrel extension 100 is configured and arranged to preferably engage both front and rear ends 166, 167 of at least some of the splines 81 to lock the barrel extension to the barrel nut 80, and more preferably the barrel extension engages all of the splines. As described herein, this is provided by barrel extension 100 including axially spaced-apart opposing surfaces that engage front and rear ends 166, 167 of the splines 81, which in some embodiments is provided by front radial locking surface 104 of barrel locking lugs 103 and rear angled locking surface 163 of flange 112.

Any suitable number of splines 81 may be provided so long as a secure locking relationship may be established between barrel unit 30 and rifle 20. In a preferred embodiment, the number of splines 81 may match the number of barrel locking lugs 103 of barrel extension 100. In one embodiment, by way of example as shown in FIGS. 9-11 without limitation, eight raised splines 81 may be provided that correspond with eight barrel locking lugs 103. Other suitable numbers of splines 81 and barrel locking lugs 103 may be used. Preferably, the splines 81 have a uniform circumferential spacing such that the splines are equally spaced around the circumference of barrel nut 80. In one exemplary embodiment, the radial centerline of each spline 81 and each corresponding channel 82 is angularly arranged at an angle A1 of about +/−45 degrees from each other (see FIG. 9 showing A1 between channels for example, splines spacing being the same) wherein eight splines are provided. In other possible embodiments, more or less splines and channels may be provided. For example, six splines 81 and corresponding channels 82 may be provided that are angularly arranged at an angle A1 of about +/−60 degrees from each other. Accordingly, the invention is not limited to any particular number and/or arrangement of splines and channels so long as the barrel locking lugs 103 may be operably engaged with and rotated behind splines 81 as further described herein to lock the barrel unit 30 to rifle 20.

With continuing reference to FIGS. 9-11, splines 81 define longitudinally-extending channels 82 formed between pairs of splines along interior surface 85 of barrel nut 80 for slidably receiving therein complementary configured and dimensioned barrel locking lugs 103, which in one preferred embodiment may be formed on a barrel extension 100 as further described herein. Splines 81 and/or channels 82 preferably extend at least partially along the axial length L2 of barrel nut 80. In addition, splines 81 and/or channels 82 may include continuous or intermittent portions disposed along the length L2 of the barrel nut 80.

Referring now to FIG. 10, barrel nut 80 preferably includes an annular locking groove 87 that receives and locates barrel locking lugs 103 of barrel extension 100. Locking groove 87 extends circumferentially along interior surface 85 of the barrel nut. Preferably, in one embodiment, locking groove 87 is oriented transverse and perpendicular to longitudinal axis LA of rifle 20. Locking groove 87 communicates with longitudinally-extending channels 82 such that barrel locking lugs 103 may be slid along the channels and enter the groove when barrel extension 100 is inserted into barrel nut 80. When barrel locking lugs 103 are positioned in locking groove 87, barrel extension 100 and barrel 31 attached thereto may be rotated to lock and unlock the barrel from the barrel nut 80 and rifle 20. In a preferred embodiment, locking groove 87 bisects splines 81 to define a group of front splines 190 and rear splines 191 on either side of the groove as shown. In a preferred embodiment, front splines 190 disposed forward of locking groove 87 define active locking elements of barrel nut 80 which engage barrel extension 100 to secure the barrel extension to the barrel nut. This group of front splines 190 is wedged between annular flange 112 and barrel locking lugs 103 of barrel extension 100 for detachably and rotatably locking barrel assembly 30 to rifle 20 in a manner further described herein. In some embodiments contemplated (not shown), rear splines 191 may be omitted or need not contribute to assisting with locking the barrel extension 100 to barrel nut 80.

With additional reference to FIG. 11, a rear portion of each spline 81 defines rear radial locking surface 88 for mutually engaging a corresponding and complementary configured front radial locking surface 104 formed on barrel locking lugs 103. Rear radial locking surface 88 on spline 81 is preferably disposed at angle A2 to interior surface 85 of barrel nut 80. Preferably, interior surface 85 is oriented generally parallel to longitudinal axis LA of rifle 20 in some embodiments. In one exemplary embodiment, angle A2 may be at least about 90 degrees, and more preferably at least about 100 degrees allowing for fabrication tolerances. Other suitable angles larger than 90 degrees may be used. It is well within the ambit of one skilled in the art to determine and select a suitable angle A2 for locking surface 88 and angle A3 for locking surface 104 of barrel locking lugs 103 (see FIG. 14). Barrel nut splines 81 and barrel locking lugs 103 preferably each have a complementary radial height selected such that barrel locking lugs 103 cannot be axially removed from inside annular locking groove 87 when locking lugs 103 are radially aligned behind the splines and positioned in the groove.

In a preferred embodiment, splines 81 each define an axial contact surface 160 for engaging a portion of annular tapered contact surface 161 of barrel extension 100, as shown in FIGS. 9 and 10 and described elsewhere herein in greater detail. When barrel extension 100 is inserted into barrel nut 80, a forward portion of each axial contact surface 160 will engage at least a portion of tapered contact surface 161.

In contrast to prior known cast or extruded barrel aluminum barrel nuts, barrel nut 80 in the preferred embodiment is made of steel for strength and ductility since barrel assembly 30 locks directly into the barrel nut. In one preferred embodiment, barrel nut 80 may be forged to provide optimum strength, and more preferably may be forged using a commercially-available hammer mill and process generally described in commonly assigned copending U.S. patent application Ser. No. 11/360,197 (Publication No. 2007/0193102 A1), which is incorporated herein by reference in its entirety. Forging provides barrel nut 80 with greater strength and ductility than cast steel. Preferably, barrel nut 80 is made of a steel or steel alloy commonly used in the art for firearm components and suitable for forging. Barrel nut 80 may be forged in the hammer mill by slipping a tubular steel blank or workpiece over a steel barrel nut form having a reverse impression of splines 81 and channels 82. The steel blank is then rotated continuously and simultaneously fed axially through a series of circumferentially-spaced and diametrically-opposed reciprocating impact hammers. The impact hammers strike the exterior surface of the steel blank, which displaces and forces the metal into a shape conforming to the barrel nut form to produce internal splines 81 and channels 82. Locking groove 87, locking surfaces 88, 165 on splines 81, threads 83, and other features may subsequently be machined using conventional techniques well known to those skilled in the art. In some embodiments, for example, the foregoing features of barrel nut 80 may be cut on a CNC turning center (lathe) except for the orientation pin 113 slot that may be milled into the face of the barrel nut during assembly, which may be done in a vertical machining center (CNC vertical milling machine).

Figure 7:
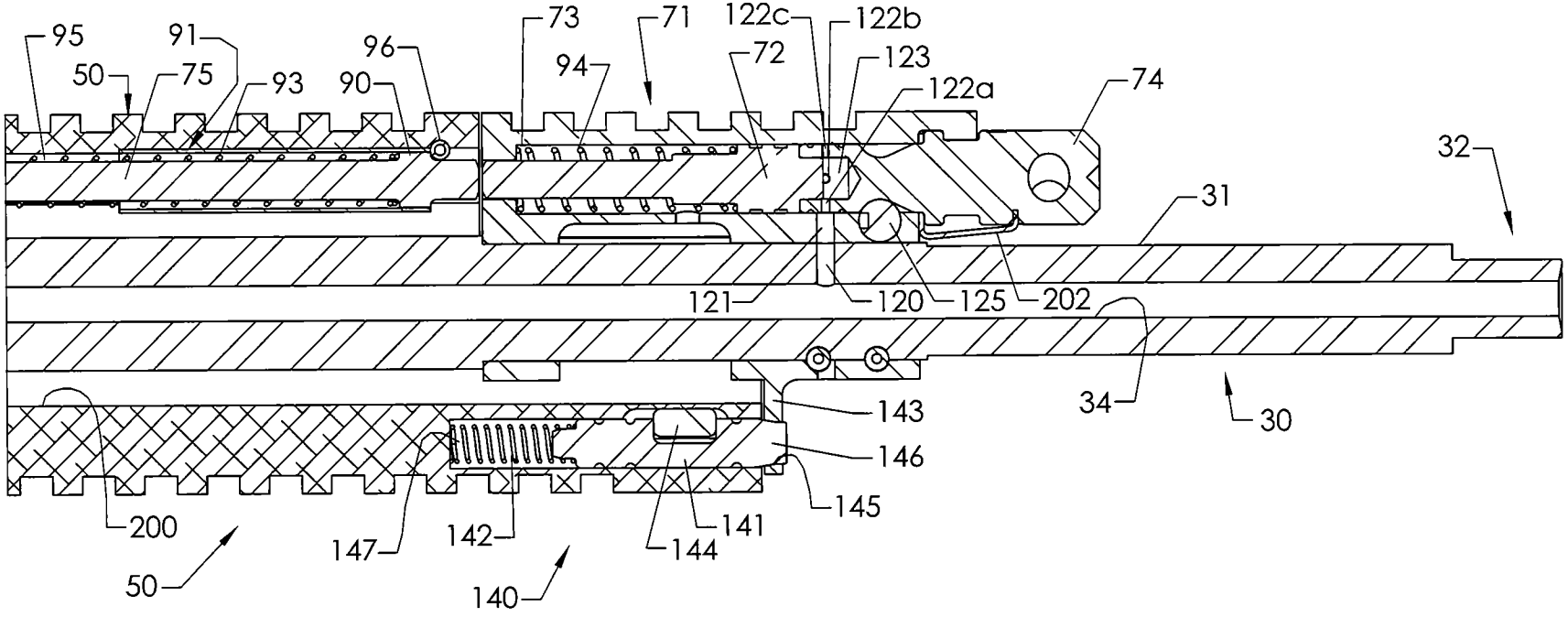
FIG. 7 is a partial cross sectional view of the muzzle end of the barrel.
Figures 8A, 8B:
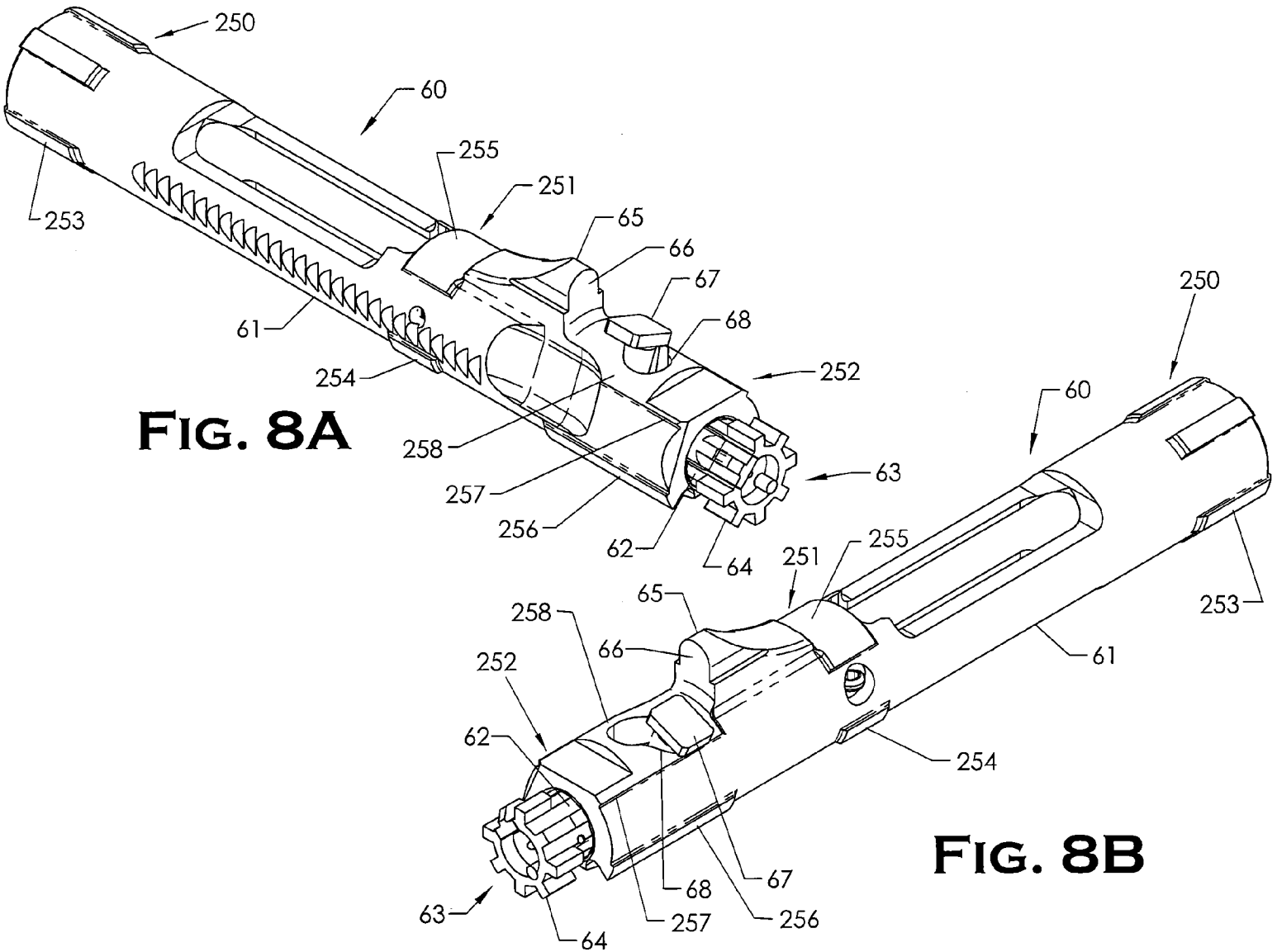
FIG. 8A is a right perspective view of the reciprocating bolt assembly with rotating bolt of the rifle.
FIG. 8B is a left perspective view of the reciprocating bolt assembly with rotating bolt of the rifle.

Handguard: In a preferred embodiment, a handguard 50 may be provided as shown in FIGS. 1, 3, and 7 to protect the users hands from direct contact with a hot barrel 31 after discharging rifle 20. Handguard 50 includes a top, bottom and side portions that extend longitudinally forward from upper receiver 42. Handguard 50 may be of unitary construction or separate top, bottom and side portions that may be permanently or detachably attached together. Preferably, handguard 50 is mounted to upper receiver 42 in a manner such that the handguard is supported by the upper receiver independently of the barrel assembly 30. In one possible embodiment, as shown in FIG. 4, handguard 50 may be coupled to upper receiver 42 by a transverse-mounted pins 270, 271. Bottom pin 270 may be pinned partially through barrel nut 80. Top pin 271 may be pinned partially through tubular bushing 92 affixed to upper receiver 42. In one exemplary embodiment, top pin 271 may be a coiled spring pin or a solid pin. This mounting arrangement allows the barrel assembly 30 to be removed and replaced from rifle 20 while handguard 50 remains in place attached to upper receiver 42. Advantageously, it is not necessary in the preferred embodiments to remove handguard 50 or portions thereof in order to gain access to a barrel nut or other retaining member unlike prior known designs for removing the barrel. Accordingly, the preferred embodiment of a barrel retaining system is intended to reduce the time required to change barrels and eliminate the need to tools. As best shown in FIG. 7, handguard 50 defines an longitudinally-extending internal chamber 53 having a forward-facing opening to receive and house barrel 31.

In one embodiment, as shown if FIG. 1, at least a portion of handguard 50 is preferably provided with accessory mounting rails 52, such as Picatinny-style rails per US Government Publication MIL-STD-1913 Revision 10 (July 1999) or a similar suitable handguard. These rails allow a variety of accessories to be mounted to rifle 20 such as scopes, grenade launchers, tactical flashlights, etc. as conventionally used with field-type rifles. In one embodiment, upper receiver 42 may include accessory mounting rails 52 as shown.

Figures 5, 6A, 6B:
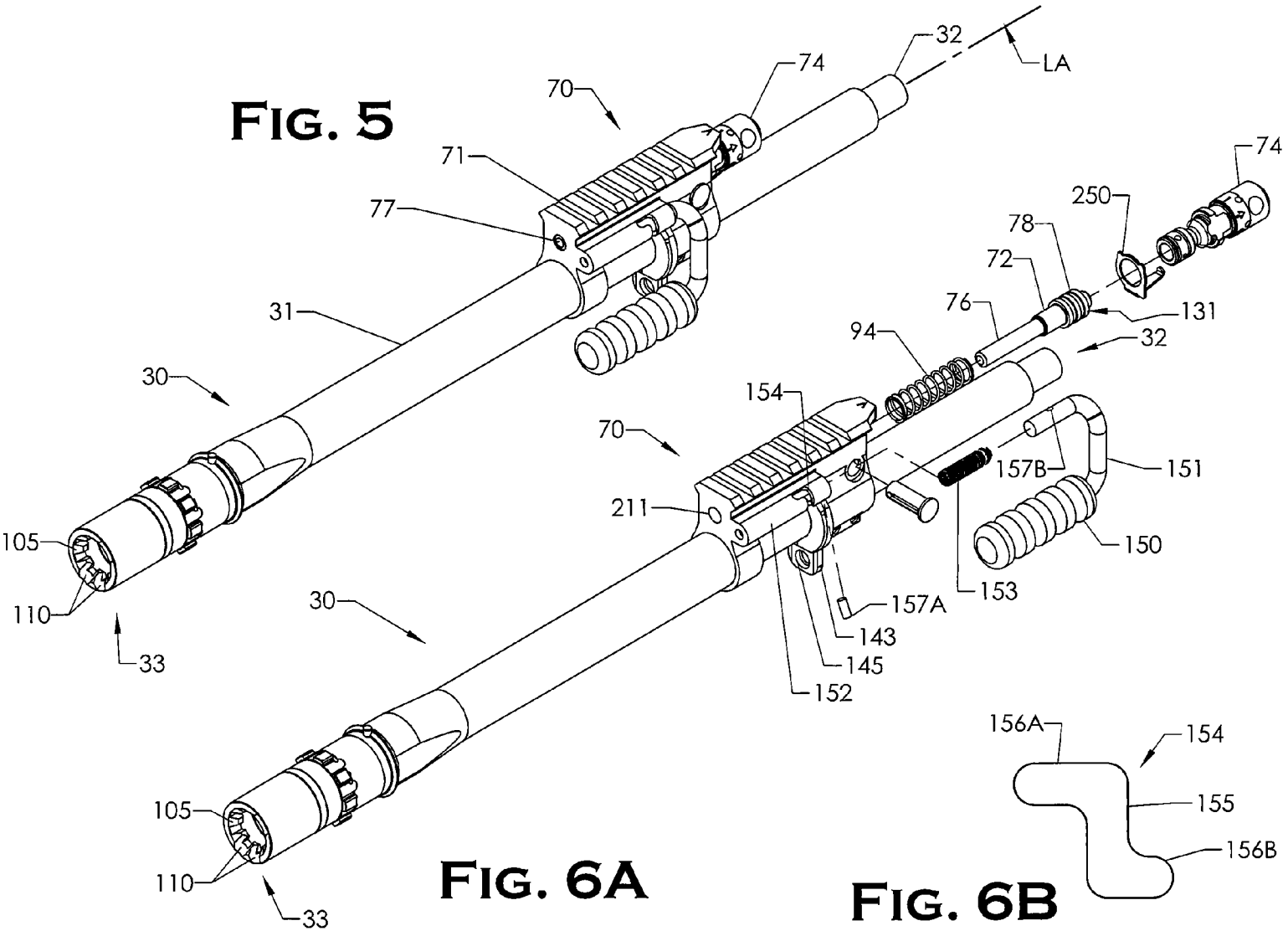
FIG. 5 is a perspective assembled view of the quick-change barrel assembly of the rifle.
FIG. 6A is a perspective exploded view of the quick-change barrel assembly of the rifle.
FIG. 6B is a detailed view of the barrel handle guide notch in the gas block in FIG. 6A.

Gas Piston System: In a preferred embodiment, rifle 20 includes a gas piston operating system 70 which automatically cycles the action of the rifle. FIGS. 5 and 6A show a perspective view and exploded perspective view, respectively, of the gas piston system 70 and gas block 71 mounted on barrel assembly 30. FIG. 7 shows a perspective view of the gas block alone.

Referring now to FIGS. 2, 3, and 5-7, gas piston operating system 70 generally includes gas block 71, a cylindrical piston bore 73 defined therein, a gas piston 72 slidably received in piston bore 73, variable pressure regulator 74, and transfer rod 75. In one embodiment, gas block 71 may be attached to barrel 31 towards the front portion of the barrel by any suitable conventional known means (e.g. pinning, clamping, screws, etc.) and preferably is spaced rearwards from muzzle end 32 as shown. A portion of the combustion gases are bled off from barrel bore 34 and routed to piston bore 73 via (in sequence) port 120 in barrel 31, conduit 121 in gas block 71, one of a plurality of manually selectable lateral orifices in pressure regulator 74 such as orifices 122*a*-122*d*, and axial passageway 123 which opens rearward into piston bore 73 as best shown in FIG. 7. In a preferred embodiment, gas block 71 is mounted on top of barrel 31.

Figure 21:
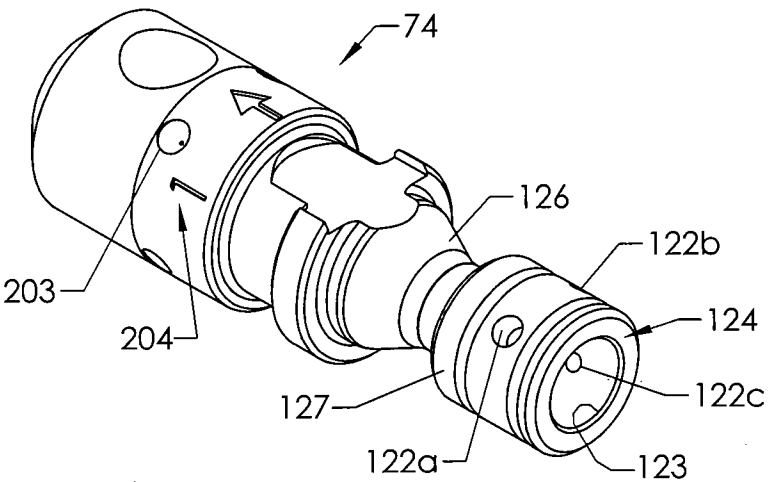
FIG. 21 is a perspective view of the gas pressure regulator of the gas operating system of the rifle.

Referring to FIGS. 7 and 21, pressure regulator 74 is a generally cylindrical component in a preferred embodiment that is rotatably received in the forward portion of piston bore 73. In one embodiment, pressure regulator 74 may be held in gas block 71 via lateral pin 125 that is received in a complementary-shaped annular groove 126 formed in the pressure regulator. However, other suitable means of securing pressure regulator 74 in gas block 71 may be used so long as regulator 74 remains rotatable. Pressure regulator 74 includes a rear face 124 that abuts front face 131 of piston 72 (see FIG. 6A) when both components are mounted in gas block 71. Axial passageway 123 opens through rear face 124 and preferably extends forward partially through the length of pressure regulator 74. A plurality of orifices 122*a*, 122*b*, 122 *c*, and 122*d* (not shown, but opposite orifice 122*b* in FIG. 7) are provided which extend laterally through the sidewall 127 of pressure regulator 74 and communicate with axial passageway 123. Preferably, each orifice 122*a*-122*d* is configured similarly, but has a different diameter than all other orifices to allow the combustion gas flow quantity and pressure to be selectably varied by the user upon rotating different orifices into lateral alignment with conduit 121 of gas block 71 and port 120 of barrel 31 (see FIG. 7). This is intended to allow the user to vary the pressure in piston bore 73 for proper operation of the gas piston system 70 and cycling of the spring-loaded action based on the type of ammunition being used, length of barrel, or other factors which may affect the operating pressure of the gas piston system. A spring clip 202 may be provided that engages detents 203 in pressure regulator 74 (see FIG. 21) to assist retaining the regulator in the user-variable position selection. Other suitable means of fixing the position of pressure regulator 74 may be used. Alphanumerical indicia 204 may be provided on pressure regulator 74 as shown in FIG. 21 to assist users with repeatedly selecting various desired orifices 122*a*-122*d*.

Although a preferred embodiment includes a pressure regulator 74, in other embodiments contemplated a non-variable gas pressure system may be provided. The pressure regulator may therefore be replaced by a fixed diameter axial passageway fluidly connecting the port 120 in barrel 31 with the piston bore 73. Accordingly, the invention is not limited in its applicability to any particular variable or non-variable pressure system.

Referring to FIGS. 2 and 5-7, piston 72 includes a cylindrical head 78 and adjacent cylindrical stem 76 formed integral with or attached to head 78. Piston head 78 in one embodiment may be enlarged with respect to piston stem 76. Preferably, a rear end 77 of piston stem 76 (see FIG. 5) protrudes through a hole in the rear of gas block 71 at the rear of piston bore 73. Transfer rod 75 detachably contacts and engages rear end 77 of piston stem 76 in an abutting relationship in a preferred embodiment. Preferably, transfer rod 75 and piston 72 are separate components that are separable from each so that barrel unit 30 may be removed from rifle 20 without removing the transfer rod, as will be further described herein.

As shown in FIG. 3, transfer rod 75 extends rearwards into upper receiver 42 to engage bolt carrier key 65 of bolt carrier 61 for cycling the action. The rear end of transfer rod 75 is positioned to contact and abut forward-facing thrusting surface 66 of bolt carrier key 65 in an abutting relationship without a fixed or rigid connection between surface 66 and key 65. The rear portion of transfer rod 75 is slidably supported by upper receiver 42 for axial movement therein. In one embodiment, a tubular bushing 92 may be provided in upper receiver 42 to slidably receive and support transfer rod 75. The front portion of transfer rod 75 is supported by handguard 50 as shown in FIG. 7. In a preferred embodiment, handguard 50 contains a longitudinally-extending cavity 95 that movably receives transfer rod 75. Handguard 50 may include a tubular collar 91 located in the front of the handguard proximate to gas block 71 as shown to support transfer rod 75. In one embodiment, transfer rod 75 may include an annular flange 90 positioned proximate to the front of the transfer rod so that intermediate portions of the rod between flange 90 and bushing 92 do not engage cavity 95. This reduces friction and drag on the transfer rod 75 when it is driven rearward by piston 72 to cycle the action after discharging rifle 20.

With continuing reference to FIGS. 2, 3 and 5-7, piston 72 is axially biased in a forward direction by a biasing member such as piston spring 94. Preferably, spring 94 is disposed in piston bore 73 and has one end that abuts gas block at the rear of the piston bore and an opposite front end that acts on piston head 74. Spring 94 keeps piston head 74 abutted against the rear of pressure regulator 74 when the gas piston operating system 70 is not actuated. In a preferred embodiment, transfer rod 75 is axially biased in a forward direction by a separate biasing member such as transfer rod spring 93 as shown in FIGS. 3 and 7. In one embodiment, transfer rod spring 93 is disposed about at least a portion of transfer rod 75 and positioned in cavity 95 of handguard 50 with the transfer rod. Transfer rod spring 93 preferably keeps the front of transfer rod 75 biased against rear end 77 of piston stem 76. Spring 93 has a rear end that abuts upper receiver 42, and in some embodiments bushing 92 as shown. An opposite front end of spring 93 abuts flange 90 on transfer rod 75. Preferably, a travel stop such as transverse pin 96 (see FIG. 7) may be provided to prevent transfer rod 75 from being ejected forward and out from handguard cavity 95 when gas block 71 is removed from rifle 20 as further described herein. Accordingly, in a preferred embodiment, spring-biased transfer rod 75 is self-contained in handguard 50 and rifle 20 independent of the spring-biased piston 72 associated with gas block 71 so that barrel assembly 30 with gas block 71 may be removed from rifle 20 without removing the transfer rod.

Barrel Latching Mechanism: Referring to FIGS. 2 and 5-7, the quick-change barrel retaining system further includes a front barrel latching mechanism 140 for securing the barrel assembly 30 to handguard 50. This is intended to provide a secure connection between the forward portions of barrel assembly 130 and handguard 50 to stabilize the barrel, and prevents the barrel assembly from being unintentionally rotated which might disengage the barrel assembly from barrel nut 80 at the rear. In addition, the latching mechanism 140 provides additional rigidity between the barrel assembly 30 and handguard 50 when grenade launchers are mounted to and used with rifle 20. In a preferred embodiment, barrel latching mechanism is associated with handguard 50. In one embodiment, front barrel latching mechanism 140 includes spring-loaded latch plunger 141 which is disposed in latch plunger cavity 147 of handguard 50 for axial movement therein. Latch plunger 141 engages barrel assembly 30 for detachably locking the barrel assembly to handguard 50. Latch plunger 141 engages an aperture 145 in barrel assembly 30, which in a preferred embodiment may be formed in a latch flange 143. At least a portion of latch plunger 141 protrudes through and engages latch flange 143 to secure the barrel assembly 30 to handguard 50. The front end 146 of latch plunger 141 may be tapered and aperture 145 may have a complementary taper to assist in centering/guiding the latch plunger into the aperture and forming a secure frictional fit. In one embodiment, latch flange 143 may conveniently be formed as part of gas block 71 as shown. In other embodiments contemplated, latch flange may be a separate component from the gas block 71 and secured to or integral with barrel 31 independently of the gas block. Latch plunger 141 is preferably biased in a forward axial direction as shown by latch spring 142 which is disposed in latch plunger cavity 147. This keeps latch plunger 141 seated in the latch flange 143.

Barrel latching mechanism is movable from a latched position shown in FIG. 7 in which latch plunger 141 engages latch flange 143 to an unlatched position (not shown) in which plunger 141 is withdrawn from aperture 145 and flange 143.

To assist with drawing latch plunger 141 from aperture 145 in latch flange 141, a latch trigger 144 is provided which may engage or be integral with the latch plunger. In one embodiment, latch trigger 144 preferably extends in a lateral direction from latch plunger 141 transverse to the longitudinal axis LA of rifle 20, and more preferably may extend sideways from rifle 20 and handguard 50. However, other suitable arrangements are contemplated and may be used for latch trigger 144.

In one embodiment, barrel latching mechanism 140 may be disposed in handguard 50 on the bottom of the handguard opposite gas block 71. In other embodiments contemplated, barrel latching mechanism 140 may be disposed in other suitable positions such as on either side or the top of gas block 71. Accordingly, the invention is not limited to any particular position or configuration of barrel latching mechanism 140 so long as the barrel assembly 30 may be detachably engaged and locked to handguard 50.

Barrel Operating Handle: According to another aspect of the preferred embodiment, a movable barrel operating handle 150 is provided as shown in FIGS. 5, 6A-B, and 22 to facilitate rotating and removing barrel assembly 30 from rifle 20, including when the barrel assembly is hot. Barrel handle 150 provides lever so that the user can readily apply the required rotational force required to lock and unlock barrel assembly 30 from rifle 20. Using the barrel handle 150, barrel assembly 30 can further be replaced without the use of separate tools in a preferred embodiment.

Referring now to FIGS. 5, 6A-B, and 22, barrel handle 150 is preferably coupled to barrel assembly 30 and rotatable about longitudinal axis LA between a stowed position (shown in FIG. 22) in which the handle is tucked in proximate to barrel assembly 30 and a deployed position (shown in dashed lines in FIG. 22) in which the handle extends outwards farther from the barrel assembly than in the stowed position to provide a mechanical advantage to the user. Barrel handle 150 may be movably coupled to gas block 71 via a handle rod 151 which is received in a socket 152 disposed in the gas block. Handle rod 151 may be generally U-shaped in a preferred embodiment having barrel handle 150 disposed on one end of the rod and the other end of the rod being inserted into socket 152. Handle rod 151 may be forward biased by a spring 153 which is carried in socket 152 and acts on the rod. In a preferred embodiment, gas block 71 includes a configured guide notch 154 having an arcuate vertical portion 155 oriented transverse to the longitudinal axis LA and a horizontal straight top portion 156A and bottom portion 156B extending axially in opposite directions. Notch 154 communicates with socket 152. Handle rod 151 includes a transverse pin 157A in a preferred embodiment as shown that fits in hole 157B in handle rod 151 and travels in notch 154 for guiding and limiting movement of barrel handle 150.

Operation of Quick-Change Barrel Retaining System: Operation of the barrel retaining system according to principles of the present invention for rifle 20 will now be described starting with the barrel removal process. Initial reference is made to FIGS. 1 and 2 showing barrel assembly 30 already mounted in rifle 20. All references made to orientation and direction are for convenience only and from the perspective of a user facing towards the rear of rifle 20 and looking at the muzzle end 32 of barrel 31.

Barrel assembly 30 is shown in FIGS. 1 and 2 in a ready-to-fire position with barrel extension 100 being in the locked position engaged with barrel nut 80. The front portion of barrel assembly 30 is secured to handguard 50 via latching mechanism 140 at the front of the handguard. Barrel locking lugs 103 are rotationally engaged with splines 81 such that front radial locking surface 104 of the barrel locking lugs are engaged with rear radial locking surface 88 on spline 81 of barrel nut 80. In a preferred embodiment, each barrel locking lugs 103 is positioned behind each corresponding spline 81 preferably so that the radial centerline of each barrel locking lugs is approximately axially aligned with the centerline of each spline when the barrel extension is fully locked into the barrel nut. In other embodiments contemplated, barrel locking lugs 103 may only partially engage splines 81 by a sufficient amount to secure lock barrel extension 100 to barrel nut 80, wherein the centerlines of splines 81 and barrel locking lugs 103 are not fully in axial alignment. Accordingly, complete axial alignment is not necessary in some embodiments to securely mount barrel assembly 30 to rifle 20.

In the ready-to-fire position of barrel assembly 30 shown in FIGS. 1 and 2, rear angled locking surface 163 of flange 112 is preferably engaged and compressed against front angled locking surfaces 165 of splines 81. Accordingly, the splines 81 are wedged between flange 112 and barrel locking lugs 103. In some embodiments where a frustoconical portion is optionally provided on barrel extension 100, tapered contact surface 161 formed by the frustoconical portion is engaged with axial contact surface 160 disposed on top of each spline 81.

Figure 22:
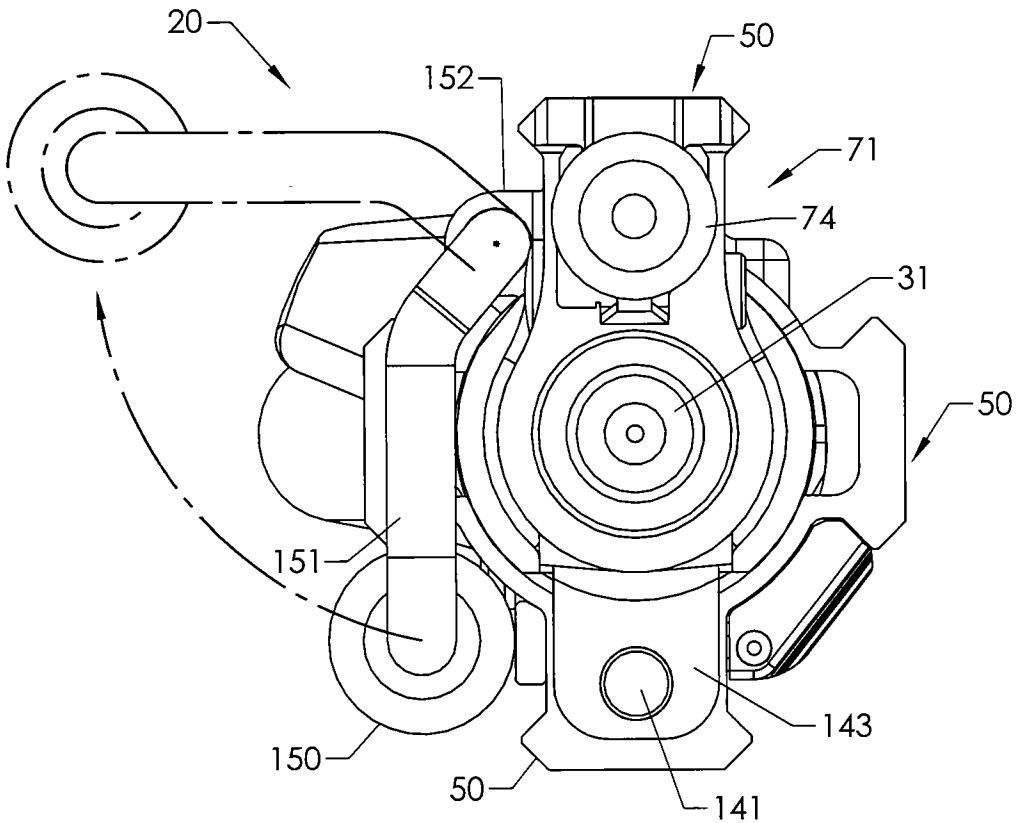
FIG. 22 is a front view of the muzzle end of the rifle looking towards the receiver.

To remove mounted barrel assembly 30 from rifle 20, with additional reference to FIGS. 5-7 and 22, the user first rotates stowed barrel handle 150 in a clockwise direction about longitudinal axis LA and moves the handle to the extended deployed position (shown by dashed lines in FIG. 22). The user also activates the barrel latching mechanism 140 by pulling rearwards on latch trigger 144 to disengage and withdraw latch plunger 141 from aperture 143 of latch flange 143. This effectively uncouples barrel assembly 30 from handguard 50 and allows the barrel assembly to be freely rotated independent from the stationary handguard still attached to receiver assembly 40. It will be appreciated that the steps of deploying barrel handle 150 or activating barrel latching mechanism 140 may be done in any order or essentially simultaneously.

Preferably using barrel handle 150, while holding latch trigger 144 and latch plunger 141 coupled thereto rearwards, the user next rotates barrel assembly 30 clockwise about longitudinal axis LA towards a second unlocked position. Rotating barrel assembly 30 simultaneously rotates barrel extension 100 coupled thereto in the same direction and unlocks barrel locking lugs 103 from splines 81 in barrel nut 80 with the barrel locking lugs turning in circumferential locking groove 87. Front radial locking surface 104 of barrel locking lugs 103 disengage rear radial locking surface 88 on spline 81 of barrel nut 80 (see additionally FIGS. 3, 4, 9-10 and 14-15) and relieve the compressive force F1 therebetween (reference FIG. 4). Barrel locking lugs 103 now are axially aligned with channels 82 of barrel nut 80 to allow the barrel extension 100 of barrel assembly 30 to be axially withdrawn forward from barrel nut 80. In one exemplary preferred embodiment, described herein, eight barrel locking lugs 103 and eight splines 81 and channels 82 may be provided and arranged such that rotating barrel assembly 30 (with barrel extension 100) clockwise by approximately +/−22.5 degrees or a ⅛ turn will disengage barrel locking lugs 103 from splines 81 of barrel nut 80 and align the barrel locking lugs with channels 82. This correlates to the top of barrel assembly 30 and gas block 71 being approximately between a 1-2 o'clock position (from a user's perspective facing towards the rear of rifle 20). When each barrel locking lugs 103 is positioned in alignment with channels 82 of barrel nut 80, the compressive engagement and compressive force F2 between rear angled locking surface 163 of flange 112 (on barrel extension 100) and front angled locking surface 165 (on barrel nut 80) is also relieved (reference FIG. 4). In some embodiments having a frustoconical portion provided on barrel extension 100, compressive force F3 between tapered contact surface of barrel extension 100 and axial contact surface 160 of splines 81 is also relieved (reference FIG. 4).

Referring to FIG. 7, because piston 72 is separately disposed in gas block 71 and not integral with transfer rod 75, any surface-to-surface contact between the transfer rod and piston stem 76 is broken when barrel assembly 30 is rotated clockwise. Transfer rod 75, however, remains stationary in position being mounted in handguard 50.

The user next slides barrel assembly 30 in an axial forward direction thereby sliding barrel locking lugs 103 in channels 81 to withdraw the barrel extension 100 from barrel nut 80. The user continues to move barrel assembly 30 forward and withdraws the entire barrel assembly 30 from within handguard 50 to complete the barrel removal. The disembodied barrel assembly 30 would appear as shown in FIG. 5 and can be replaced with another barrel assembly of the same or different type and/or barrel length. Handguard 50 remains attached to receiver assembly 40.

To install a new barrel assembly 30, the foregoing process is essentially reversed. Generally, new barrel assembly 30 is oriented with the top of barrel assembly 30 at between about the 1-2 o'clock radial position corresponding to the removal position of the old barrel. The barrel assembly 30 is inserted axially rearwards through the front of handguard 50 until barrel extension 100 is fully inserted into and seated in barrel nut 80. Barrel locking lugs 103 will enter and slide rearwards in channels 82 of barrel nut 80. Annular flange 112 will contact/abut front angled locking surfaces of each spline 81 on barrel end 84 of barrel nut 80 and to tactilely indicate to the user that the barrel extension is fully inserted (see FIG. 4). In addition, barrel extension 100 is preferably configured and dimensioned such that barrel locking lugs 103 will concomitantly be located and fall into proper position within locking groove 87 of barrel nut 80 when flange 112 abuts the barrel nut. With the user then either retracting latch plunger 141 rearwards again (via the latch trigger 144) if previously released after removing the barrel or still holding latch plunger 141 rearwards if not released before, the user then rotates barrel assembly 30 counterclockwise (by about +/−22.5 degrees or a ⅛ turn in the preferred embodiment described herein) until gas block 71 is at top center position and aperture 145 of latch flange 143 is axially aligned again with latch plunger 141. This rotationally engages barrel locking lugs 103 with splines 81 to lock barrel extension 100 into barrel nut 80 in the manner already described herein. The camming action between spline 81 and camming notch 170 (see FIG. 16) disposed at front radial locking surface 104 of each barrel locking lug 103 displaces barrel extension 100 slightly rearward in the manner already described herein. Front radial locking surface 104 of barrel locking lugs 103 now rotationally engages and is fully compressed against rear radial locking surface 88 of splines 81 (see FIG. 4, compressive locking force F1). The rearward displacement of barrel extension 100 also fully compresses rear angled locking surface 163 of flange 112 against front angled locking surface 165 of spline 81 (see FIG. 4, compressive locking force F2) such that the splines 81 are wedged between the barrel locking lugs and flange of the barrel extension. In some embodiments where provided, tapered contact surface 161 of barrel extension 100 becomes fully compressed into axial contact surface 160 on top of spline 81 with the rearward axial displacement of the barrel extension caused by camming notches 170. This causes an increasing annular frictional force fit between tapered contact surface 161 contact surface 160 of the splines 81 (see FIG. 4, compressive locking force F3) as barrel extension 100 moves rearward relative to barrel nut 80.

With barrel assembly 30 fully seated and rotated into its final locked and ready-to-fire position, the user may release latch trigger 144 so that latch plunger 141 enters aperture 145 of latch flange 143 to lock the front of barrel assembly 30 to handguard 50 (see, e.g. FIG. 7). Barrel assembly 30 is now fully locked to rifle 20 which is ready to be fired.

Spring-Loaded Quick Coupling Barrel Retaining System

According to another aspect of the present invention, a spring-loaded quick coupling barrel retaining system is provided in one embodiment that is self-tensioning and self-adjusting to maintain a secure lock up between the user-removable barrel and barrel nut mounted to the upper receiver described herein. The spring-loaded barrel system generally incorporates many aspects of the barrel system already described herein with respect to FIGS. 1-22, but further includes an elastically deformable biasing or spring member in the separable barrel nut-barrel assembly combination. The spring member preferably is operably disposed between a portion of the barrel nut mounted to the receiver and the removable/replaceable barrel assembly. In one embodiment, without limitation, the spring member may be a coned disc spring (also known as a Belleville spring or washer in the art).

Advantageously, the spring-loaded quick coupling barrel system simplifies fabrication by at least partially relieving some of the exacting manufacturing tolerances that need to be maintained between the mutually engaging locking surfaces and features of barrel extension 100 disposed on the rear of barrel 31 and barrel nut 80 to achieve a tight fit and secure lockup of the barrel 31 to upper receiver 42. In the previously described quick coupled barrel embodiment shown in FIGS. 1-22, front splines 190 of barrel nut 80 (see, e.g. FIGS. 4 and 10) become wedged between forwardly disposed annular locking flange 112 and rearward barrel locking lugs 103 on barrel extension 100 (see, e.g. FIGS. 4 and 15) for detachably and rotatably locking barrel assembly 30 to rifle 20. Therefore, manufacturing tolerances need to be precisely controlled to ensure that the front splines 190 of the barrel nut 80 properly fit and are engaged between the forward locking flange 112 and rearward barrel locking lugs 103 to promote secure locking of the barrel assembly to the rifle. Since the flange 112 on barrel extension 100 and front splines on barrel nut 80 represent fixed structures on the parts, the manufacturing of these parts inherently introduces dimensional variances due to manufacturing/machining accuracy limitations which adds to the tolerance stack which may interference with proper mating of these components.

The spring-loaded quick coupling barrel retaining system to now be described eliminates locking flange 112 from the front of barrel extension 100, which is replaced by an axially deformable and flexible biasing or spring member such as a coned disc spring 550. Advantageously, this provides a self-tensioning and self-adjusting interface between the barrel nut and barrel assembly to relieve the manufacturing tolerance stack between these components promoting more reliable mating and smooth operation when coupling the barrel assembly to the rifle. This results in a barrel quick coupling system that is simpler and less expensive to manufacture. This flexible interface compensates for dimensional variations from machining or forming the barrel nut, barrel extension, and barrel. In addition, the spring-loaded barrel assembly benefits the interface and mating further rearward on the barrel nut 80 between the barrel locking lugs 103 on the barrel extension 100 and rear of front splines 190 on the barrel nut at circumferential locking groove 87 due to the biasing or spring member providing some degree of self-adjustment in axial position of the barrel extension with respect to the barrel nut.

In addition, it may further be noted that after repeated use and exchange of new replaceable barrels in rifle 20 over time as the rifling on the barrels wears out, the various barrel extension locking surfaces on the barrel nut 80 (which remains attached to upper receiver mounting nipple 48 as shown for example in FIGS. 3 and 4) may experience wear resulting in opening up of these manufacturing tolerances between the mutually engaging locking surfaces on the barrel extension 100 and barrel nut 80. This may result in a less than desired tight fit between the barrel extension and barrel nut requiring more frequent replacement of the barrel nut over time. Sand, dirt, or other debris may become lodged between the mating locking surfaces of the barrel extension and barrel nut when barrels are exchanged under field conditions depending on the environment encountered. This situation may interfere with maintaining the tight tolerances required between the barrel extension 100 and barrel nut 80 mating locking surfaces for a tight fit. The spring-loaded quick coupling barrel retaining system disclosed herein at least partially compensates for the foregoing types of conditions by providing some degree of axial flexibility in positioning and movement between mating components to still promote reliable lock up of a new barrel assembly to the rifle even when manufacturing tolerances between these components may be out of original factory specification due to wear or other service factors such as heat or pressure which may alter manufactured dimensions.

Figure 23:
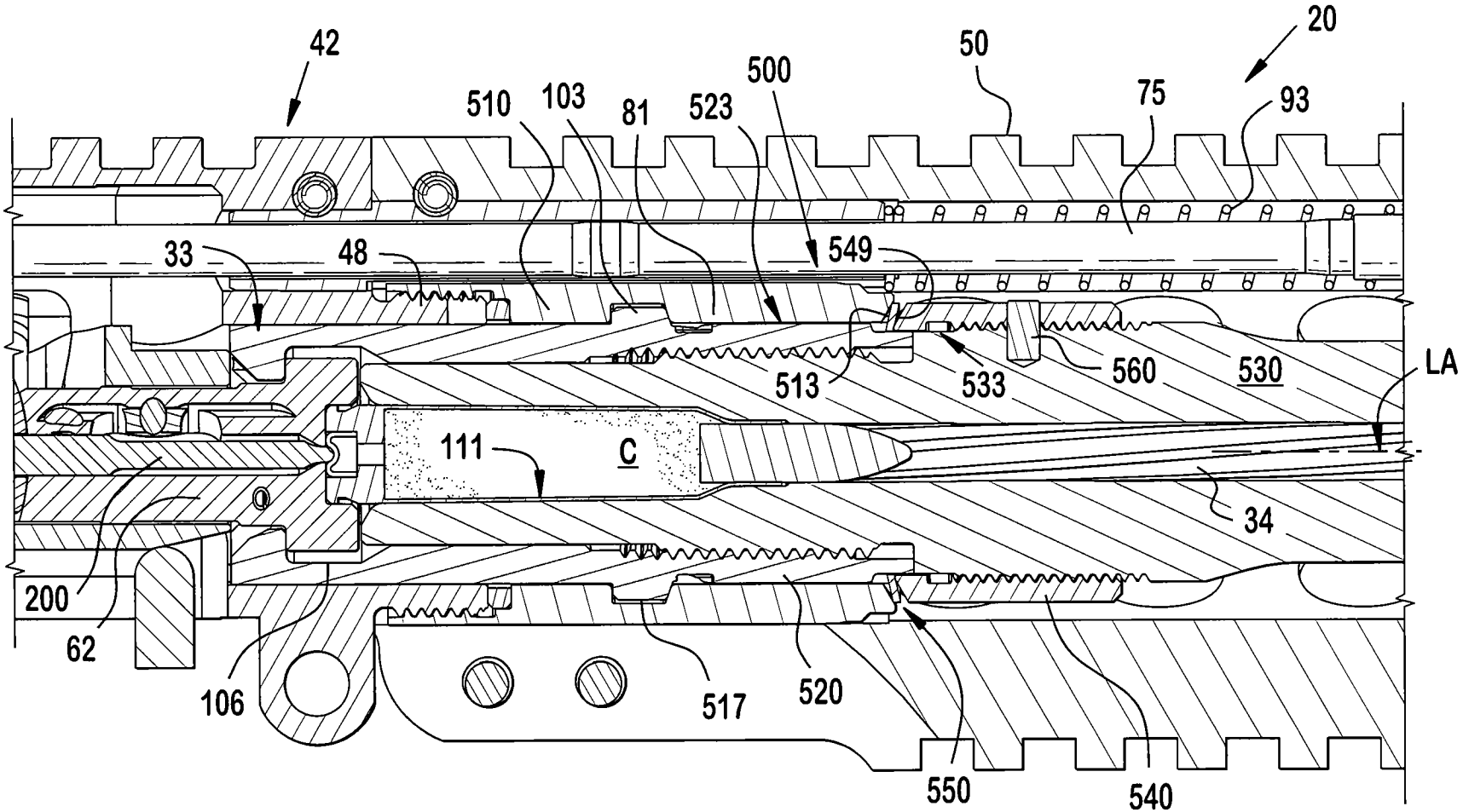
FIG. 23 is a cross sectional side view of a second embodiment of a rifle having a spring-biased self-tensioning quick coupling barrel assembly showing the area of the receiver and breech end of the barrel assembly.

FIG. 23 depicts one possible embodiment of a novel spring-loaded quick coupling barrel retaining system according to principles of the present invention. FIG. 23 is a partial cross sectional detailed view of the upper receiver and breech end of the barrel of the rifle with the barrel assembly or unit being fully mounted to rifle 20 in a locked and ready-to-fire position.

It should be noted that many of the elements or components of the spring-loaded quick coupling barrel retaining system are essentially similar to those previously described in FIGS.

1-22 (e.g. barrel nut 80, barrel extension 100, etc.) with some modifications being made. Reference should be made to the description of those elements already provided herein to the extent application for the spring-loaded barrel system. New and/or modified component elements or components associated with embodiments of the self-tensioning barrel quick coupling system are assigned new numerical reference numbers while sub-parts of those previously disclosed elements or components that remain the same retain the same reference numbers used before.

Referring now to FIG. 23, spring-loaded quick coupling barrel retaining system 500 generally includes barrel nut 510, barrel extension 520 removably mounted on rear breech end 33 of barrel 530, lock nut 540, and an elastically deformable biasing or spring member which functions to axially tension the barrel coupling system. In some preferred embodiments, without limitation, the spring member may be a coned disc or Belleville type spring 550. Barrel extension 520 and barrel 530 collectively define a barrel extension-barrel assembly (referred to hereafter as barrel assembly 520/530 for convenience).

Figure 24:
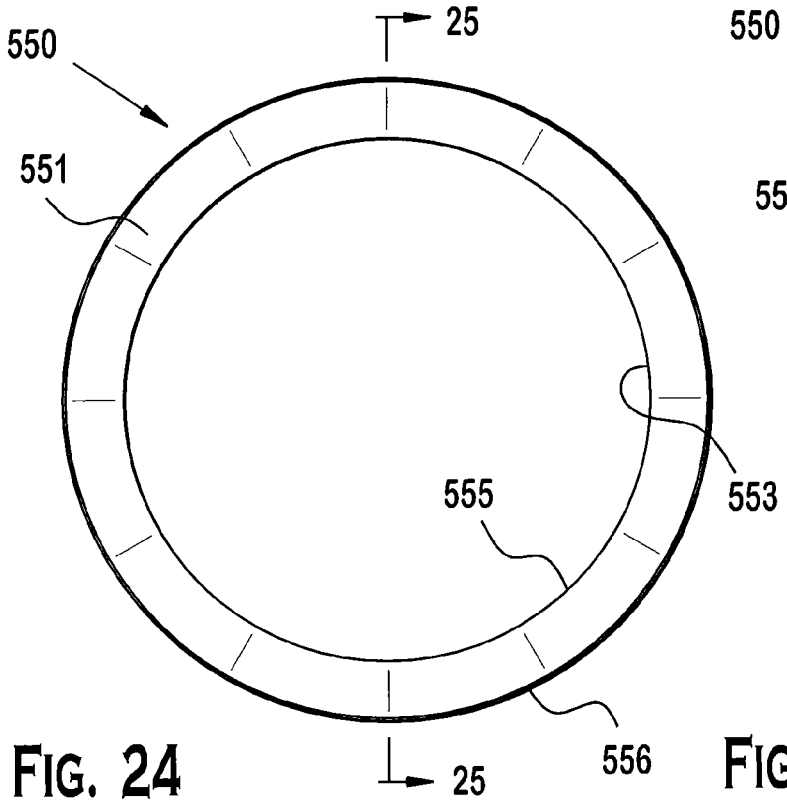
FIG. 24 is a top plan view of a coned disc spring used in the rifle of FIG. 23.
Figure 25:
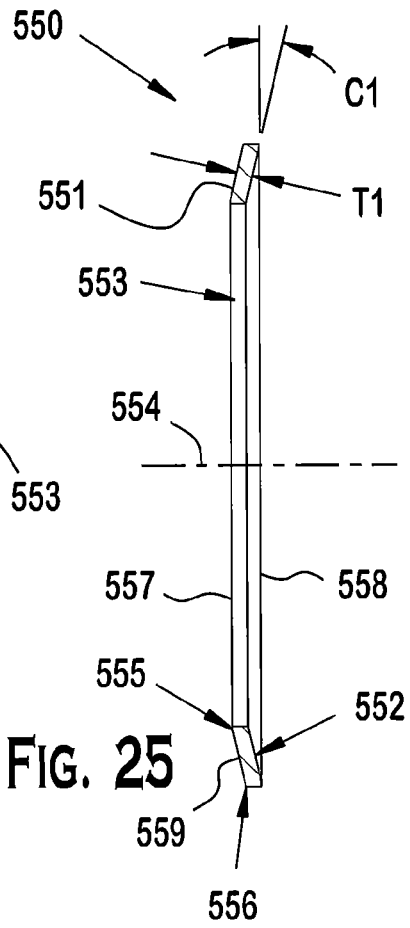
FIG. 25 is a cross sectional view thereof.

In one embodiment as best shown in FIGS. 24 and 25, coned disc spring 550 has an annular and generally frusto-conical shaped body forming a convex upper annular surface 551, a concave lower annular surface 552, a central opening 553 which defines a central axis 554. Disc spring 550 further includes a top end 557 defining a top annular edge 555, bottom end 558 defining a bottom annular edge 556, a sidewall 559 extending longitudinally between the top and bottom ends. In one embodiment, central opening 553 may be circular shaped and is configured and dimensioned to have a diameter larger than breech end 33 of barrel 31 to allow spring 550 to be slipped over the barrel. Central opening 553 is also preferably slightly larger in diameter than reduced diameter portion 521 on front end 103 of barrel extension 520 which forms an axial seating seat for the spring in some embodiments as further described herein.

Disc spring 550 functions in a conventional manner and exerts a biasing force between barrel extension 520-barrel 530 assembly and barrel nut 510 to keep barrel extension 520 tightly engaged with the barrel nut when the barrel is mounted to upper receiver 42 (FIG. 23) wherein the spring is at least partially compressed or deformed. The force F (also referred to as restoring force) exerted by disc spring 550 may be determined by application of well known Hooke's Law $F=-kx$ wherein F=force (Newtons in SI units), k=spring constant ($Nm^{-1}$ in SI units), and x=displacement (meters in SI units) of the spring from its equilibrium or unloaded condition. Disc spring 550 is operable to be deformed and deflected to assume a more flattened profile (i.e. reduced cone angle C1 of sidewall 559 with respect to base or bottom end 558 as identified in FIG. 25) when an external compressive load or force is applied to the spring in an axial direction parallel to spring central axis 554. This external force, which in one embodiment may be created by the action of mounting barrel extension-barrel assembly 520/530 to upper receiver 42 in the manner described herein, is opposed by the oppositely directed restoring force F of the spring (i.e. spring memory) which resists deformation and attempts to return the spring to its original configuration, thereby producing the biasing force between the barrel assembly 520/530 and barrel nut 510. Disc spring 550 is therefore further operative to resume a more coned profile (i.e. increased cone angle C1 of sidewall 559 with respect to base or bottom end 558) when the external compressive load is reduced or removed to maintain tight engagement between barrel assembly 520/530 and barrel nut 510.

Figure 26:
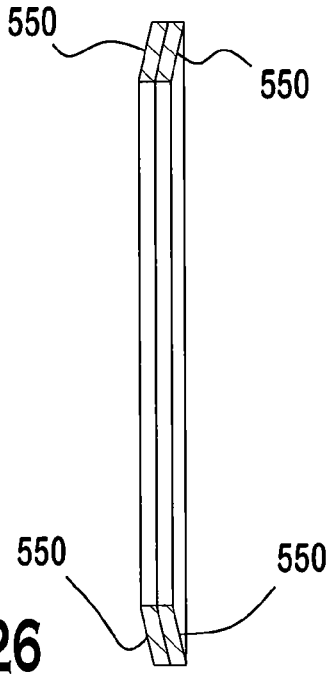
FIG. 26 is a cross sectional view of multiple spring members usable in the rifle of FIG. 23 arranged in a parallel mounting relationship.
Figure 27:
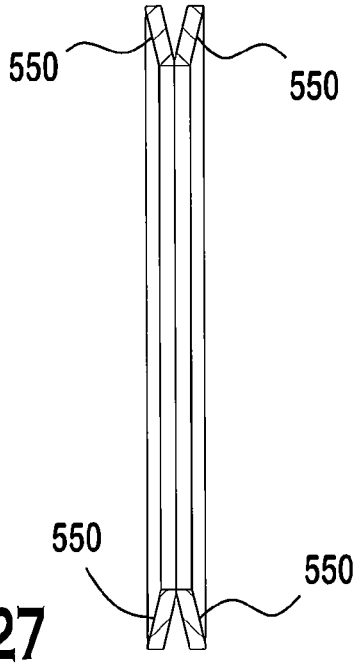
FIG. 27 is a cross sectional view of multiple spring members usable in the rifle of FIG. 23 arranged in a series mounting relationship.

Preferably, at least one disc spring 550 is provided. In some embodiments, as will be known to those of ordinary skill in the art, two or more disc springs 550 may be used in stacked relation to each other to modify the spring constant "k" force and/or maximum amount of deflection of the spring(s) obtainable. Accordingly, multiple disc springs 550 may be used in a parallel nested arrangement to each other (i.e. facing in same direction, see e.g. FIG. 26), a series arrangement to each other (i.e. facing in opposite directions with top ends of two disc springs or bottom ends of two springs contacting each other, see e.g. FIG. 27), or a combination thereof. Stacking in parallel generally increases the spring constant and stiffens the spring combination while stacking in series generally increases the amount of deflection obtainable.

Disc spring 550 may have any suitable thickness T1 (measured perpendicular and through sidewall 559) and cone angle C1 which in combination with the spring material selected and overall cone height (measured between top end 554 and base or bottom end 558) will determine the spring constant "k" and amount of deflection obtainable under a given externally applied axial load. It is well within the ambit of one skilled in the art to select a disc spring 550 with the appropriate foregoing technical specifications without undue experimentation to fit the specific intended application requirements. Any suitable spring material may be used including without limitation steel and steel alloys, copper alloys, nickel alloys, cobalt alloys, or other metals. In some preferred embodiments, the spring material may be heat and/or corrosion resistant. In one preferred embodiment, disc spring 550 is made of stainless steel. Suitable disc springs are commercially available from manufacturers such as Key Bellevilles, Inc. of Leechburg, Pa. and others.

To incorporate disc spring 550 into the self-tensioning barrel quick coupling system 500, the barrel nut 510, barrel extension 520, and barrel 530 are modified in certain respects from those embodiments previously shown in FIGS. 1-22 and described herein. In one embodiment, a lock nut 540 is added which is movably disposed on barrel assembly 520/530 that operatively interacts with the disc spring 550. Lock nut 540 may further be used with advantage to preset a predetermined load imparted by the spring to the barrel extension-barrel nut assembly when in use, as further disclosed herein. These modified and new components of the self-tensioning barrel quick coupling system will now be further described.

Figure 28:
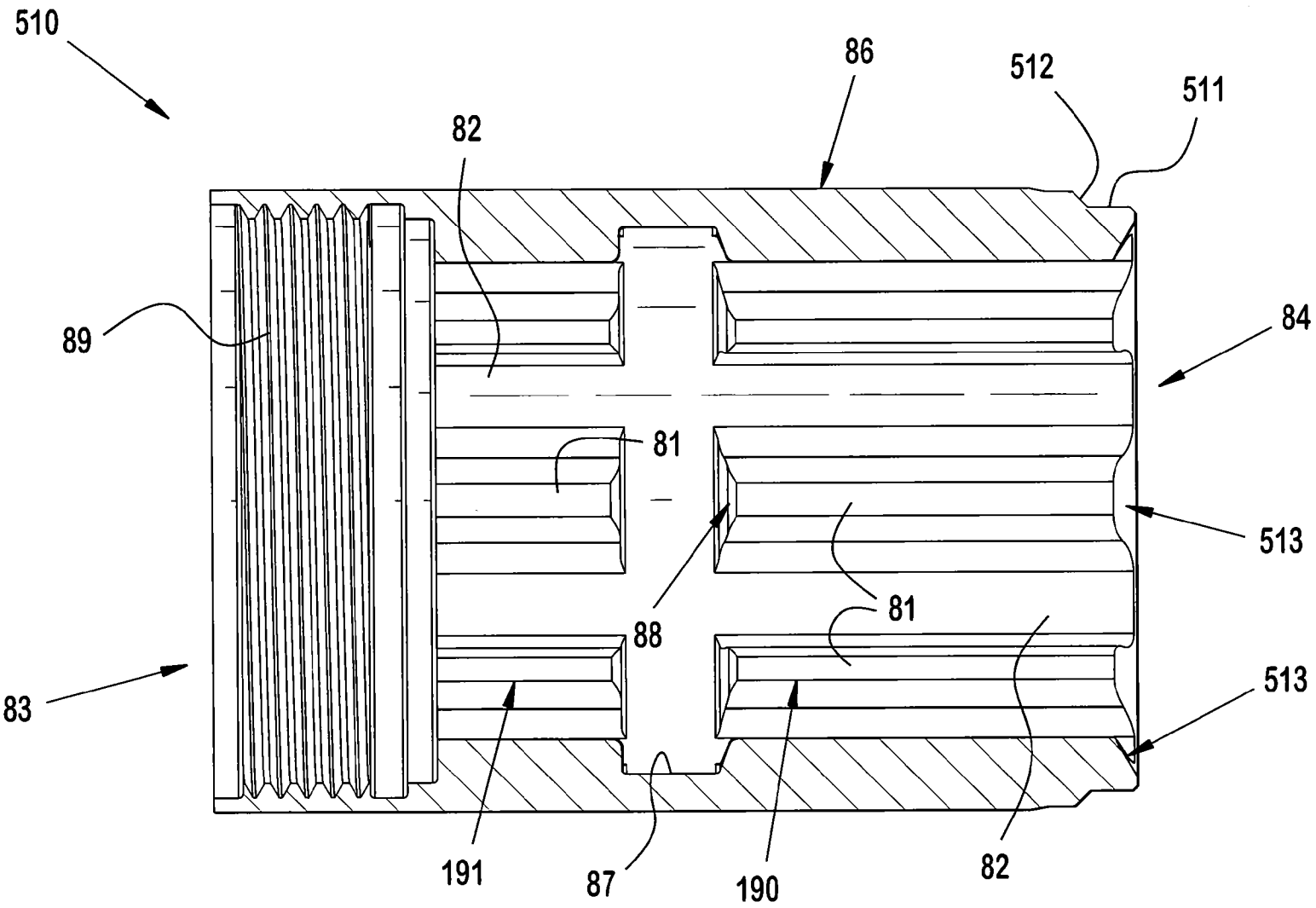
FIG. 28 is a cross sectional side view of the barrel nut used in the rifle of FIG. 23.

FIG. 28 is a cross-sectional side view of one embodiment of a barrel nut 510 associated with the self-tensioning barrel quick coupling system. Barrel nut 510 is essentially the same as barrel nut 80 previously described (reference FIGS. 9-11) and includes an interior surface 85 which defines an internal axial passageway preferably extending completely through the barrel nut for receiving portions of barrel extension 520 and/or barrel 530 at least partially therethrough, with the following differences.

In one embodiment, with continuing reference to FIGS. 9-11 and 28, the exterior surface 86 of barrel nut 510 proximate to front end 84 includes a reduced diameter annular portion 511 which transitions into the larger diameter rearward portion of the remainder of the barrel nut at shoulder 512 disposed therebetween as shown. Front end 84 of barrel nut 510 may similarly include front angled locking surfaces 165 formed on the forward ends of the front splines 190 similarly to barrel nut 80 (see FIGS. 9 and 10). However, in the self-tensioning barrel quick coupling system embodiment, surfaces 165 instead define forward facing radial spring contact or seating surfaces 513 (re-designated reference numeral as shown in FIG. 28 for convenience in view of new functionality) which are operative to contact and compress coned disc spring 550 against lock nut 540 as shown in FIG. 23. In a preferred embodiment, radial spring seating surfaces 513 of barrel nut 510 may be angled similar to angled locking surfaces 165 on barrel nut 80 (see, e.g. FIG. 10) sloping rearwards and inwards towards the interior of the barrel nut, thereby defining surfaces 513 that face forwards and towards the axial centerline of the barrel nut and longitudinal axis LA when barrel 530 is mounted to the barrel nut (see also FIG. 23). Since radial spring seating surfaces 513 are disposed on the ends of front splines 190, the surfaces collectively define a forward facing interrupted annular contact surface that engages disc spring 550. Radial spring seating surfaces 513 function with rear facing radial spring contact or seating surface 549 of lock nut 540 to compress disc spring 550 therebetween when barrel 530 is coupled to barrel nut 510. In other possible alternative embodiments contemplated, radial spring seating surface 513 may instead be vertically oriented and disposed perpendicular to longitudinal axis LA of the barrel 530.

Figure 29:
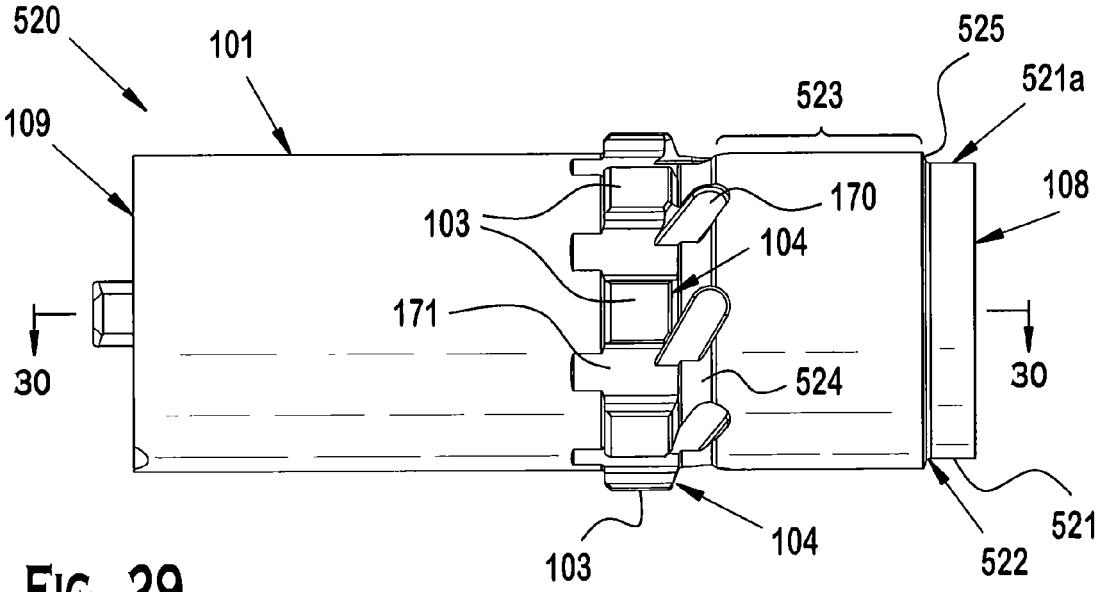
FIG. 29 is a side view of the barrel extension used in the rifle of FIG. 23.
Figure 30:
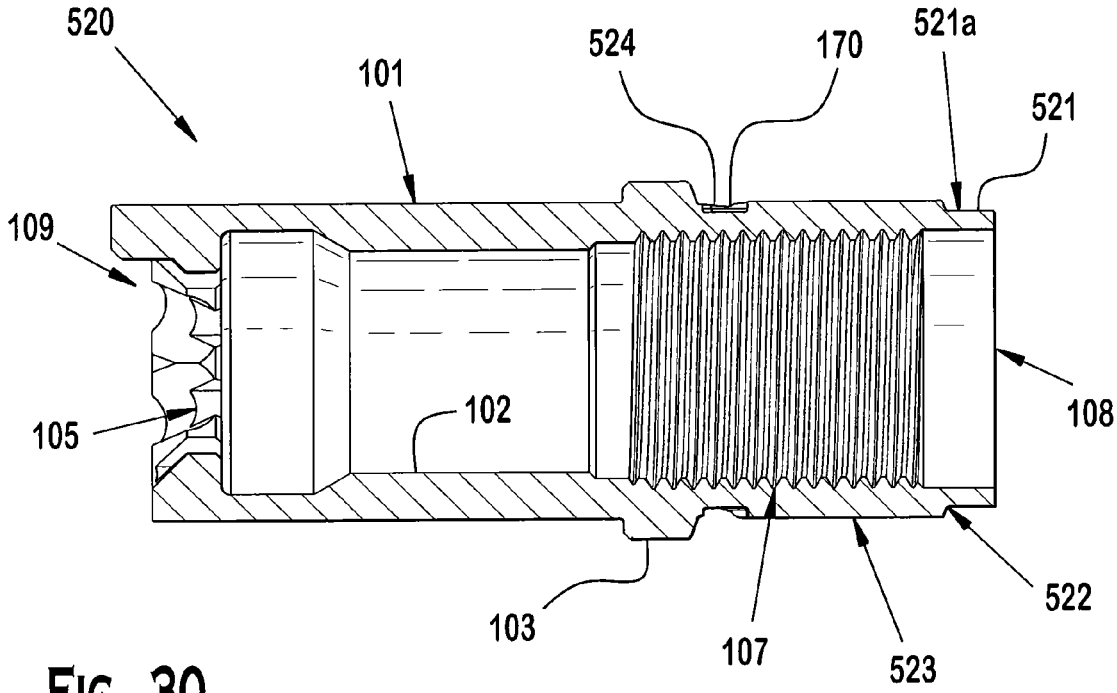
FIG. 30 is a cross-sectional side view thereof.

FIG. 29 depicts a side view of barrel extension 520 associated with the self-tensioning barrel quick coupling system 500. FIG. 30 is a cross-sectional view of barrel extension 520 taken from FIG. 29. Barrel extension 520 is essentially the same as barrel extension 100 previously described (FIGS. 14 and 15) with the following differences. Forward portions of barrel extension 520 proximate to front end 108 and forward of barrel locking lugs 103 have been modified and configured to receive disc spring 550 and lock nut 540. Most notably, rigidly formed flange 112 on front end 108 of barrel extension 100 (see, e.g. FIGS. 14 and 15) has been removed in its entirety and replaced in functionality by deformable self-tensioning spring 550.

With continuing reference to FIGS. 29 and 30, the exterior surface 101 of barrel extension 520 proximate front end 108 includes a reduced diameter annular portion 521 which is separated from the larger diameter portion immediately rearward by a shoulder 522 as shown. Accordingly, reduced diameter portion 521 has a smaller diameter than annular contact surface 523 defined between barrel locking lugs 103 and front end 108 which receives and engages front splines 190 of barrel nut 510. Contact surface 523 need not be tapered in some embodiments like tapered contact surface 161 defined on annular surface 114 of barrel extension 100 (shown in FIGS. 14 and 15), thereby advantageously simplifying manufacturing by relieving the need to maintain precise tolerances associated with producing a tapered surface on the barrel extension.

Reduced diameter portion 521 of barrel extension 520 forms a seat for holding disc spring 550, which in combination with shoulder 522 traps the spring between the shoulder and lock nut 540 (see, e.g. FIG. 23) in one embodiment when the user-replaceable barrel 530 is in an uncoupled condition removed from rifle 20 so that the spring does not become separated and lost either in storage or the field. Advantageously, this allows a plurality of barrel assemblies to be provided with springs 550 already factory pre-installed so that the user may quickly swap out barrels without having to manipulate or pre-assemble the springs in the field.

With continuing reference to FIGS. 29 and 30, barrel extension 520 may further include a circumferentially extending annular groove 524 formed immediately forward of barrel locking lugs 103 on the exterior surface 101 of the barrel extension. Annular groove 524 is provided to facilitate rotatably engaging the lugs 103 with front splines 190 of barrel nut 510 when mounting barrel 530 to rifle 20 wherein the groove prevents the radius at the base of surface 104 from making contact with the opposed surface 88 (see FIG. 28) on the barrel nut.

Barrel extension 520 includes the locking features of barrel extension 100 shown in FIGS. 14-20 which detachable mount barrel assembly 520/530 to barrel nut 510. This includes circumferentially spaced barrel locking lugs 103 with axial passageways formed between the lugs 103, which may be machined depressions 171 in some embodiments, and optionally camming notches 170. The axial passageways provided between lugs 103 form longitudinally-extending slots for slidably receiving splines 81 on barrel nut 510 axially or splines 605 on setting tool 600 to allow the barrel nut or setting tool to be axially withdrawn from barrel extension 520 without rotation.

To operably engage one end of coned disc spring 550, barrel assembly 520/530 preferably includes a rear facing radial spring seating surface 549 as shown in FIG. 23 which protrudes outwards from and is preferably raised above adjoining rearward portions of the barrel assembly. Rear facing radial spring seating surface 549 may be configured as a continuous or interrupted annular surface. In a preferred embodiment, radial spring seating surface 549 may be configured as a continuous annular surface.

In one preferred embodiment, radial spring seating surface 549 may be axially movable and adjustable in position on barrel assembly 520/530 in order to allow the spring force F of disc spring to be factory preset prior to coupling the barrel 530 to rifle 20 as further described herein. In one embodiment, radial spring seating surface 549 preferably may be disposed on a threaded lock nut 540 which threadably engages and is axially movable in position on barrel assembly 520/530 as now further explained.

Figure 31:
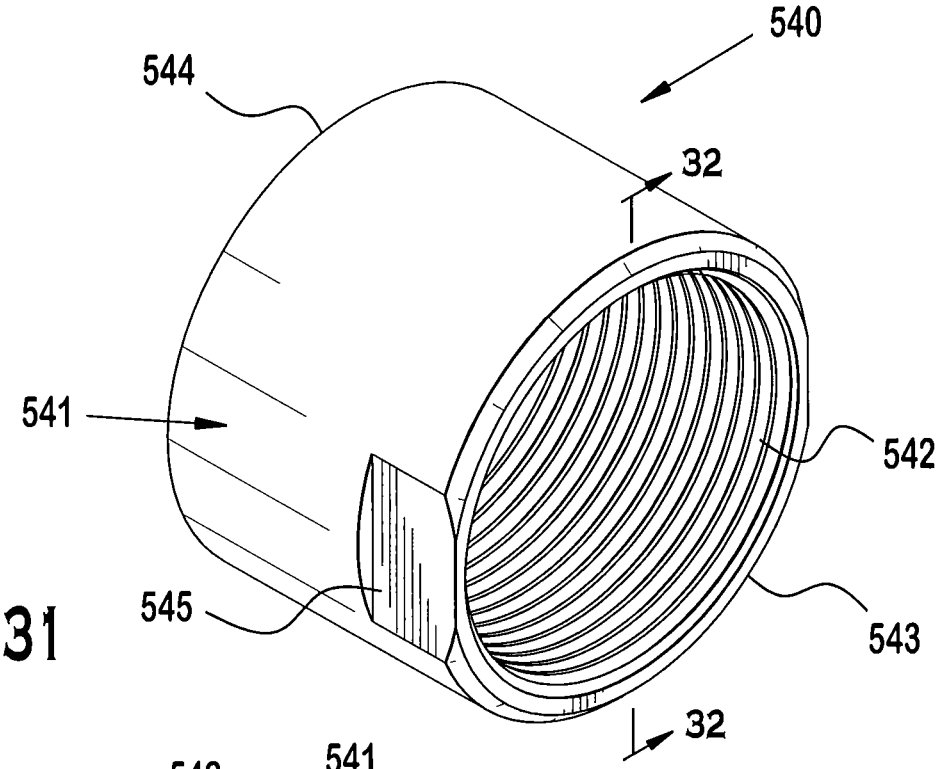
FIG. 31 is a front perspective view of the lock nut used in the rifle of FIG. 23.
Figure 32:
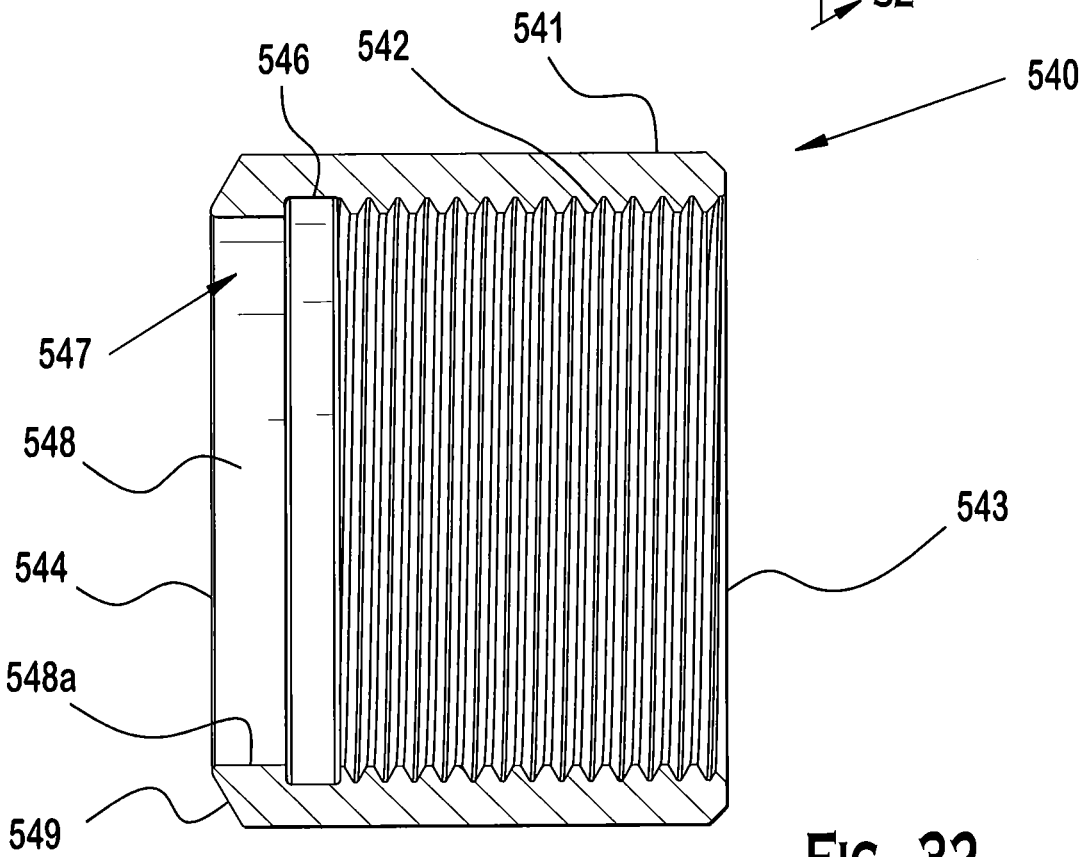
FIG. 32 is a cross-sectional side view thereof.

FIG. 31 is a front perspective view of lock nut 540 and FIG. 32 is a longitudinal cross sectional view taken from FIG. 31. In one embodiment, lock nut 540 has a generally tubular or hollow cylindrical body as shown including a front end 543, rear end 544, and outer surface 541 which may include an opposing pair of flats 545 to facilitate griping with a tool for assembling the lock nut to barrel 530 and adjusting the axial position of the lock nut. The interior surface 547 of lock nut 540 includes an internally threaded portion 542 for engaging a corresponding externally threaded portion 531 on barrel 530 (see FIGS. 33-34) which provides axial translation or movement by rotating the lock nut. In one preferred embodiment, threaded portion 542 may start proximate to front end 543 and extend rearwards preferably terminating before rear end 544. In other embodiments, internally threaded portion 531 may extend completely through lock nut 540 from front end 543 to rear end 544.

It will be appreciated in some alternative embodiments contemplated, externally threaded portion 531 on barrel 530 for engaging lock nut 540 may instead be formed on barrel extension 520. In that case, the front end 108 (see FIGS. 29-30) may be axially elongated so that externally threaded portion 531 now formed barrel extension 520 would preferably be located at the same axial position and have the same general configuration as shown in FIG. 23.

Returning now with reference to FIGS. 31-32, lock nut 540 defines rear facing annular spring contact or seating surface 549 on barrel 530. Radial spring seating surface 549 is disposed on rear end 544 of lock nut 540 in one embodiment and is configured to engage disc spring 550 (see FIG. 23). Radial spring seating surface 549 preferably may be angled or sloped in a rearward and inward direction with respect to longitudinal axis LA of barrel 530 when mounted thereon and faces outwards and away from the axial centerline of the lock nut 540 as best shown in FIGS. 23 and 32. Radial spring seating surface 549 may be oriented similarly to and complement radial spring seating surfaces 513 at the front end 84 of barrel nut 510 (FIG. 28) as best shown in FIG. 23 so that each angled annular surface slopes in the same direction with respect to the longitudinal axis LA of the barrel assembly. In other possible embodiments contemplated, radial spring seating surface 549 may be vertically oriented being disposed perpendicular to longitudinal axis LA of the barrel 530.

Figure 33:
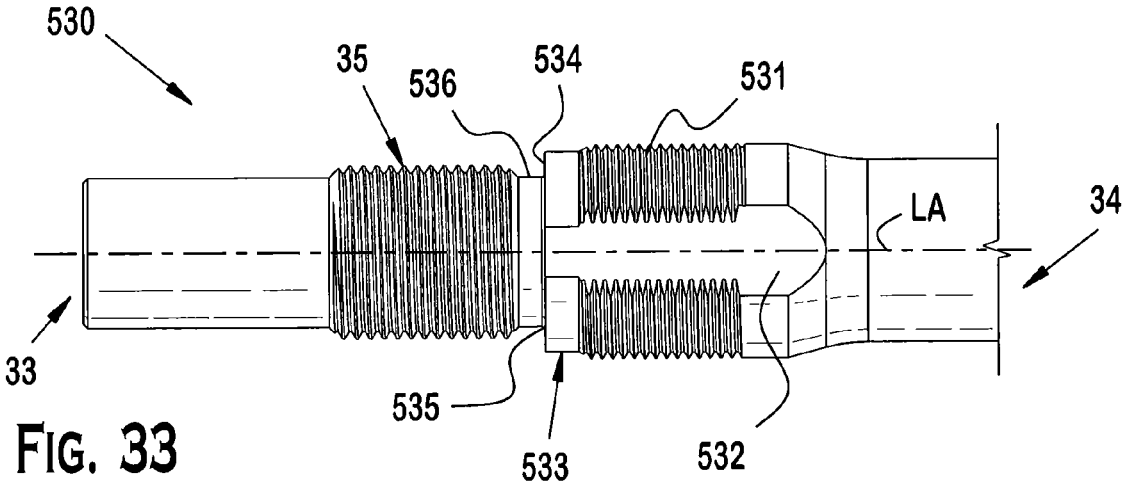
FIG. 33 is a side view of the breech end of the barrel used in the rifle of FIG. 23.
Figure 34:
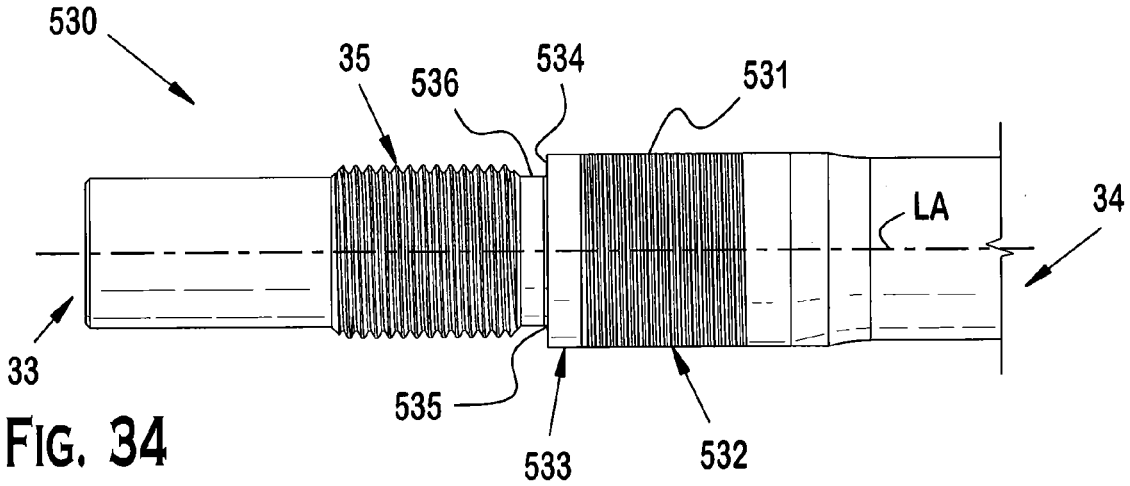
FIG. 34 is a top plan view thereof.

With continuing reference to FIGS. 31 and 32, interior surface 547 of lock nut 540 may further include a generally smooth and plain, unthreaded portion 548 proximate to rear end 544 that defines an axially disposed sliding contact surface 548*a* for slidingly engaging corresponding generally smooth and plain axially disposed exterior annular axial spring seating surface 521*a* defined by reduced diameter portion 521 on barrel extension 520 (FIG. 30) and a similarly smooth and plain axially disposed annular segment surface 533 on barrel 530 (FIGS. 33-34). Accordingly, sliding contact surface 548*a* is preferably oriented parallel to the length and longitudinal axis of the lock nut 540. During adjustment of the lock nut 540 (to be further described), the rear unthreaded plain portion 548 may slide forward and rearward over the reduced diameter portion 521 and annular segment surface 544 until a proper position is determined for the lock nut. The lack of threads in plain portion 548 of lock nut 540 prevents binding and facilitates smooth sliding contact between mating the mating axial surfaces.

As shown in FIG. 23, annular axial spring seating surface 521*a* of reduced diameter portion 521 on barrel extension 520 and annular segment surface 533 on barrel 530 preferably have the same outer diameter (measured radially outwards from longitudinal axis LA) and are preferably arranged in substantially abutting relationship when the barrel extension is fully threaded onto the barrel (a slight offset is generally acceptable provided that the resulting axial gap there between does not exceed the axial length of contact surface 548*a* on lock nut 540). This configuration and common diameters forms a uniform and substantially even or level combined axial surfaces 521*a* and 533 (see, e.g. FIG. 23) without any significant stepped transition there between for facilitating smooth sliding of interior contact surface 548*a* of lock nut 540 over the foregoing barrel and barrel extension annular surfaces when adjusting the position of the lock nut. Accordingly, lock nut 540 preferably has an internal diameter measured at plain portion 548 that is slightly larger than the outer diameter measure at reduced diameter portion 521 on barrel extension 520 and annular segment surface 533 on barrel 530 to allow contact surface 548*a* in the lock nut to slide over slid over the reduced diameter portion 521 and annular segment surface 533.

In some embodiments, as shown in FIG. 32, an annular thread relief groove 546 may be provided which is formed on interior surface 547 of lock nut 540, and extends circumferentially around and is interspersed between internally threaded portion 542 and plain portion 548.

Although in a preferred embodiment just described radial spring seating surface 549 is disposed on movable lock nut 540, in other possible embodiments contemplated radial spring seating surface 549 may instead be defined by a non-movable diametrically enlarged and radially outward extending protrusion on barrel assembly 520/530 formed by a radially raised boss or flanged portion that is integral with and/or machined on the barrel assembly 520/530. Such a boss or flanged portion may be configured and arranged similarly to radial spring seating surface 549 and lock nut 540 as shown in FIG. 23, but instead be integrally formed and a rigid part of barrel assembly 520/530. This integral alternative embodiment preferably would be located so that radial spring seating surface 549 is axially positioned on barrel assembly 520/530 to engage spring 550 when the barrel assembly is operably coupled to rifle 20. It is well within the ambit of one skilled in the art to readily reduce this alternative embodiment to practice based on the description already provided herein with respect to lock nut 540 and radial spring seating surface 549 with any further description or depiction.

Barrel 530 will now be further described. FIG. 33 is a side view of barrel 530 and FIG. 34 is a top view thereof. Barrel 530 is essentially identical to barrel 31 described with reference to FIGS. 1-22 previously and includes rear breech end 33 and forward muzzle end 34. In addition to previously provided external threads 35 for engaging internal threads 107 on barrel extension 520, barrel 530 of the self-tensioning barrel quick coupling system includes an externally threaded portion 531 for engaging threaded portion 542 of lock nut 540. Lock nut 540 may be axially moved or translated in position with respect to barrel 530 by rotating the lock nut. In one embodiment, threaded portion 531 may be axially spaced apart from external threads 35 as shown providing space for a smooth unthreaded annular segment surface 533 interspersed there between for slidably engaging contact surface 548*a* of lock nut 540 as already described. Threaded portion 531 is disposed on an enlarged diameter portion of barrel 530 whereas external threads 35 disposed rearward thereto are disposed on a reduced diameter portion of the barrel that receives barrel extension 520. These enlarged and reduced diameter portions of barrel 530 are separated by a shoulder 535 which defines a rear facing surface 534 that abuts front end 108 of barrel extension 520 when the barrel extension is mounted to the barrel (see FIG. 23). In some embodiments, threaded portion 531 may be interrupted by a pair of opposing flats 532 as shown in FIG. 33 to facilitate holding the barrel 530 with a tool or vice for mounting the lock nut 540 and barrel extension 520. Some embodiments of barrel 530 may further include a reduced diameter annular thread undercut disposed adjacent shoulder 535 as shown.

With continuing reference to FIGS. 33 and 34, a relatively smooth and plain annular segment surface 533 without threading is defined by barrel 530 for slidingly engaging contact surface 548*a* on the unthreaded portion 548 of lock nut 540 proximate to rear end 544 (FIG. 32). In one embodiment, annular segment surface 533 may be disposed immediately forward and adjacent to shoulder 535 and rearward of threaded portion 531 as shown.

According to a preferred method for assembling a rifle barrel assembly, lock nut 540 may be used to tune and preset the spring force F for coned disc spring 550 by adjusting and setting the lock nut torque to a predetermined torque setting or value (e.g. measured in inch-pounds) prior to coupling the barrel extension-barrel assembly 520/530 to rifle 20. The spring force F will be automatically replicated when the quick coupling barrel unit or assembly is mounted to the rifle 20 by the user. Since the barrel assembly 520/530 is removably coupled to rifle 20 through the handguard 50 which remains affixed to upper receiver 42 during a barrel exchange as previously described herein, there is not sufficient access to enable the lock nut torque and corresponding compression/deflection of spring 550 to be set after mounting a new barrel assembly to the rifle. Accordingly, presetting the lock nut torque prior to mounting the barrel assembly 520/530 to the rifle ensures that the desired amount of compression/deflection of the spring will be produced when actually mounting the barrel extension-barrel assembly to barrel nut 510, thereby producing the desired biasing force imparted by the spring to the barrel nut and barrel assembly on opposite ends thereof to keep the barrel tightly coupled to the rifle during repeated firings. Since there inherently is some variability in the spring constant "k" values of disc or Belleville springs, this preferred assembly method of torqueing lock nut 540 and presetting the spring 550 force advantageously provides repeatability ensuring that a uniform and desired resultant biasing force F is provided from one barrel assembly to another when the user exchanges different pre-manufactured barrels with the rifle.

Figure 36:
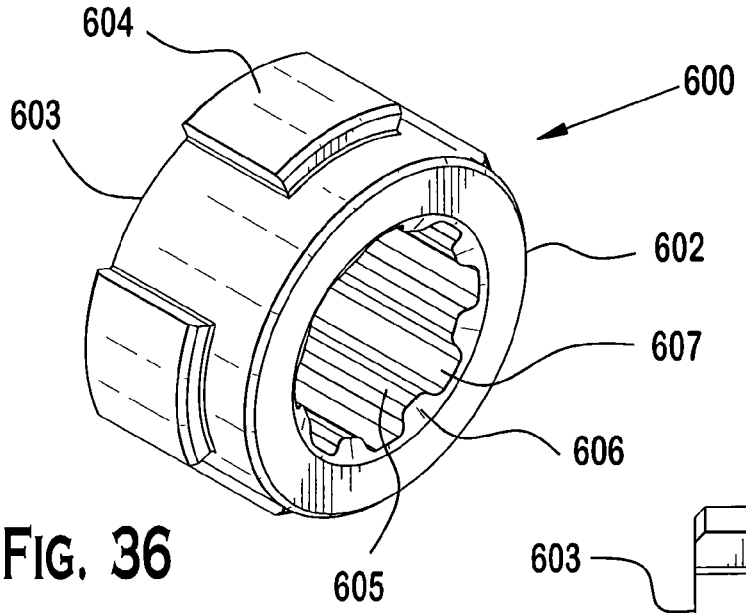
FIG. 36 is a front perspective view of a setting tool usable in assembling the barrel assembly of FIG. 35.
Figure 37:
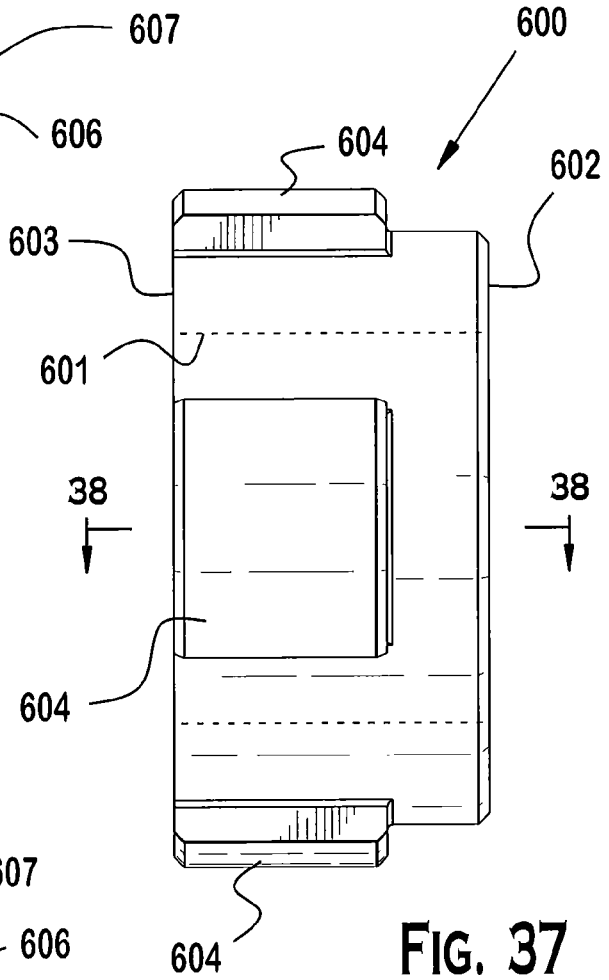
FIG. 37 is a side view thereof.
Figure 38:
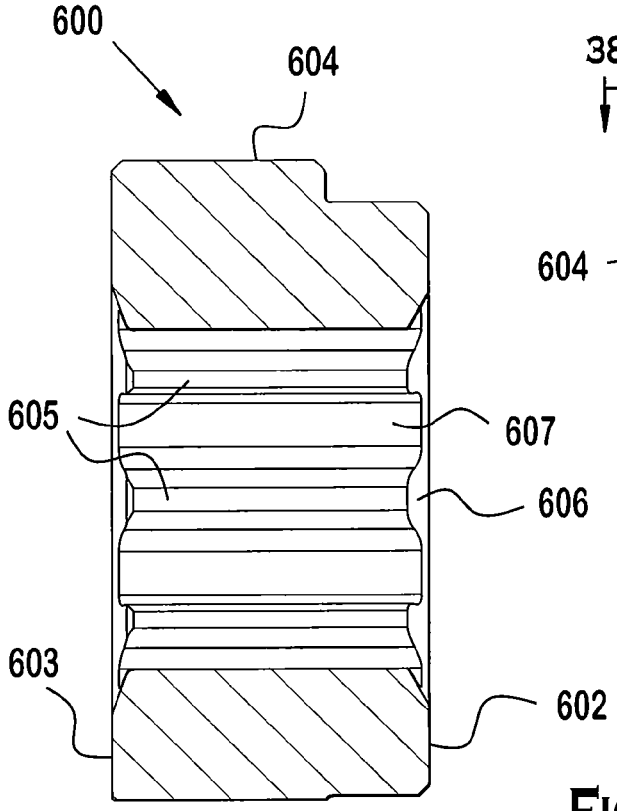
FIG. 38 is a cross-sectional side view thereof.

To facilitate presetting the torque for disc spring 550, a setting tool 600 may be provided according to one preferred embodiment as shown in FIGS. 36-38. Setting tool 600 serves as a surrogate for barrel nut 510. This allows a completely assembled rifle with quick coupling barrel assembly 520/530 attached to be replicated or simulated in advance for purposes of presetting the lock nut 540 torque and concomitantly the spring force F of disc spring 550 before the barrel assembly is ever coupled to barrel nut 510 and upper receiver 42 of an actual rifle. In one embodiment, setting tool 600 is removably mountable to barrel assembly 520/530 in the same manner as barrel nut 520 for setting the lock nut 540 torque and spring force F of disc spring 550.

Referring to FIGS. 36-38, setting tool 600 in one embodiment has a generally cylindrical and hollow or tubular body with an axial central passageway 601 extending from front end 602 to rear end 603. Passageway 601 includes a plurality of longitudinally-extending raised splines 605 projecting radially inwards an interior surface of setting tool 600. Preferably, splines 605 are circumferentially spaced apart and define a plurality of longitudinally-extending channels 607 formed between the splines. The forward ends of splines 605 each define a forward facing radial spring seating surface 606, which in some embodiments may be slightly angled rearwards and inwards towards the axial centerline of the setting tool 600. Surfaces 606 may therefore be disposed at an angle to longitudinal axis LA when the setting tool is mounted on barrel 530, and are configured and positioned to engage top end 557 of disc spring 550 in the same manner as barrel nut 510 as shown in FIG. 23 and described herein. Preferably, splines 605 are substantially identical in configuration, size, and spacing as front splines 190 on barrel nut 510 to engage and interlock with barrel locking lugs 103 and annular contact surface 523 on barrel extension 520 in a similar manner as the barrel nut.

In some embodiments, setting tool 600 may further include external surface features to facilitate gripping the tool with a wrench or other similar tool to mount the setting tool on barrel extension 520. In one embodiment, setting tool 600 includes a plurality of circumferentially spaced apart tool lugs 604 which are configured to be gripped by wrench or similar tool. In other embodiments contemplated, flats similar to flats 545 on lock nut 540 (see, e.g. FIG. 31), knurling, or hex shaped flats (similar to a hex nut) may be provided on the outer cylindrical surface of setting tool 600 to facilitate mounting the setting tool on barrel extension 520.

With continuing reference to FIGS. 36-38, setting tool 600 is operable to be mounted on barrel extension 520 in the same manner as barrel nut 510. Preferably, setting tool 600 is positioned forward of locking lugs 103 on barrel extension 520 to occupy the same position as front splines 190 on barrel nut 510 (see also FIG. 23). When mounted on barrel extension 520, front end 602 of setting tool 600 assumes the same relative axial position as and replicates front end 84 of barrel nut 510 so that spring 550 may be compressed against the setting tool to torque the lock nut 540 to the desired predetermined setting, thereby concomitantly setting the spring force F to that desired to provide a secure lock up of the barrel assembly to rifle 20. Advantageously, this also prevents over travel (i.e. excess compression) and stress on the washer when the barrel assembly 520/530 is eventually coupled to the barrel nut 510 and upper receiver 42 in addition to setting the spring force.

Spring-Loaded Quick Coupling Barrel Assembly Method

Figure 35:
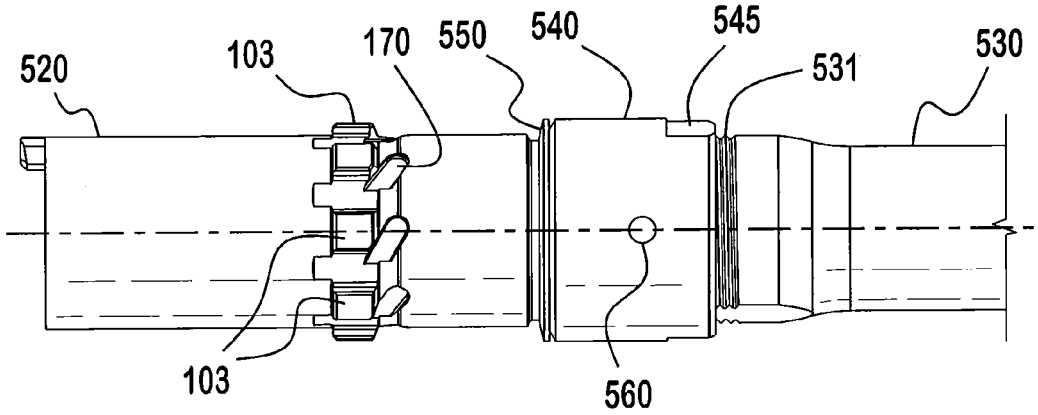
FIG. 35 is a top plan view of a fully assembled barrel assembly including the barrel, barrel extension, lock nut, and disc spring used in the rifle of FIG. 23.

A preferred exemplary method for assembling a spring-loaded quick coupling rifle barrel assembly including barrel 530, barrel extension 520, lock nut 540 and coned disc or Belleville spring 550 will now be described with primary reference to FIGS. 23-34. The present method creates a barrel assembly 520/530 that is available to a user as fully preassembled new unit ready to be exchanged with an existing barrel assembly installed on rifle 20 for changing barrel styles, lengths, replace worn or damaged barrels, etc. FIG. 35 shows the completed barrel assembly unit with the foregoing components fully assembled and coupled to barrel nut 510 pre-mounted on upper receiver 42 of the rifle 20 and ready for installation on rifle 20 as shown in FIG. 23. The present method to now be described includes presetting the lock nut 540 torque and spring force F of disc spring 550 using the setting tool 600 described above.

In a first step of the barrel assembly method according to one embodiment, the process begins installing lock nut 540 which may be performed by slipping lock nut 540 over breech end 33 of barrel 530 and then axially sliding the lock nut forward towards muzzle end 34 of the barrel over annular segment surface 533. The lock nut 540 is then rotatably engaged with barrel 530 by positioning and rotating threaded portion 542 of lock nut 540 (FIGS. 31-32) in a first rotational direction onto complementary threaded portion 531 of barrel 530 (FIGS. 33-34), which defines a first set of threads on the barrel. Continued rotation of lock nut 540 gradually moves and axially advances the lock nut forward towards muzzle end 34 of barrel 530. Lock nut 540 is axially movable forward and rearward in position on barrel 530 by concomitantly rotating the lock nut in opposing rotational directions. In one embodiment, lock nut 540 is preferably rotatably threaded onto barrel 530 and advanced forward by a sufficient axial distance to a first forward position until the annular segment surface 533 of the barrel eventually emerges from the rear end 544 of the barrel nut and becomes exposed. This position of the lock nut 520 is forward of the position shown in FIG. 23 (note available threads forward of the lock nut on threaded portion 531). Annular segment surface 533 provides a temporary seating surface for holding disc spring 550 during assembly of the barrel 530 and barrel extension 520.

With continuing reference to FIGS. 23-34, the assembly method continues with installing coned disc spring 550 (FIGS. 24-25) which may be performed by slipping coned disc spring 550 over breech end 33 of barrel 530 and axially sliding the spring forward on the barrel towards muzzle end 34. In one preferred embodiment, spring 550 may be temporarily located and positioned on exposed annular segment surface 533 on barrel 530 immediately rearward of lock nut 540 to facilitate coupling the barrel extension 520 to barrel 530.

Next, with disc spring 550 preferably loosely positioned in place on barrel 530, and preferably on or near annular segment surface 533 of barrel 530, the barrel assembly method continues with installing barrel extension 520 (FIGS. 29-30) which may be performed by slipping barrel extension 520 over breech end 33 of barrel 530 and then axially sliding the barrel extension forward towards muzzle end 34. Barrel extension 520 is then rotatably engaged with barrel 530 by positioning and rotating internal threads 107 formed on interior surface 102 of the barrel extension onto complementary shaped external threads 35 on barrel 530 (FIGS. 33-34), which defines a second set of threads on a reduced diameter portion of the barrel spaced apart from threads 531. Preferably, barrel extension 520 is rotated and axially advanced or moved forward until front end 108 of the barrel extension adjacent reduced diameter portion 522 abuts shoulder 535 and rear facing vertical surface 534 of barrel 530 adjacent annular segment surface 533 as shown in FIG. 23 preferably without any appreciable gap remaining there between. Barrel extension 520 may be tightened and torqued to a predetermined torque setting to ensure a proper and tight fit that will not loosen during repeated firings of rifle 20. In one embodiment, barrel extension exterior annular axial spring seating surface 521*a* defined by reduced diameter portion 521 (FIGS. 29-30) lies at the same radial distance from the longitudinal axis LA of barrel 530 as annular segment surface 533 of barrel 530 to form a substantially level or even axial surface (see FIG. 23) to form a smooth transition there between for slidably engaging axially aligned contact surface 548*a* formed on the unthreaded portion 548 of lock nut 540 proximate to rear end 544 of the lock nut (see FIG. 32).

As shown in FIG. 23, now with barrel extension 520 mounted on barrel 530, disc spring 550 is captured on barrel assembly 520/530 and cannot be removed from the barrel assembly without removing barrel extension 520. Spring 550 is trapped between shoulder 522 adjacent exterior annular contact surface 523 on the barrel extension 520 and rear facing radial spring seating surface 549 on lock nut 540. The diameter of barrel extension 520 at annular contact surface 523 has a larger diameter than central opening 553 of the spring 550 (FIGS. 24-25) so that the spring cannot slide rearward past shoulder 522 and forward facing annular vertical radial surface 525 formed thereon (see FIGS. 29-30). The same holds true for the diameter of exterior surface 541 of lock nut 540 which preferably is larger than the diameter of central opening 553 of disc spring 550 to prevent the spring from sliding forward past rearward facing radial spring seating surface 549 on the lock nut. In one embodiment, disc spring 550 is preferably oriented so that diametrically narrower top end 557 faces rearwards towards breech end 33 of barrel 530 as shown in FIG. 23 for engaging barrel nut 510.

With disc spring 550, lock nut 540, and barrel extension 520 now mounted on barrel 530, the preferred method for assembling the barrel assembly now continues with a series of steps using setting tool 600 describe above to tighten and set the torque value/setting of lock nut 540 to a predetermined value which will establish a secure lock up and mount when the barrel assembly 520/530 is eventually coupled to rifle 20. This concomitantly sets the spring force F to be exerted by disc spring 550 between the barrel nut 510 and barrel assembly 520/530 to provide a secure lockup.

Figure 39:
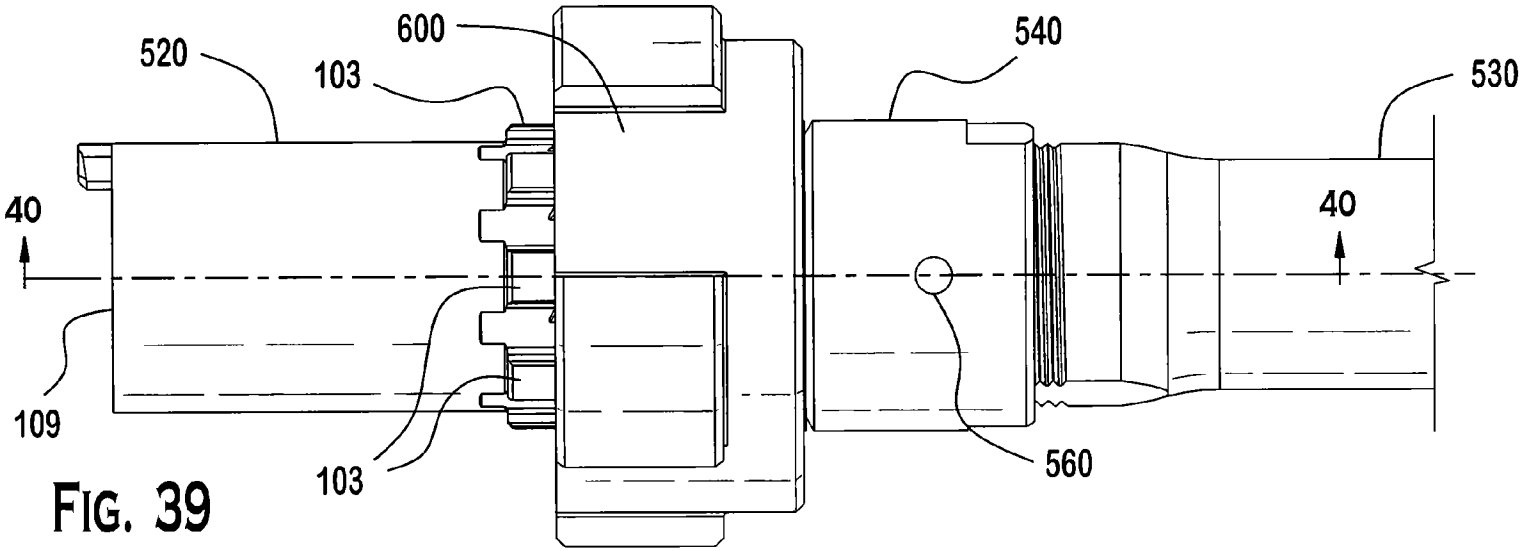
FIG. 39 is a top plan view of the barrel assembly of FIG. 35 with the setting tool of FIGS. 36-38 shown temporarily installed thereon for adjusting the torque setting of the lock nut and spring force of the disc spring.
Figure 40:
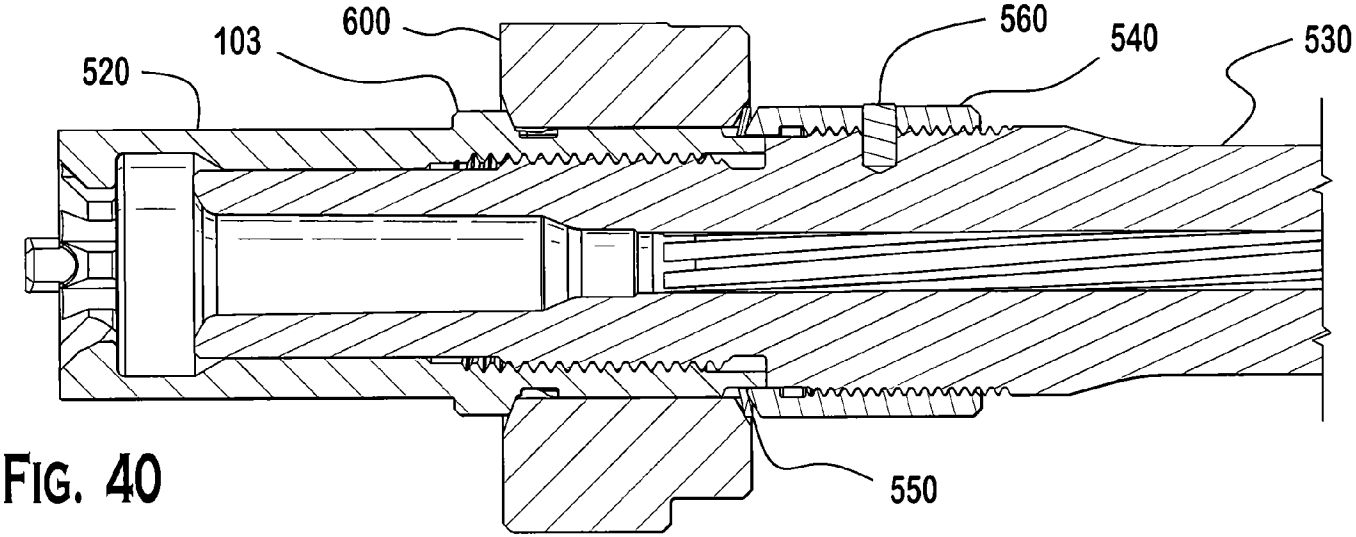
FIG. 40 is a cross-sectional side view thereof.

Reference is now made to FIGS. 36-38 showing setting tool 600 and FIGS. 39 and 40 showing the setting tool temporarily mounted on barrel extension-barrel assembly 520/530. In one embodiment, the method continues by first mounting the setting tool 600 on the barrel assembly 520/530 until the position is achieved that is shown in FIGS. 39 and 40. This may be performed by axially aligning channels 607 on setting tool 600 with barrel locking lugs 103 on barrel extension 520, axially sliding the setting tool forward on the barrel extension until barrel locking lugs 103 emerge from the rear end 603 the setting tool are exposed, and then rotating the setting tool until the locking lugs 103 are positioned behind the rear end of splines 605. Setting tool 600 cannot now be withdrawn rearward from barrel extension 520 due to the interference fit between locking lugs 103 and splines 605. Camming notches 170 on barrel extension 520 assist in providing a secure albeit temporary lock up between the splines 605 of setting tool 600 and locking lugs 103 in the same manner already described herein with respect to splines 190 on barrel nut 80. The front end of setting tool 600 is preferably located or positioned at the same axial position as would be occupied by front end 84 of barrel nut 510 when the barrel assembly 520/530 is eventually mounted to a rifle 20. With setting tool 600 now temporarily, but rigidly secured in position on the barrel assembly 520/530, the lock nut 540 torque may now be set to yield the desired spring force F of coned disc spring 550.

To next set the torque setting or value for lock nut 540, the barrel assembly method continues by first rotating the lock nut in a second rotational direction opposite the first rotational direction preferably with a torque wrench or other device. This moves and axially retracts lock nut 540 rearwards on barrel 530. Lock nut 540 is moved rearward until rear facing radial spring seating surface 549 abuttingly contacts bottom end 558 of coned disc spring 550. The opposite top end 557 of disc spring 550 is in abutting contact with front end 602 of setting tool 600 with the spring now being sandwiched between the setting tool and lock nut 540. Using the torque wrench or other device, lock nut 540 is torqued and further tightened against disc spring 550 (backed by the setting tool) with sufficient force to compress and deform/deflect the spring until a predetermined desired torque setting is reached for the lock nut, which corresponds to the desired spring force to be exerted by the spring between the lock nut and barrel assembly for secure lock up to barrel nut 510 mounted on the receiver 42. FIGS. 39 and 40 show lock nut 540 in this position being tightly engaged with setting tool 600 and disc spring 550 being compressed there between.

In some exemplary embodiments, without limitation, ranges of representative torque settings or values for lock nut 540 which may produce a spring force F by disc spring 550 sufficient to provide a secure lock up or coupling between barrel extension-barrel assembly 520/530 and barrel nut 510 on rifle 20 may be from about and including 15 inch-pounds to about and including 22 inch-pounds. In one preferred embodiment, the torque setting may be preferably about 19.5 inch-pounds +/−1 inch-pound.

After the torque value has been set for lock nut 540 in the manner described above and the desired final axial position has been reached for the lock nut on barrel 530, the lock nut is then preferably rigidly fixed in position on the barrel to prevent rotation and loosening from vibrations produced by repeated firings of rifle 20. It should be noted that the now assembled barrel extension-barrel assembly 520/530 has not yet been mounted to rifle 20. Lock nut 540 may be rigidly fixed to barrel 530 by any suitable method commonly used in the art. In one embodiment, for example, lock nut 540 may be fixedly attached to barrel 530 by pinning including drilling a transversely extending hole completely through the side wall of the lock nut and partially into barrel 530, and then inserting a pin 560 completely through the hole in the lock nut and into the partial depth hole formed in the barrel. This fixes the axial position of the lock nut 540 as shown in FIGS. 39 and 40. In other possible embodiments, lock nut 540 may be permanently fixed to barrel 530 by any other suitable mechanical techniques commonly used in the art including tack welding or brazing, adhesives, threaded fasteners, or other known methods. Fixing the position of lock nut 540 will determine the maximum possible deflection of and spring force F created by coned disc spring 550 when the barrel is eventually coupled to barrel nut 510 and rifle 20 for use.

With lock nut 540 fixed in its final position on barrel 530, the setting tool 600 is then removed by rotating the setting tool until internal channels 607 are once again axially aligned with barrel locking lugs 103 on barrel extension 520. The setting tool 600 may now be axially withdrawn rearwards from barrel extension 520 and removed. Without setting tool 600 in place for bracing and supporting disc spring 550, the spring may become slightly or completely uncompressed and may be slightly loose with a very limited range of axial movement possible between lock nut 540 and shoulder 522 on barrel extension 520. The spring 550, however, still remains trapped on barrel 530 and cannot be removed with the barrel extension 520 still in place.

The rear portion of completed barrel assembly 520/530 would now appear as shown in FIG. 35 with lock nut 540 pinned in position and disc spring 550 rearward thereof. The barrel extension-barrel assembly 520/530 is now ready for mounting and coupling to rifle 20 or alternatively may be stored in a kit including a plurality of other assembled quick coupling barrel units ready for later mounting to a rifle.

According to an alternative variation of the barrel assembly method, a threaded set nut (not shown) configured similarly to lock nut 540 or configured as a conventional hex nut could instead be threaded onto thread 35 of barrel 530 (see FIGS. 33-34) before installing the barrel extension 520, but after installing disc spring 550 and lock nut 540 in the manner already described above. The set nut would be sized such that a forward face of the set nut would terminate at the same location as the barrel nut 540 when the set nut is fully threaded onto the barrel 530. The disc spring 550 would be compressed between the set nut and lock nut 540 after setting the torque of the lock nut (and hence the spring force also) and pinning it in position as already described above. The set nut would next be removed and then the barrel extension 520 may be installed to barrel nut 540 with the spring force of spring 550 having already been set.

According to yet another alternative possible embodiment of the barrel assembly method, the use of setting tool 600 may be omitted wherein the desired axial position of lock nut 540 on barrel 530 may instead be established by exacting measurement techniques in lieu of pre-torqueing the lock nut against disc spring 550 and the setting tool. Through trial and error, empirical methods, and/or engineering calculations, one skilled in the art may determine the desired axial position of lock nut 540 associated with producing the intended spring force F from disc spring 550 when the barrel assembly 520/530 is mounted to rifle 20. In one embodiment, for example, a conventional optical comparator may be used to adjust and set the position of lock nut 540 using optical principles. A comparator produces a magnified silhouette of parts such as the barrel nut and barrel assembly 520/530 that are projected upon a screen and basically functions according to the principles presented in U.S. Pat. No. 1,703,933 entitled "Optical Comparator" to Hartness, which is incorporated herein by reference in its entirety. Lock nut 540 may then be rotated to adjust its axial position in the manner prescribed above. The desired position of lock nut 540 may then be measured and established from a reference point on the barrel assembly 520/530, such as without limitation barrel locking lugs 103 or shoulder 522 on the barrel extension (FIG. 29-30), vertical surface 525 at shoulder 522 on barrel extension 520, or another suitable reference point. Optical comparators are commercially available from manufacturers such as J&L Metrology Inc. of Springfield, Vt. and others. Lock nut 540 may then be fixed to barrel 530 by pinning or another suitable method in the manner described above.

Spring-Loaded Quick Coupling Barrel Installation Method

The spring-loaded self-tensioning quick coupling embodiment barrel assembly 520/530, as shown in FIG. 35 and including disc spring 550, may be installed onto and subsequently removed from rifle 20 in the same manner as already described herein with reference to alternative embodiment barrel 31 and FIGS. 1-22. Preferably, spring-loaded barrel assembly 520/530 may be installed on rifle 20 without separate installation tools in a preferred embodiment, thereby advantageously allowing a new barrel assembly to be rapidly exchanged in the field without concerns for carrying and potentially losing barrel installation tools. The method for installing spring-loaded barrel extension-barrel assembly 520/530 will now be briefly summarized.

A barrel assembly 520/530, which may be pre-assembled in one embodiment according to the method just described above, is first provided and would appear generally the same as barrel 31 shown in FIG. 5 with exception that the rear portion of the assembly would instead be as shown in FIG. 35 for the spring-loaded barrel embodiment with disc spring 550 and lock nut 540 mounted thereon. Barrel assembly 520/530 in a preferred embodiment may include barrel operating handle 150, which is rotatable about longitudinal axis LA between a stowed position (shown in FIG. 22) in which the handle is tucked in proximate to barrel assembly 520/530 and a deployed position (shown in dashed lines in FIG. 22) in which the handle extends outwards farther and distally from the barrel assembly than in the stowed position as already described herein. Other components as shown in FIG. 5 may also be provided including gas piston operating system 70 and latch plunger 141 mechanism. Rifle 20 is also provided without a barrel installed and ready to receive a new barrel assembly 520/530. Without a barrel installed and in place, handguard 50 preferably remains attached to upper receiver 42 as well as barrel nut 510 (FIG. 28) is threadably coupled to mounting nipple 48 on the upper receiver.

To install a new barrel assembly 520/530, the installation method continues with the user then orienting the barrel assembly with the top of barrel 530 radially offset from the top center of the rifle 20. Barrel locking lugs 103 are preferably each radially aligned or oriented with a channel 82 formed in barrel nut 510. In one exemplary embodiment without limitation wherein 8 barrel locking lugs 103 may be provided, the barrel assembly 520/530 may be oriented at between about the 1-2 o'clock radial position (viewed facing upper receiver 42) in one embodiment, which radially aligns the locking lugs 103 with channels 81 (see, e.g. FIG. 9 for radial orientation of barrel nut splines and channels). This position of the barrel assembly also preferably corresponds to the removal position of the old barrel.

Next, the barrel assembly 520/530 is inserted axially rearwards through the front of handguard 50 (which remains attached to rifle 20) until barrel extension 520 is fully inserted into and seated within barrel nut 510. In this final seated axial position, breech end 33 of barrel assembly 520/530 preferably abuttingly contacts receiver 42 to be in position for receiving and engaging bolt lugs 64 on bolt 62 which engage corresponding bolt locking lugs 105 on barrel extension 520 to lock the breech prior to firing rifle 20 (see, e.g. FIGS. 4, 8A, 8B, and 14). Barrel locking lugs 103 will enter and slide rearwards in channels 82 of barrel nut 510. In addition, barrel extension 520 is preferably configured and dimensioned such that barrel locking lugs 103 will concomitantly be located and fall into proper position within circumferential locking groove 87 of barrel nut 510 when barrel assembly 520/530 is fully seated in barrel nut 510. Preferably, the user slides barrel assembly 520/530 rearwards with sufficient axial force to partially compress and deform coned disc spring 550 between forward facing radial spring seating surfaces 513 on front end 108 of barrel nut 510 (FIG. 28) and rearward facing radial spring seating surface 549 on rear end 544 of lock nut 540 (FIG. 32) to locate barrel locking lugs 103 in locking groove 87 in the barrel nut.

With the user preferably retracting latch plunger 141 associated with barrel operating handle 150 rearwards again (via the latch trigger 144), the user next rotates barrel assembly 520/530 counterclockwise (viewed facing upper receiver 42) in a first rotational direction to a locked position. This rotationally engages barrel locking lugs 103 with splines 81 to lock barrel extension 520 into barrel nut 510 in the same manner already described herein with reference to FIGS. 1-22. In one preferred embodiment wherein eight barrel locking lugs 103 may be provided, barrel assembly 520/530 may be rotated by about +/−22.5 degrees or a ⅛ turn in a until gas block 71 is at top center position and aperture 145 of latch flange 143 is axially aligned again with latch plunger 141 (FIGS. 2, 6A, and 7). The camming action between the rear radial locking surface 88 of splines 81 (i.e. front splines 190 as shown e.g. in FIG. 28) and camming notch 170 disposed at front radial locking surface 104 of each barrel locking lug 103 (see, e.g. FIGS. 29 and 35) draws barrel extension 520 slightly farther axially rearward toward receiver 42 in the manner already described herein to tighten the engagement between the splines and locking lugs. This final rearward axial displacement of barrel extension 520 now further and fully compresses disc spring 550 to a predetermined extent which reproduces approximately the same spring force F between lock nut 540 and barrel nut 510 that was preset during assembly of the barrel assembly 520/530 using setting tool 600 to torque lock nut 540 as already described herein.

In the locked position just described, barrel assembly 520/530 is biased forward away from barrel nut 510 by disc spring 550 toward muzzle end 32 via engagement between barrel nut 510 (i.e. radial spring seating surface 513) and lock nut 540 (i.e. radial spring seating surface 549) which are axially forced apart in opposing directions. Barrel locking lugs 103 of barrel extension 520 are now positioned directly behind front splines 190 on barrel nut 510 preventing axial withdrawal and removal of barrel assembly 520/530 from the upper receiver 42 by interference between the splines and locking lugs. As shown in the final locked and ready-to-fire rotational position of barrel assembly 520/530 and rifle 20 shown in FIG. 23, front radial locking surfaces 104 of barrel locking lugs 103 now rotationally engage and are fully compressed against rear radial locking surfaces 88 of front splines 190 (see also FIGS. 4 and 28, and compressive locking force F1) with axial biasing force F of spring 550 assisting to keep the locking lugs 103 and splines 190 in tight and secure mutual engagement thereby forming a secure lockup. Front splines 190 of barrel nut 510 are wedged between barrel locking lugs 103 at the rear and disc spring 550 at the front behind lock nut 540 which provides a flexible and deformable interface between the front end 84 of barrel nut and barrel assembly 520/530, specifically barrel extension 520 in one embodiment.

As shown in FIGS. 4 and 23, it should be noted that the axial compressive engagement and self-tensioning force F2 at the front end of barrel nut 510 is now established between axially facing radial spring seating surfaces 513 on barrel nut 510 (formerly designed locking surface 165 in FIG. 4) and radial spring seating surface 549 on lock nut 540 with disc spring 550 disposed therebetween and transmitting the force between the lock nut and barrel nut. This self-adjusting and flexible interface between the barrel assembly 520/530 (via lock nut 540) and barrel nut 510 alleviates the strict manufacturing tolerances required for machining and placement of locking flange 112 associated with barrel extension 100 in the prior embodiment described herein (see, e.g. FIGS. 14 and 15). The tolerance stack between flange 112 on the barrel extension and splines 81 at the front of the barrel nut are reduced and replaced by the self-adjusting flexible interface instead.

It will be known by those skilled in the art that a tolerance stack or stackup generally refers to the result of conventional analyses performed by engineers to account for the accumulated variations (+/−) in specified tolerances and dimensions between mating parts in an assembly and/or machined surfaces on a single part due in part to variations encountered in manufacturing accuracy and machine limitations. Since parts are preferably designed and manufactured to account for maximum and minimum variations in dimensions or clearances, reducing the number of parts and/or fixed surfaces on mating components minimizes the potential variations which might adversely affect proper meshing and functioning of the overall assembly especially considering service factors such as temperature and wear. Accordingly, the flexible interface provided between front end 84 of barrel nut 510 and barrel assembly 520/530 (i.e. lock nut 540) by disc spring 550 is self compensating in axial dimension thereby reducing the tolerance stack between these components to beneficially promote tight coupling of the barrel assembly to rifle. In addition, the axial self-adjustment provided by disc spring 550 further automatically compensates for the tolerance stack rearward between barrel locking lugs 103 on barrel extension 520 and splines 81 on barrel nut 510 which also contributes to proper coupling of the barrel assembly to the rifle.

Returning now to discussion of barrel assembly 520/530 which is fully seated and rotated into its final locked and ready-to-fire position as shown in FIG. 23, the user may release latch trigger 144 so that latch plunger 141 enters aperture 145 of latch flange 143 to lock the front of barrel assembly to handguard 50 (see, e.g. FIG. 7) in the manner already described herein. Barrel assembly 520/530 is fully locked to rifle 20 as shown in FIG. 1 and ready to be fired.

To remove the barrel assembly 520/530, the foregoing steps would be reversed in a similar manner already described herein for non-spring-loaded barrel assembly described with respect to FIGS. 1-22. To summarize, in general, the user would rotate barrel assembly 520/530 clockwise (viewed facing front of upper receiver 42) in a second rotational direction opposite the first rotational direction used when locking the barrel assembly to the rifle. This rotationally disengages barrel locking lugs 103 on barrel extension 520 from splines 81 on barrel nut 510 to unlock barrel assembly. Barrel assembly 520/530 is now in an unlocked rotational position in which barrel locking lugs 103 on barrel extension 530 are positioned still in locking groove 87 (FIG. 28) and are now axially aligned with channels 82 in barrel nut 510 (see, e.g. FIGS. 9 and 28). Barrel assembly 520/530 is now axially removable from barrel nut 510 and rifle 20 wherein barrel locking lugs 103 may slide forward in channels 82 of the barrel nut. Barrel assembly 520/530 may be fully removed from rifle 20 without the user being required to remove barrel nut 510 and handguard 50 which remain attached to the rifle being preferably supported independently of the barrel assembly as already described herein.

Although embodiments of a barrel retaining system according to principles of the present invention has been described for convenience with reference to a firearm in the form of an rifle, it will be appreciated that the invention may be used with any type of firearm or weapon wherein a rotatable attachment of a barrel to a frame or receiver may be beneficially used, such as in pistols, artillery, etc. In addition, embodiments of a barrel retaining system and barrel assembly described herein with respect to firearms having automatic axially reciprocating bolts in the form of gas-operated bolt return systems may be used with equal benefit in spring-biased only bolt return mechanisms or manual bolt return systems. Accordingly, the invention is not limited to use in any particular type of bolt return system.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes and/or control logic as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A quick coupling barrel assembly for removable mounting to a receiver of a rifle, the barrel assembly comprising:

a barrel having a bore defining a longitudinal axis and an axial path for a bullet; a barrel extension having a front end coupled to the barrel and a rear end for coupling to the receiver of the rifle, the barrel and barrel extension collectively defining a barrel assembly;

an annular shaped spring member coaxially mounted on the barrel assembly;

a first radial spring seating surface disposed on the barrel assembly and facing in an axial direction; and a setting tool removably mounted on the barrel assembly, the setting tool defining a second radial spring seating surface, the spring being engageable between the first and second radial seating surfaces;

wherein the spring member is positioned for compression against the radial spring seating surface when the barrel assembly is mounted to the receiver of the rifle;

wherein the setting tool comprises a plurality of splines engageable with a plurality of corresponding barrel locking lugs disposed on the barrel assembly, wherein the setting tool is rotatable in a first rotational direction to lock the setting tool on the barrel assembly and further rotatable in a second rotational direction to unlock the setting tool from the barrel assembly.

2. The barrel assembly of claim 1, wherein the spring member has a central opening sized to be received over the barrel assembly.

3. The barrel assembly of claim 2, wherein the spring member is disposed between the radial spring seating surface and the rear end of the barrel extension.

4. The barrel assembly of claim 2, wherein the spring member is trapped between the radial spring, seating surface and a shoulder disposed on the barrel extension wherein the spring cannot be removed from barrel assembly without removing the barrel extension.

5. The barrel assembly of claim 4, wherein the barrel extension includes a reduced diameter portion defining an axial spring seating surface disposed between the shoulder and the radial spring seating surface on the barrel assembly.

6. The barrel assembly of claim 2, wherein the spring member is a coned disc spring.

7. The barrel assembly of claim 1, wherein the radial spring surface is an annular surface defined on a lock nut threadably engaged with the barrel assembly, the lock nut movable forward and rearward on the barrel assembly via rotating the lock, nut, wherein the radial spring surface is axially adjustable in position.

8. The barrel assembly of claim 1, further comprising a barrel nut removably mourned to the barrel assembly and having a threaded end mountable to the receiver of the rifle, the barrel nut defining a second radial spring seating surface, the spring being engageable between the first and second radial seating surfaces.

9. A quick coupling barrel assembly for removable mounting to a receiver of a rifle, the barrel assembly comprising:

a barrel having a bore defining a longitudinal axis and an axial path for a bullet;

a barrel extension having a front end coupled to the barrel and a rear end for coupling to the receiver of the rifle, the barrel and barrel extension collective defining a barrel assembly;

an annular shaped spring member coaxially mounted on the barrel assembly;

a first radial spring seating surface disposed on the barrel assembly and facing in an axial direction; and a barrel nut removably mounted to the barrel assembly and having a threaded end mountable to the receiver of the rifle, the barrel nut defining a second radial spring seating surface, the spring being engageable between the first and second radial seating surfaces;

wherein the spring member is positioned for compression against the radial spring seating surface when the barrel assembly is mounted to the receiver of the rifle;

wherein the barrel nut comprises a plurality of splines engageable with a plurality of corresponding barrel locking lugs disposed on the barrel assembly, wherein the barrel assembly is rotatable in a first rotational direction to lock the barrel assembly to the barrel nut and further rotatable in a second rotational direction to unlock the barrel assembly from the barrel nut.

10. A quick coupling barrel assembly for removable mounting to a receiver of a rifle, the barrel assembly comprising;

a barrel having, a bore defining a longitudinal axis and an axial path for a bullet;

a barrel extension having a front end coupled to the barrel and a rear end for coupling to the receiver of the rifle, the barrel and barrel extension collectively defining a barrel assembly;

a first radial spring seating surface disposed on the barrel assembly and facing in an axial direction, the first seating surface being axially adjustable in position by a user;

a coned disc spring coaxially mounted about the barrel assembly; and a setting tool removably mounted on the barrel assembly, the setting tool defining a second radial spring seating surface the spring being engageable between the first and second radial seating surfaces;

wherein the spring member is positioned for compression against the first radial spring seating surface when the barrel assembly is mounted to the receiver of the rifle;

wherein the setting tool comprises a plurality of splines engageable with a plurality of corresponding barrel locking lugs disposed on the barrel assembly, wherein the setting tool is rotatable in a first rotational direction to lock the setting tool on the barrel assembly and further rotatable in a second rotational direction to unlock the setting tool from the barrel assembly.

11. The barrel assembly of claim 10, further comprising a lock nut threadably mounted on the barrel assembly and axially movable forward and rearward, the lock nut defining the first radial spring seating. surface thereon.

12. The barrel assembly of claim 10, wherein the spring member is disposed between the first radial spring seating surface and the rear end of the barrel extension.

13. The barrel assembly of claim 10, wherein the spring member is trapped between the first radial spring seating surface and a shoulder disposed on the barrel extension, wherein the spring cannot be removed from barrel assembly without removing the barrel extension.

14. The barrel assembly of claim 10, wherein the barrel extension includes a reduced diameter portion defining an axial spring seating surface disposed between the shoulder and the first radial spring seating surface on the barrel assembly, the spring being positionable on the axial spring seating surface.

15. The barrel assembly of claim 10, further comprising a barrel nut removably mounted to the barrel assembly and having a threaded end mountable to the receiver of the rifle, the barrel nut defining a second radial spring seating surface, the spring being engageable between the first and second radial seating surfaces.

16. The barrel assembly of claim 11, wherein the barrel includes a first set of threads engageable with a mating set of threads on the barrel extension for coupling the barrel extension to the barrel, and wherein the barrel includes a second set of threads spaced apart from the first set of threads and engageable with the lock nut.

17. The barrel assembly of claim 16, wherein the first set of threads is located on a reduced diameter portion of the barrel.

18. A method for assembling a spring-loaded barrel assembly for a firearm, the method comprising:

coaxial sliding a lock nut over one end of a firearm barrel:

threadably engaging the lock nut with a firearm barrel, the barrel having a bore defining a longitudinal axis and an axial pathway for a bullet;

installing an annular shaped coned disc spring coaxially over the barrel;

removably mounting a barrel extension to the barrel thereby defining a barrel assembly, the barrel extension being configured for mounting to a receiver of a firearm;

wherein the spring is trapped on the barrel by the barrel extension so that the spring cannot be removed without dismounting the barrel extension;

installing an annular shaped setting tool coaxially onto the barrel extension; and locking the setting tool to the barrel extension by rotating the setting tool in a first rotational direction to a locked position in which the setting tool cannot be axially withdrawn from the barrel extension.

19. The method of claim 18, wherein the locking step includes positioning splines on the setting tool in front of barrel locking lugs disposed on the barrel extension.

20. The method of claim 19, comprising a step of unlocking the setting tool from the barrel extension by rotating the setting tool in a second rotational direction to an unlocked position in which the setting tool can be axially withdrawn from the barrel extension, the second rotational direction being opposite the first rotational direction.

21. The method of claim 20, wherein the unlocking step includes positioning the splines on the setting tool between the barrel locking lugs on the barrel extension.

22. The method of claim 18, further comprising a step of compressing the disc spring against the setting tool with the lock, nut by rotating the lock nut.

23. The method of claim 22, wherein the compressing step includes torqueing the lock nut to a predetermined value to set the spring force of the spring.

24. The method of claim 23, further comprising a step of fixing the lock nut in an axial position in a manner that prevents rotating the lock nut.

25. A method for assembling a spring-loaded barrel assembly for a firearm, the method comprising:

threadably engaging a lock nut with a firearm barrel, the barrel having a bore defining a longitudinal axis and an axial pathway for a bullet;

installing an annular shaped coned disc spring coaxially over the barrel:

removably mounting a barrel extension to the barrel thereby defining a barrel assembly, the barrel extension being configured for mounting to a receiver of a firearm, wherein the spring is trapped on the barrel by the barrel extension so that the spring cannot be removed without dismounting the barrel extension;

mounting a barrel nut on the barrel extension; and compressing the spring between the barrel nut and a surface on the barrel assembly.

* * * * *

UNITED STATES PATENT AND TRADEMARK OFFICE

CERTIFICATE OF CORRECTION

PATENT NO. : 8,490,312 B2
APPLICATION NO. : 13/101548
DATED : July 23, 2013
INVENTOR(S) : Jonathan Barrett et al.

It is certified that error appears in the above-identified patent and that said Letters Patent is hereby corrected as shown below:

In the Claims

Column 42, line 5, the punctuation "," should be deleted
Column 42, line 19, after the text "lock" delete the punctuation ","
Column 42, line 22, the text "mourned" should be changed to --mounted--
Column 42, line 33, the text "collective" should be changed to --collectively--
Column 42, line 56, the punctuation ";" should be changed to --:--
Column 42, line 57, after the text "having" delete the punctuation ","
Column 43, line 3, after the text "surface" insert the punctuation --,--
Column 43, line 18, after the text "seating" delete the punctuation "."
Column 43, line 49, the text "coaxial" should be changed to --coaxially--
Column 43, line 49, the punctuation ":" should be changed to --;--
Column 44, line 18, after the text "claim 19," insert the text --further--
Column 44, line 29, after the text "lock" delete the punctuation ","
Column 44, line 42, the punctuation ":" should be changed to --;--

Signed and Sealed this
First Day of April, 2014

Michelle K. Lee

Michelle K. Lee
*Deputy Director of the United States Patent and Trademark Office*